US005242785A

United States Patent [19]

Morigaki et al.

[11] Patent Number: 5,242,785

[45] Date of Patent: Sep. 7, 1993

[54] SILVER HALIDE COLOR PHOTOGRAPHIC MATERIAL CONTAINING COLOR STAIN INHIBITORS AND DISCOLORING INHIBITORS

[75] Inventors: Masakazu Morigaki; Nobuo Seto, both of Kanagawa, Japan

[73] Assignee: Fuji Photo Film Co., Ltd., Kanagawa, Japan

[21] Appl. No.: 873,340

[22] Filed: Apr. 20, 1992

Related U.S. Application Data

[63] Continuation of Ser. No. 511,905, Apr. 23, 1990, abandoned, which is a continuation of Ser. No. 212,370, Jun. 27, 1988, abandoned.

[30] Foreign Application Priority Data

Jun. 25, 1987 [JP] Japan ..... 62-158342

[51] Int. Cl.[5] ..... G03C 1/34; G03C 7/392

[52] U.S. Cl. ..... 430/505; 430/541; 430/551

[58] Field of Search ..... 430/372, 551, 549, 546, 430/545, 609, 627, 505

[56] References Cited

U.S. PATENT DOCUMENTS

| | | | |
|---|---|---|---|
| 3,725,063 | 4/1973 | Wolfarth et al. | 430/551 |
| 4,204,807 | 5/1980 | Kuffner et al. | 430/566 |
| 4,590,153 | 5/1986 | Kawagishi et al. | 430/551 |
| 4,675,275 | 6/1987 | Nishijima et al. | 430/551 |
| 4,704,350 | 11/1987 | Moriguki et al. | 430/546 |
| 4,748,107 | 5/1988 | Umemoto et al. | 430/551 |
| 4,770,987 | 9/1988 | Takahashi et al. | 430/546 |
| 4,820,614 | 4/1989 | Takada et al. | 430/551 |
| 4,839,264 | 6/1989 | Kida et al. | 430/551 |
| 5,047,315 | 9/1991 | Morigaki et al. | 430/546 |

FOREIGN PATENT DOCUMENTS

| | | | |
|---|---|---|---|
| 145342 | 6/1985 | European Pat. Off. . | |
| 162328 | 11/1985 | European Pat. Off. . | |
| 255722 | 2/1988 | European Pat. Off. . | |
| 258622 | 3/1988 | European Pat. Off. . | |
| 052698 | 5/1971 | Fed. Rep. of Germany . | |
| 62-69266 | 3/1987 | Japan | 430/551 |

*Primary Examiner*—Lee C. Wright

*Attorney, Agent, or Firm*—Sughrue, Mion, Zinn, Macpeak & Seas

[57] ABSTRACT

A silver halide color photographic material comprising a support having thereon at least one silver halide emulsion layer, wherein the silver halide color photographic material contains (1) at least one compound selected from the group consisting of compounds represented by the general formula (I), (II) or (III) and dimers or higher polymers containing at least one moiety derived from the compounds, and (2) at least one compound selected from the group consisting of organic color fading preventing agents represented by the general formula (IV) and dimers or higher polymers containing at least one moiety derived from the agents, organic metal complexes containing copper, cobalt, nickel, palladium or platinum as the central metal and having at least one organic ligand having at least one conformation and dimers or higher polymers containing at least one moiety derived from the complexes:

$$R_1\text{-}(A)_n\text{-}X \quad \text{(I)}$$

$$R_2\text{-}\underset{\underset{B}{|}}{C}=Y \quad \text{(II)}$$

$$R\text{-}Z \quad \text{(III)}$$

$$R_{30}\text{-}W\text{-}R_{31} \quad \text{(IV)}$$

wherein $R_{30}$ represents an aliphatic group, an aromatic group or a heterocyclic group; $R_{31}$ represents a hydrogen atom, an aliphatic group, an aromatic group, a heterocyclic group or $$-Si(R_{32})(R_{33})(R_{34});$$

W represents —O—, —S— or $$-\underset{\underset{R_{35}}{|}}{N}-;$$

wherein $R_{30}$ and $R_{31}$, or $R_{35}$ and $R_{30}$ or $R_{31}$ may be connected to each other to form a 5-membered to 7-membered ring.

19 Claims, No Drawings

SILVER HALIDE COLOR PHOTOGRAPHIC MATERIAL CONTAINING COLOR STAIN INHIBITORS AND DISCOLORING INHIBITORS

This is a continuation of application Ser. No. 07/511,905, filed Apr. 23, 1990 (now abandoned), which is a continuation of application Ser. No. 07/212,370, filed Jun. 27, 1988, now abandoned.

FIELD OF THE INVENTION

The present invention relates to a silver halide color photographic light-sensitive material, and more particularly relates to a silver halide color photographic material which exhibits excellent fastness to light, heat and humidity and exhibits less formation of stain.

BACKGROUND OF THE INVENTION

When a silver halide color photographic material is imagewise exposed and developed with an aromatic amine color developing agent, dye images are formed by a reaction of dye image forming coupler(s) (hereinafter simply referred to as coupler(s)) and an oxidation product of the color developing agent formed as the result of development. For a multicolor photographic material, a combination of a yellow coupler, a cyan coupler, and a magenta coupler is usually used.

In general, the quality of photographic images obtained from silver halide color photographic materials is not permanent and degrades during preservation with the lapse of time. Particularly, with respect to color photographs, when they are exposed to light for a long period of time or preserved under conditions of high temperature and high humidity, color fading or discoloration of dye images and discoloration of the white background ordinarily occur and the color images degrade. This degradation of the color image is a fatal defect for recording materials.

In order to eliminate such a defect, various proposals have hitherto been made. Among these proposals, methods of using color fading preventing agents are extremely effective. As such color fading preventing agents, there are known, for example, hydroquinones, hindered phenols, tocopherols, chromans, coumarans, and the compounds formed by etherifying the phenolic hydroxy groups of these compounds as described in U.S. Pat. Nos. 3,935,016, 3,930,866, 3,700,455, 3,764,337, 3,432,300, 3,573,050 and 4,254,216, British Patents 2,066,975 and 1,326,889, Japanese Patent Publication No. 30462/76, etc.

These compounds may have the effect of preventing color fading and discoloration of dye images, but since the effect is yet insufficient for meeting the customers' requirement for high image quality and the use of these compounds changes the hue, forms fogs, causes poor dispersibility, and causes fine crystals after coating silver halide emulsions, overall excellent effects for color photography have not yet been obtained by the use of these compounds.

Further, it has recently been found that color stain occurs during preservation after development processing owing to the fact that components of the processing solutions remain in the processed photographic materials. Of the components of processing solutions, the use of a color developing agent is particularly of concern because it causes the occurrence of color stain. For the purpose of preventing the occurrence of color stain, the effectiveness of certain amine compounds have been proposed in U.S. Pat. Nos. 4,463,085 and 4,483,918, Japanese Patent Application (OPI) Nos. 218445/84 and 229557/84, etc. (the term "OPI" as used herein means a "published unexamined patent application").

However, these compounds are still insufficient in achieving an overall preservability of color photographs, although some degree of improvement in preventing the occurrence of color stain has been observed.

As described above, in the case of using color photographs as recording materials to be preserved for a long period of time, their preservability is not sufficient and thus, further improvement in preservability has been desired.

SUMMARY OF THE INVENTION

Therefore, an object of the present invention is to provide a color photographic light-sensitive material with which fastness of color images formed is extraordinarily improved.

Another object of the present invention is to provide a color photographic light sensitive material with which the occurrence of yellow stain of the white background in uncolor-formed portions due to light, heat and humidity is exceptionally prevented.

A further object of the present invention is to provide a color photographic light-sensitive material with which the occurrence of color stain caused by the components of processing solutions carried into the color photographic material after development processing, particularly due to a color developing agent remaining therein, is extremely prevented.

A still further object of the present invention is to provide a color photographic light-sensitive material which exhibits remarkable improvement in preservability even when the composition of the processing solution is changed due to processing with a processing solution which provides a large amount of its components to the color photographic material, such as a processing solution of a running state, a processing solution of reduced amount of washing water or without employing a water washing step, a color developing solution containing substantially no benzyl alcohol, etc., or other processing solutions which impose a burden on color development.

A still further object of the present invention is to provide a color photographic light-sensitive material with which a three color balance of a yellow dye, magenta dye and cyan dye is maintained and the coloration of the white background is markedly prevented under the preservation for a long period of time.

Other objects of the present invention will become apparent from the following detailed description and examples.

As a result of various investigations, it has been unexpectedly found that the above described objects of the present invention can be accomplished with a silver halide color photographic material comprising a support having thereon at least one silver halide emulsion layer, wherein the silver halide color photographic material contains (1) at least one compound selected from the group consisting of compounds represented by the general formula (I), (II) or (III) and dimers or higher polymers containing at least one moiety derived from the compounds, and (2) at least one compound selected from the group consisting of organic color fading preventing agents represented by the general formula (IV) and dimers or higher polymers containing at least one moiety derived from the agents, organic metal complexes containing copper, cobalt, nickel, palladium or platinum as the central metal and having at least one organic ligand having a bidentate or more conformation and dimers or higher polymers containing at least one moiety derived from the complexes:

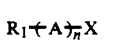

(I)

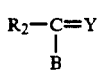

(II)

(III)

wherein $R_1$ and $R_2$ each represents an aliphatic group, an aromatic group or a heterocyclic group; X represents a group capable of being released upon a reaction with an aromatic amine developing agent; A represents a group capable of reacting with an aromatic amine developing agent to form a chemical bond; n represents 0 or 1; B represents a hydrogen atom, an aliphatic group, an aromatic group, a heterocyclic group, an acyl group or an aliphatic or aromatic sulfonyl group; Y represents a group capable of accelerating the addition of an aromatic amine developing agent to the compound represented by the general formula (II); wherein $R_1$ and X, or Y and $R_2$ or B may be connected to each other to form a cyclic structure; R represents an aliphatic group, an aromatic group or a heterocyclic group; and Z represents a nucleophilic group or a group capable of being decomposed in the photographic material to release a nucleophilic group,

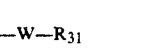

(IV)

wherein $R_{30}$ represents an aliphatic group, an aromatic group or a heterocyclic group; $R_{31}$ represents a hydrogen atom, an aliphatic group, an aromatic group, a heterocyclic group or

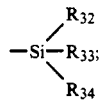

$R_{32}$, $R_{33}$ and $R_{34}$, which may be the same or different, each represents an alkyl group, an alkenyl group, an aryl group, an alkoxy group, an alkenoxy group or an aryloxy group; W represents —O—, —S— or

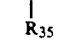

$R_{35}$ represents a hydrogen atom, an aliphatic group, an aromatic group, a heterocyclic group, an acyl group, a sulfonyl group, a sulfinyl group, an oxy-radical group or a hydroxy group; Wherein $R_{30}$ and $R_{31}$, or $R_{35}$ and $R_{30}$ or $R_{31}$ may be connected to each other to form a 5-membered to 7-membered ring.

The above described objects of the present invention can also be accomplished by imagewise exposing a silver halide color photographic material containing at least one dye image forming coupler and subjecting the photographic material exposed to a color photographic processing under the presence of the compounds of (1) and (2).

DETAILED DESCRIPTION OF THE INVENTION

The compounds of (1) and (2) may be incorporated in at least one hydrophilic colloidal layer in the photographic material. It is preferred that the compounds are incorporated in a silver halide emulsion layer, and it is more preferred that the compounds are incorporated in a silver halide emulsion layer containing a magenta coupler.

Of the compounds represented by the general formula (I) or (II), those having a second-order reaction rate constant $K_2$ (80° C.) in a reaction with p-anisidine measured by a method as described in EP 0,258,662A2 in a range from 1.0 l/mol·sec to $1\times10^{-5}$ l/mol·sec are preferred in order to better achieve the effect of the present invention. Further, of the compounds represented by the general formula (III), it is preferred that Z is a nucleophilic functional group or group derived therefrom each having a Pearson's nucleophilic $^nCH_3I$ value of at least 5 (R. G. Pearson et al., *J. Am. Chem. Soc.*, Vol. 90, page 319 (1968). Examples of such a group include an amino group, a mercapto group, and a sulfinic acid group.

In accordance with the present invention where there is used a combination of the compounds the occurrence of color stain caused by the components of processing solutions remaining in the photographic material after development processing can be markedly prevented, and prevention from degradation of color image and occurrence of yellow stain of the white background during preservation for a long period of time can be achieved. In particular, the degree of prevention from degradation of color image and occurrence of yellow stain of the white background is extremely high and such effects can not be expected from combinations of hitherto known color fading preventing agents with each other.

It is more preferred that at least one compound selected from compounds represented by the general formula (I) or (II) and at least one compound represented by the general formula (III) are employed together.

Now, the compounds represented by the general formula (I), (II) or (III) are described in more detail below.

The term "aliphatic group" as used in the present invention represents a straight chain, branched chain or cyclic alkyl, alkenyl or alkynyl and these groups may be substituted with a substituent. The term "aromatic group" as used in the present invention may be a carbocyclic series aromatic group (examples for $R_1$, $R_2$, B or R include a phenyl group, a naphthyl group, etc.) or a heterocyclic series aromatic group (examples for $R_1$, $R_2$, B or R include a furyl group, a thienyl group, a pyrazolyl group, a pyridyl group, an indolyl group, etc.) and the group may be a monocyclic series or condensed ring series (e.g., a benzofuryl group, a phenanthridinyl group, etc.). Furthermore, these aromatic rings may have a substituent.

The term "heterocyclic group" used in the present invention represents a group having a 3-membered to 10-membered ring having carbon atom(s), oxygen atom(s), nitrogen atom(s), or sulfur atom(s) as nucleus-forming atoms, the heterocyclic ring itself may be a saturated ring or an unsaturated ring (examples for $R_1$, $R_2$, B or R include a chromanyl group, a pyrrolidyl group, a pyrrolinyl group, a morpholinyl group, etc.), and further the ring may be substituted with a substituent.

X in the general formula (I) represents a group capable of being released upon a reaction with an aromatic amine developing agent and preferably represents a group connected to A through an oxygen atom, a sulfur atom or a nitrogen atom (e.g., a 3-pyrazolyloxy group, a 3H-1,2,4-oxadiazolin-5-oxy group, an aryloxy group, an alkoxy group, an alkylthio group, an arylthio group, a substituted N-oxy group, etc.) or a halogen atom.

A in the general formula (I) represents a group capable of reacting with an aromatic amine developing agent to form a chemical bond. Such groups includes a group containing an atom of low electron density, for example,

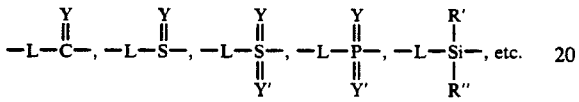

When X is a halogen atom, n represents 0. In the above described formulae, L represents a single bond, an alkylene group,

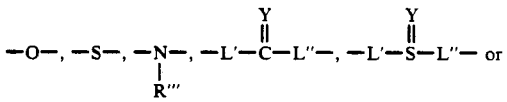

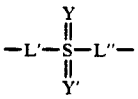

(e.g., a carbonyl group, a sulfonyl group, a sulfinyl group, an oxycarbonyl group, a phosphonyl group, a thiocarbonyl group, an aminocarbonyl group, a silyloxy group, etc.).

Y has the same meaning as Y defined in the general formula (II), and Y' has the same meaning as defined for Y. Y and Y' may be the same or different.

R' and R'', which may be the same or different, each represents —L'''—$R_0$. $R_0$ has the same meaning as defined for $R_1$.

R''' represents a hydrogen atom, an aliphatic group (e.g., a methyl group, an isobutyl group, a tert-butyl group, a vinyl group, a benzyl group, an octadecyl group, a cyclohexyl group, etc.), an aromatic group (e.g., a phenyl group, a pyridyl group, a naphthyl group, etc.), a heterocyclic group (e.g., a piperidinyl group, a pyranyl group, a furyl group, a chromanyl group, etc.), an acyl group (e.g., an acetyl group, a benzoyl group, etc.), or an aliphatic or aromatic sulfonyl group (e.g., a methanesulfonyl group, a benzenesulfonyl group, etc.).

L', L'' and L''', which may be the same or different each represents —O—, —S— or

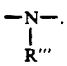

Among these groups, A is preferably a divalent group represented by

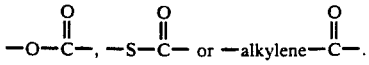

Of the compounds represented by the general formula (I), those represented by the general formula (I-a), (I-b), (I-c) or (I-d) described below, and have a second-order reaction rate constant $K_2$ (80° C.) in a reaction with p-anisidine in the range from $1\times10^{-1}$ l/mol·sec to $1\times10^{-5}$ l/mol·sec. are particularly preferred

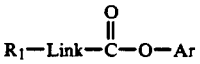

(I-a)

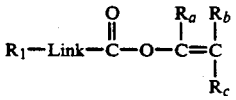

(I-b)

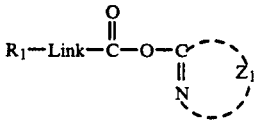

(I-c)

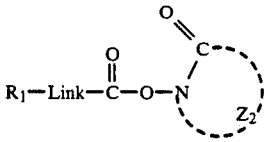

(I-d)

wherein $R_1$ has the same meaning as $R_1$ defined in the general formula (I); Link represents a single bond or —O—; Ar represents an aromatic group provided that it does not become a group useful as a photographic reducing group such as a hydroquinone derivative, a catechol derivative, etc., as a result of reaction with an aromatic amine developing agent; $R_a$, $R_b$ and $R_c$, which may be the same or different, each represents a hydrogen atom, an aliphatic group, an aromatic group, a heterocyclic group, an alkoxy group, an aryloxy group, a heterocyclic oxy group, a carboxy group, an alkylthio group, an arylthio group, a heterocyclic thio group, an amino group, an alkylamino group, an acylamino group, a sulfonamido group, an acyl group, an aliphatic or aromatic sulfonyl group, an alkoxycarbonyl group, a sulfo group, a hydroxy group, an acyloxy group, a ureido group, a urethane group, a carbamoyl group or a sulfamoyl group, wherein $R_a$ and $R_b$ or $R_b$ and $R_c$ may be connected to each other to form a 5-membered to 7-membered heterocyclic ring, which heterocyclic ring may further be substituted with a substituent, form a spiro ring or a bicyclo ring, or condensed with an aromatic ring; and $Z_1$ and $Z_2$ each represents a non-metallic atomic group necessary to form a 5-membered to 7-membered heterocyclic ring, which heterocyclic ring may further be substituted with a substituent, form a spiro ring or a bicyclo ring, or condensed with an aromatic ring.

The groups or rings in the formula (I) to (IV) and (I-a) to (I-b) may be substituted with a substituent such as groups recited for $R_a$, $R_b$ and $R_c$, and/or a halogen atom.

In order to adjust the second-order reaction constant $K_2$ (80° C.) in a reaction with p-anisidine in the range from $1\times10^{-1}$/mol·sec to $1\times10^{-5}$ l/mol·sec in the compound represented by the general formula (I-a), (I-b), (I-c) or (I-d), especially in a case wherein Ar represents a carbocyclic series aromatic group in the general formula (I-a), one or more substituents may be appropriately selected. In this case, it is noted that the sum of the Hammet's $\sigma$ value of the individual substituents is preferably not less than 0.2, more preferably not less than 0.4, and further more preferably not less than 0.6, although it depends on the type of group represented by $R_1$.

In the case of adding the compound represented by the general formula (I) to the photographic light-sensitive material during the production thereof, the total number of carbon atoms included in the compound per se is preferably at least 13, and the more the carbon atoms present, the more preferred. On the other hand, in the case of adding the compound to a processing solution the total number of carbon atoms is usually not more than 13 in order to render the compounds water soluble.

It is preferred that the compound according to the present invention does not decompose during development processing in order to attain the objects of the present invention.

In the general formula (II), Y preferably represents an oxygen atom, a sulfur atom, =N—$R_4$ or

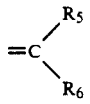

wherein $R_4$, $R_5$ and $R_6$ each represents a hydrogen atom, an aliphatic group (e.g., a methyl group, an isopropyl group, a tert-butyl group, a vinyl group, a benzyl group, an octadecyl group, a cyclohexyl group, etc.), an aromatic group (e.g., a phenyl group, a pyridyl group, a naphthyl group, etc.), a heterocyclic (non-aromatic) group (e.g., a piperidyl group, a pyranyl group, a furyl group, a chromanyl group, etc.), an acyl group (e.g., an acetyl group, a benzoyl group, etc.), or an aliphatic or aromatic sulfonyl group (e.g., a methanesulfonyl group, a benzenesulfonyl group, etc.), wherein $R_5$ and $R_6$ may be connected to each other to form a cyclic structure.

In the general formula (III) Z represents a nucleophilic group or a group capable of being decomposed in the photographic material to release a nucleophilic group. Preferred examples of the nucleophilic group include a nucleophilic group in which the atom which directly chemically connects to the oxidation product of the aromatic amine developing agent is an oxygen atom, a sulfur atom, or a nitrogen atom (e.g., a benzenesulfinyl group, a primary amino group, etc.).

Of the compounds represented by the general formula (III) described above, a compound represented by the following general formula (III-a) is more preferred;

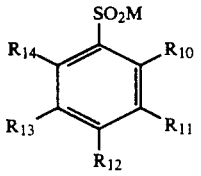

(III-a)

wherein, M represents an atom or an atomic group forming an inorganic salt (e.g., a salt of Li, Na, K, Ca, Mg, ammonium, etc.) or an organic salt (e.g., a salt of triethylamine, methylamine, etc.),

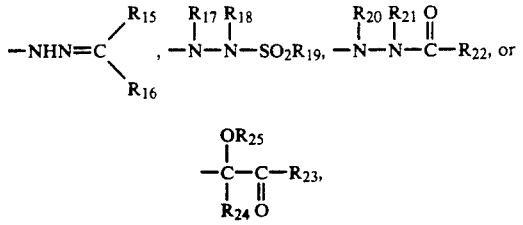

wherein $R_{15}$ and $R_{16}$, which may be the same or different, each represents a hydrogen atom, an aliphatic group, an aromatic group, or a heterocyclic group, Wherein $R_{15}$ and $R_{16}$ may be connected each other to form a 5-membered to 7-membered ring; $R_{17}$, $R_{18}$, $R_{20}$, and $R_{21}$, which may be the same or different, to each represents a hydrogen atom, an aliphatic group, an aromatic group, a heterocyclic group, an acyl group, an alkoxycarbonyl group, an aliphatic or aromatic sulfonyl group, a ureido group, or a urethane group, provided that at least one of $R_{17}$ and $R_{18}$ and at least one of $R_{20}$ and $R_{21}$ each represents a hydrogen atom; $R_{19}$ and $R_{22}$ each represents a hydrogen atom, an aliphatic group, an aromatic group, or a heterocyclic group; $R_{19}$ may further represent an alkylamino group, an arylamino group, an alkoxy group, an aryloxy group, an acyl group, an alkoxycarbonyl group, or an aryloxycarbonyl group; wherein at least two of R:7, $R_{18}$ and $R_{19}$ may be connected to each other to form a 5-membered to 7-membered ring, and at east two of $R_{20}$, $R_{21}$ and $R_{22}$ may be connected to each other to form a 5-membered to 7-membered ring; $R_{23}$ represents a hydrogen atom, an aliphatic group, an aromatic group or a heterocyclic group; $R_{24}$ represents a hydrogen atom, an aliphatic group, an aromatic group, a halogen atom, an acyloxy group or an aliphatic or aromatic sulfonyl group; $R_{25}$ represents a hydrogen atom or an alkali-hydrolizable group; and $R_{10}$, $R_{11}$, $R_{12}$, $R_{13}$, and $R_{14}$, which may be the same or different, each represents a hydrogen atom, an aliphatic group (e.g., a methyl group, an isopropyl group, a tert-butyl group, a vinyl group, a benzyl group, an octadecyl group, a cyclohexyl group, etc.), an aromatic group (e.g., a phenyl group, a pyridyl group, a naphthyl, group, etc.), a heterocyclic group (e.g., a piperidyl group, a pyranyl group, a furyl group, a chromanyl group, etc.), a halogen atom (e.g., a chlorine atom, a bromine atom, etc.), —$SR_{26}$, —$OR_{26}$,

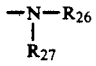

(wherein, $R_{26}$ and $R_{27}$, which may be the same or different in the case of —$NR_{26}R_{27}$, each represents a hydrogen atom, an aliphatic group, an alkoxy group, or an aromatic group), an acyl group (e.g., an acetyl group, a benzoyl group, etc.), an alkoxycarbonyl group (e.g., a methoxycarbonyl group, a butoxycarbonyl group, a cyclohexyloxycarbonyl group, an octyloxycarbonyl group, etc.), an aryloxycarbonyl group (e.g., a phenyloxycarbonyl group, a naphthyloxycarbonyl group, etc.), an aliphatic or aromatic sulfonyl group (e.g., a methanesulfonyl group, a benzenesulfonyl group, etc.), an aliphatic or aromatic sulfonamido group (e.g., a methanesulfonamido group, a benzenesulfonamido group, etc.), a sulfamoyl group, a ureido group, a urethane group, a carbamoyl group, a sulfo group, a carboxy group, a nitro group, a cyano group, an alkoxyoxalyl group (e.g., a methoxyoxalyl group, an isobutoxyoxalyl group, an octyloxyoxalyl group, a benzyloxyoxalyl group, etc.), an aryloxyoxalyl group (e.g., a phenoxyoxalyl group, a naphthoxyoxalyl group, etc.), an aliphatic or aromatic sulfonyloxy group (e.g., a methanesulfonyloxy group, a benzenesulfonyloxy group, etc.), $-P(R_{26})_3$, $$-\overset{O}{\overset{\|}{P}}(R_{26})_2,\ -\overset{S}{\overset{\|}{P}}(R_{26})_2,$$

$-P(OR_{26})_3$, (wherein $R_{26}$ has the same meaning as defined above), or a formyl group.

In these groups, the group in which the sum of Hammet's $\sigma$ values with respect to the $-SO_2M$ group is at least 0.5 is preferred to better achieve the effect of the present invention.

In the case of adding the compound represented by the general formula (II) or (III) to the photographic material during the production thereof, the total number of carbon atoms of the compound is that which provides the compound non-diffusible. On the other hand, in the case of adding the compound (having no water-solubilizing group) to a processing solution the total number of carbon atoms is that which renders the compound water soluble.

Among the compounds represented by the general formulae (I), (II) and (III), those represented by the general formula (I) or (III) are preferred, although preferred compounds in the individual general formula are those as described above.

Representative examples of the compounds represented by the general formula (I), (II) or (III) used in the present invention are illustrated below, but the present invention should not be construed as being limited thereto. (In the present invention, the alkyl group in a formula, which does not have (t) or (i) means n-alkyl group.)

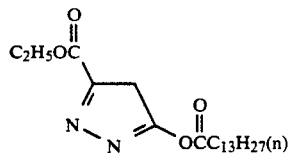
(I-1)

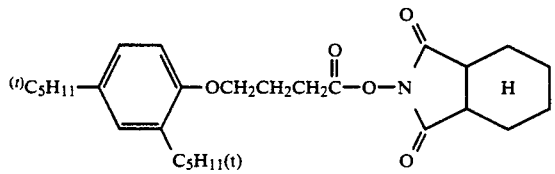
(I-2)

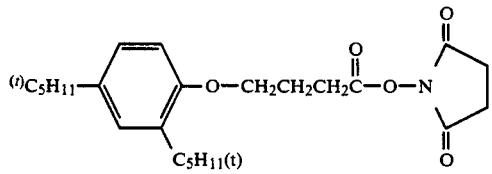
(I-3)

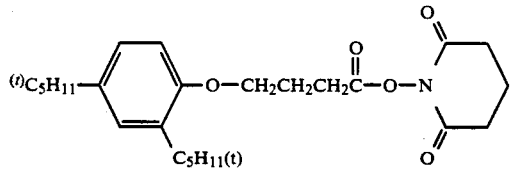
(I-4)

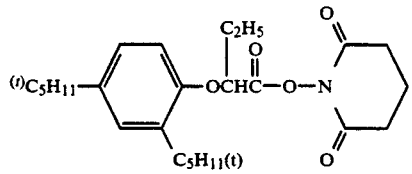
(I-5)

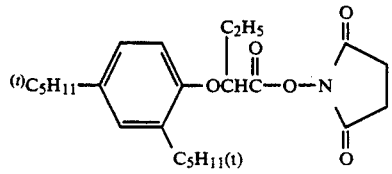
(I-6)

-continued
(I-7)
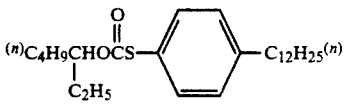
(I-8)
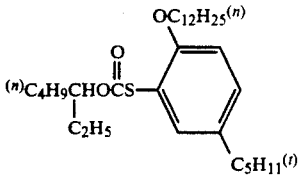
(I-9)
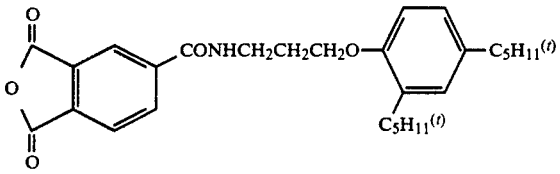
(I-10)
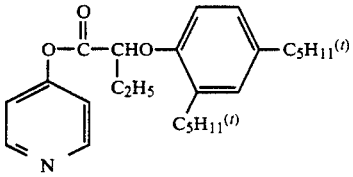
(I-11)
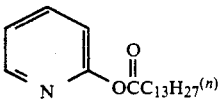
$^{(n)}C_{18}H_{37}I$ (I-12)
$^{(n)}C_{18}H_{37}Br$ (I-13)
(I-14)
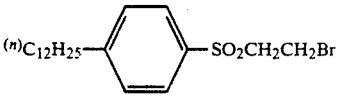
(I-15)
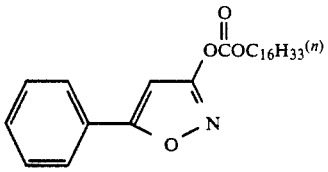
(I-16)
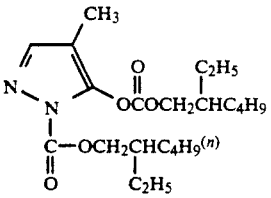
(I-17)
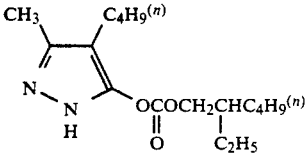

-continued
(I-18)
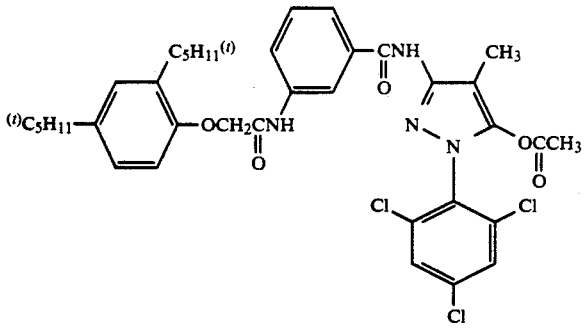
(I-19)
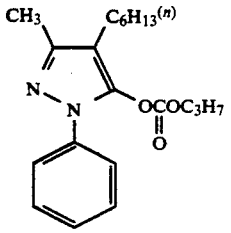
(I-20)
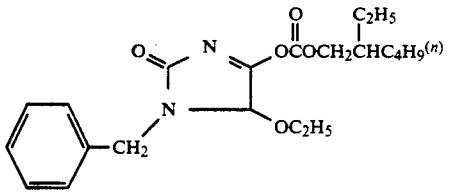
(I-21)
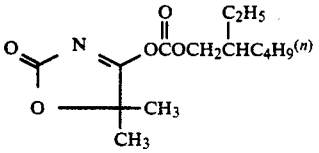
(I-22)
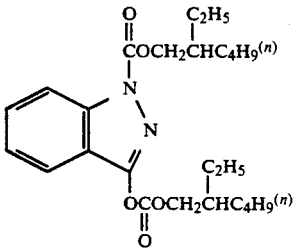
(I-23)
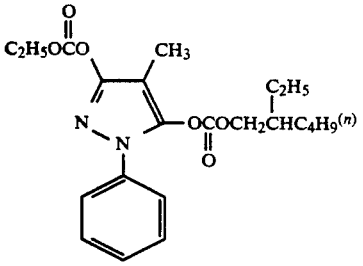
(I-24)
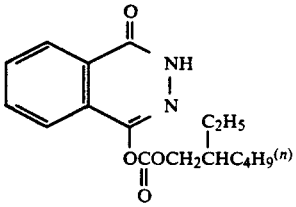

-continued
(I-25)
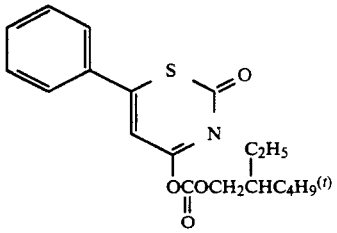
(I-26)
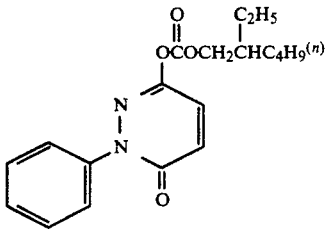
(I-27)
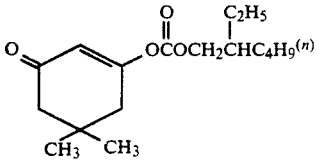
(I-28)
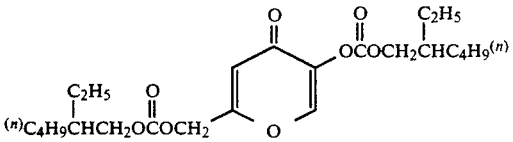
(I-29)
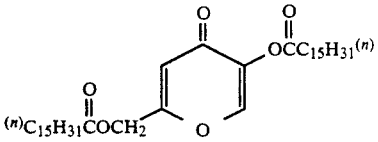
(I-30)
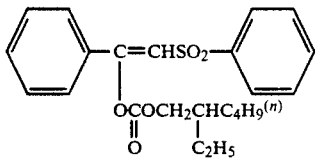
(I-31)
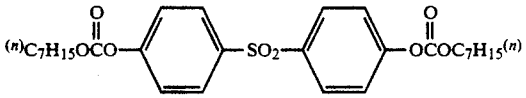
(I-32)
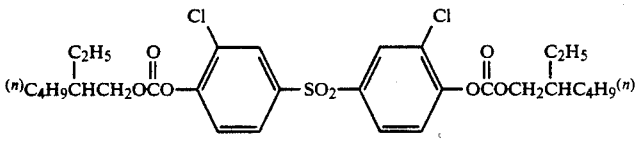
(I-33)
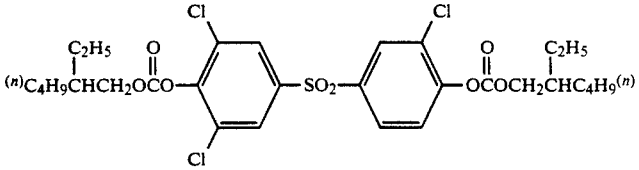

-continued
(I-34)
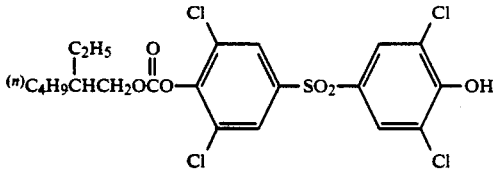
(I-35)
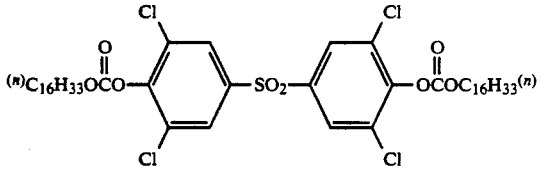
(I-36)
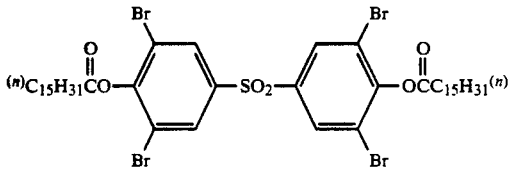
(I-37)
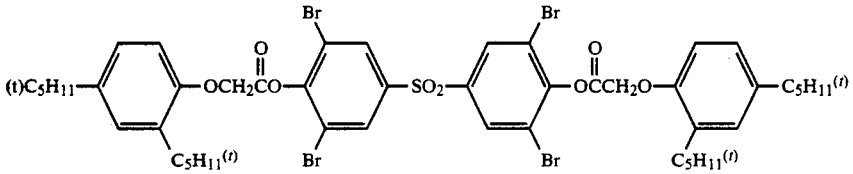
(I-38)
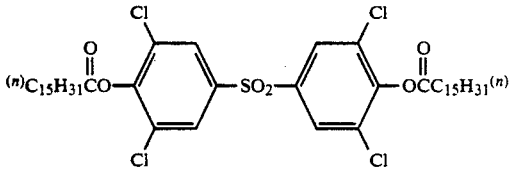
(I-39)
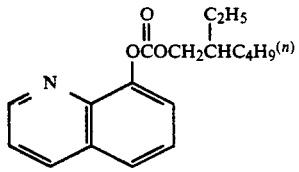
(I-40)
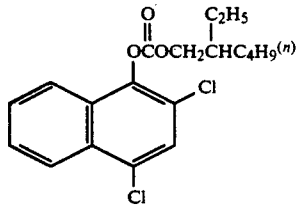
(I-41)
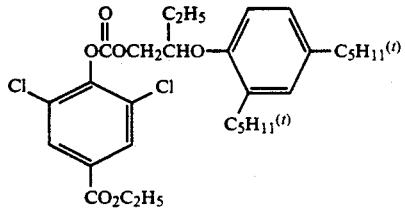

-continued
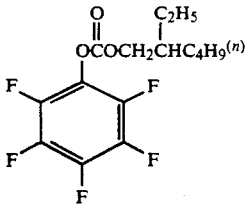
(I-42)
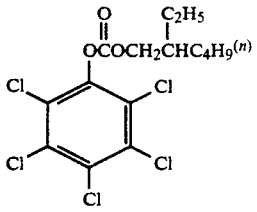
(I-43)
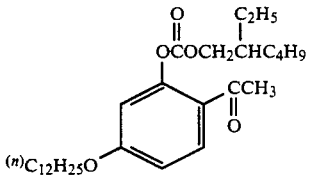
(I-44)
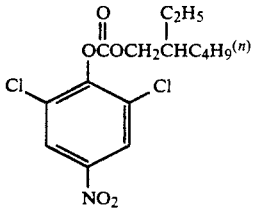
(I-45)
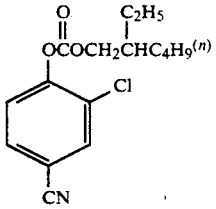
(I-46)
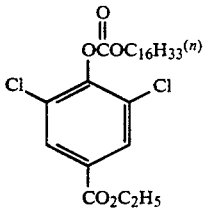
(I-47)
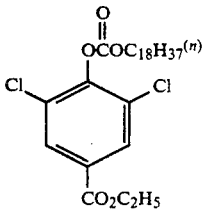
(I-48)

-continued
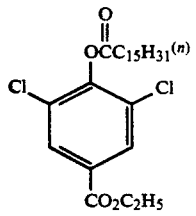
(I-49)
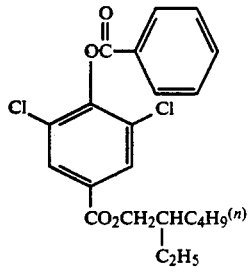
(I-50)
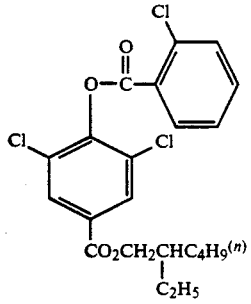
(I-51)
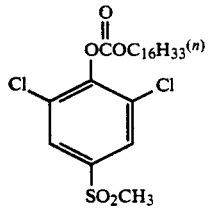
(I-52)
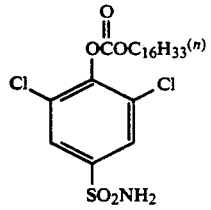
(I-53)
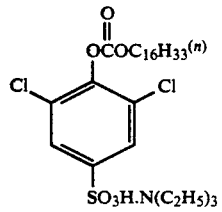
(I-54)

-continued
(I-55)
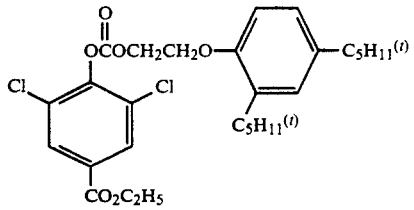
(I-56)
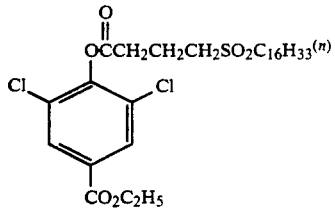
(I-57)
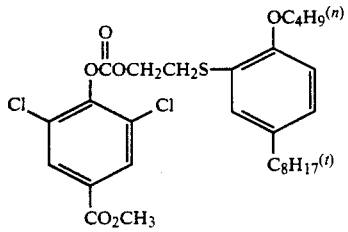
(I-58)
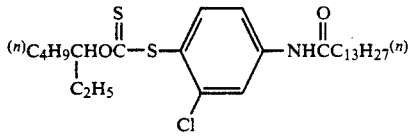
(I-59)
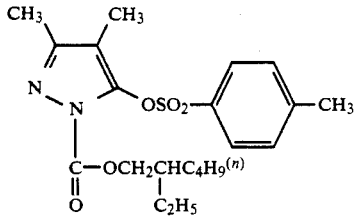
(I-60)
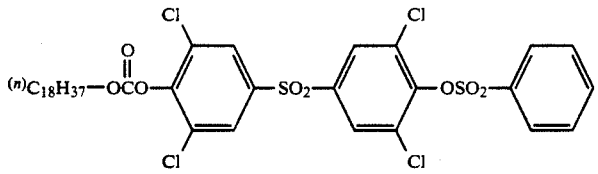
(I-61)
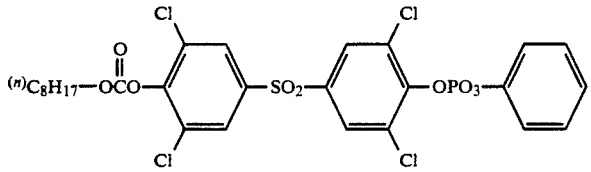
(I-62)
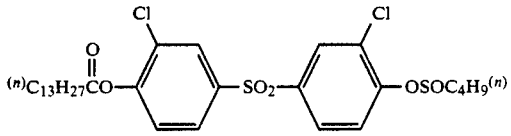

-continued
(I-63)
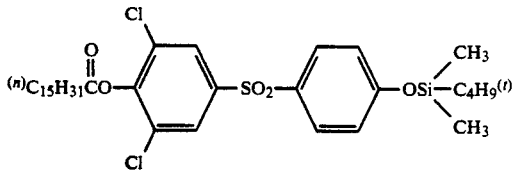
(I-64)
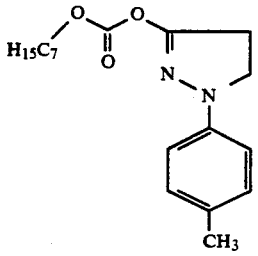
(I-65)
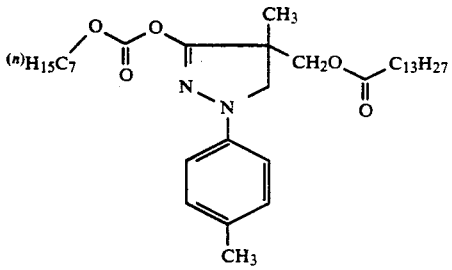
(I-67)
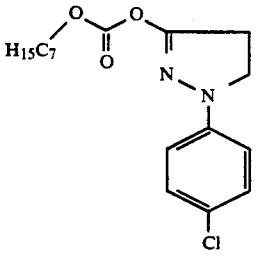
(I-68)
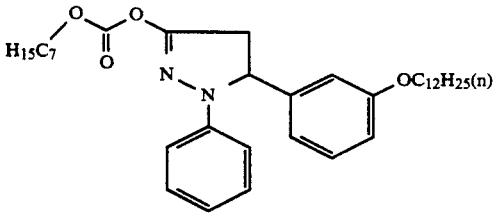
(I-69)
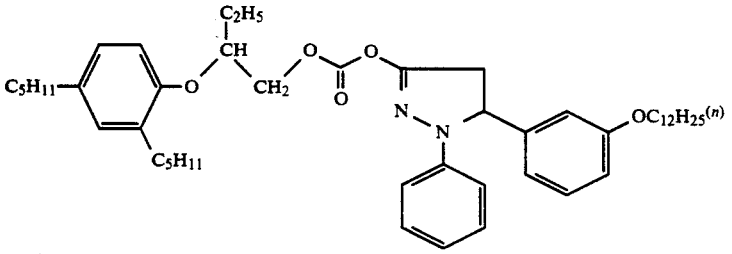

-continued
(I-70)
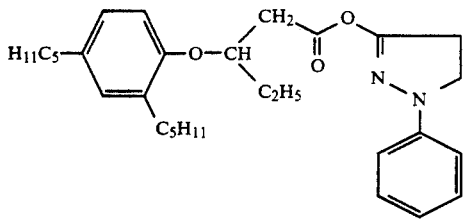
(I-71)
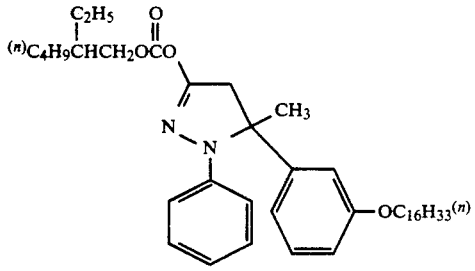
(I-72)
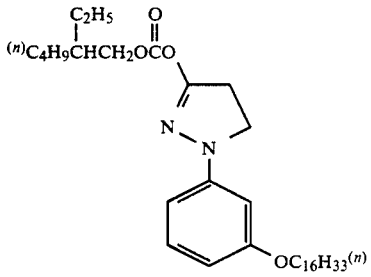
(I-73)
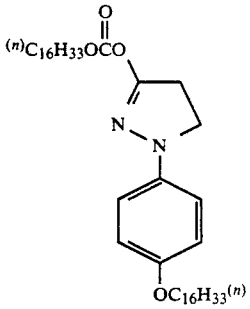
(I-74)
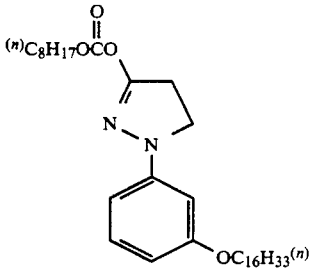
(I-75)
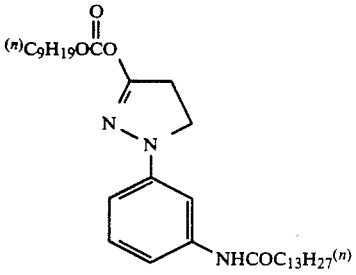

-continued
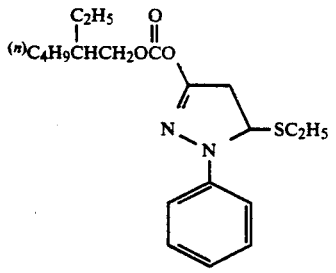
(I-76)
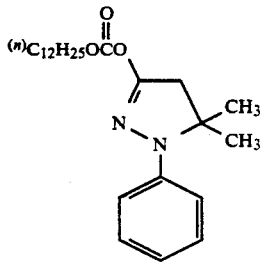
(I-77)
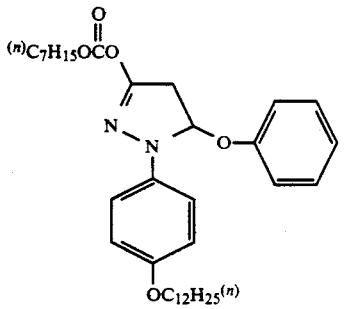
(I-78)
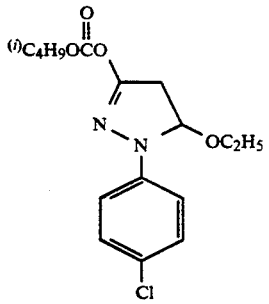
(I-79)
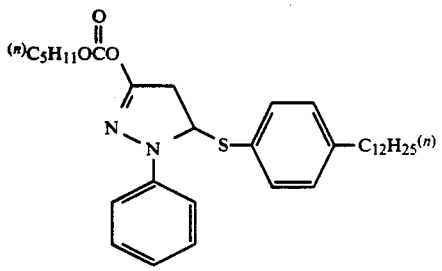
(I-80)

-continued
(I-81)
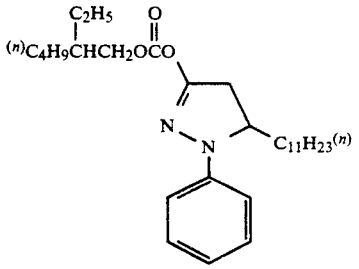
(I-82)
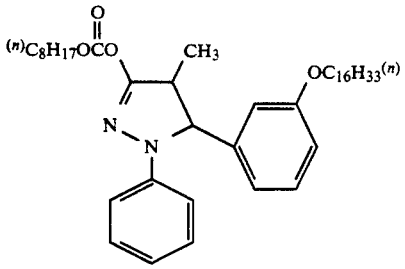
(I-83)
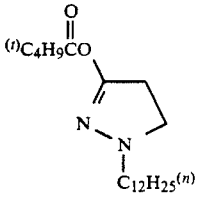
(I-84)
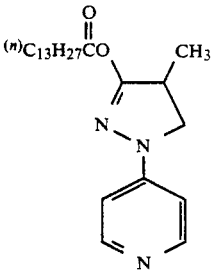
(I-85)
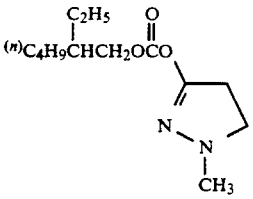
(I-86)
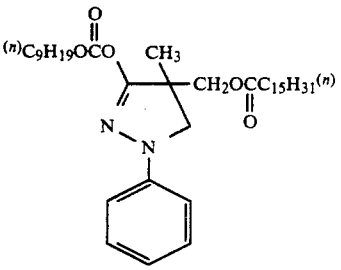

-continued
(I-87)
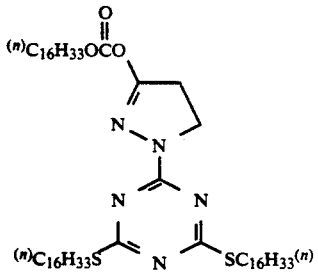
(I-88)
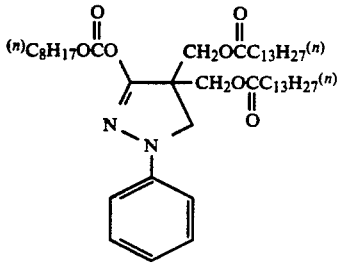
(I-89)
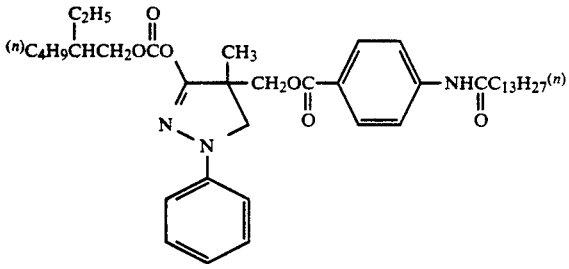
(I-90)
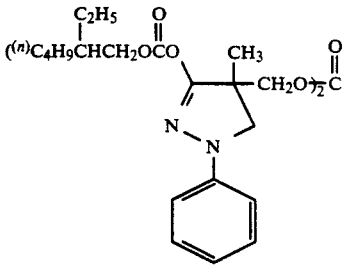
(II-1)
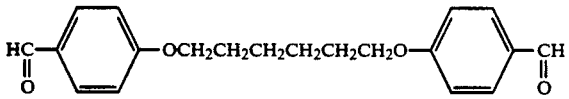
(II-2)
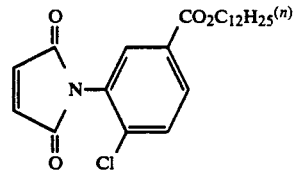
$CH_2{=}CH{-}SO_2{-}C_{18}H_{37}{}^{(n)}$ (II-3)
(II-4)
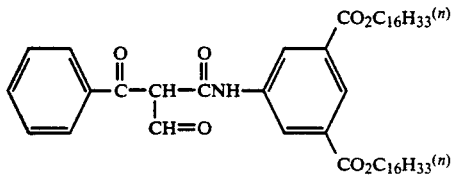

-continued
(II-5)
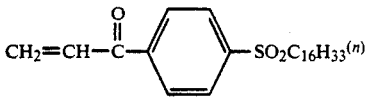
(III-1)
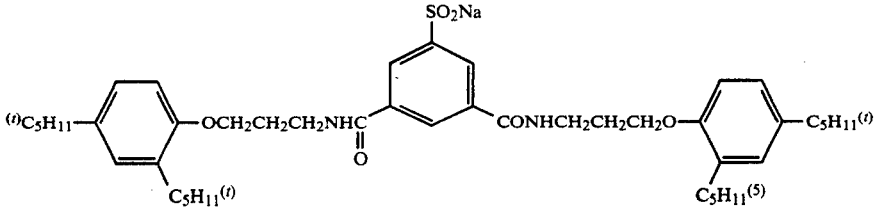
(III-2)
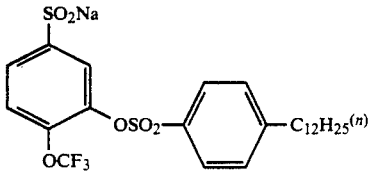
(III-3)
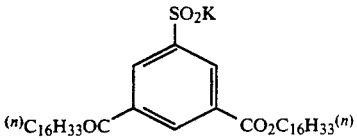
(III-4)
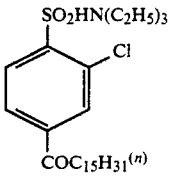
(III-5)
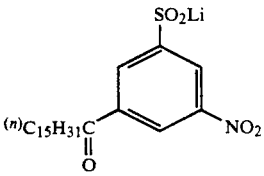
(III-6)
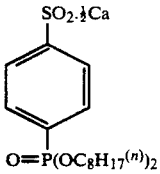
(III-7)
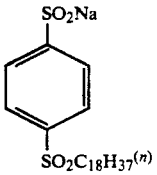
(III-8)
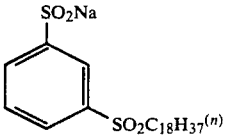

-continued
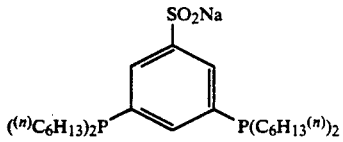
(III-9)
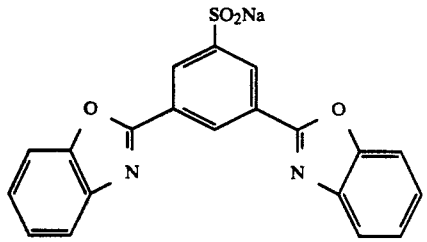
(III-10)
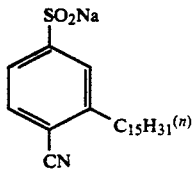
(III-11)
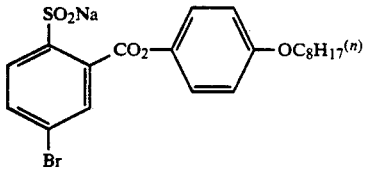
(III-12)
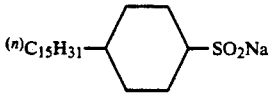
(III-13)
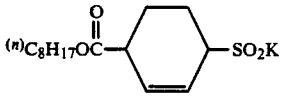
(III-14)
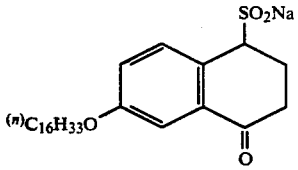
(III-15)
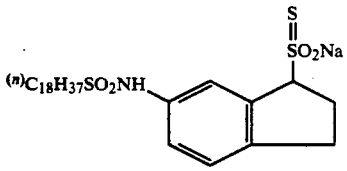
(III-16)
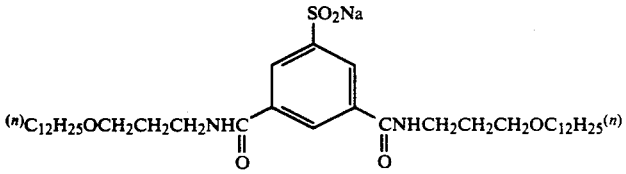
(III-17)

-continued
(III-18)
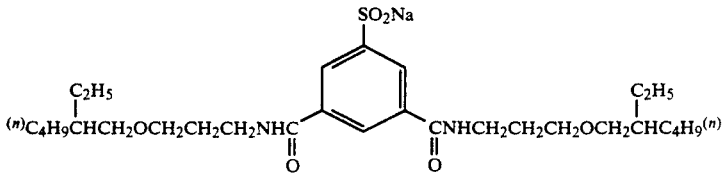
(III-19)
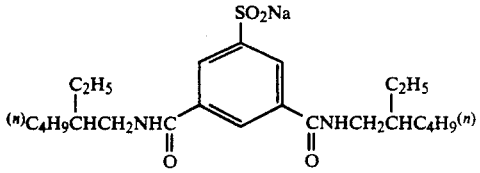
(III-20)
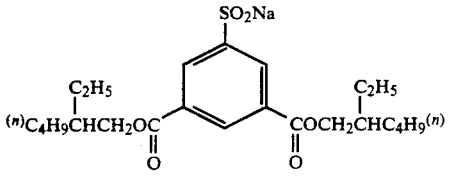
(III-22)
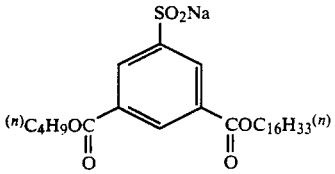
(III-23)
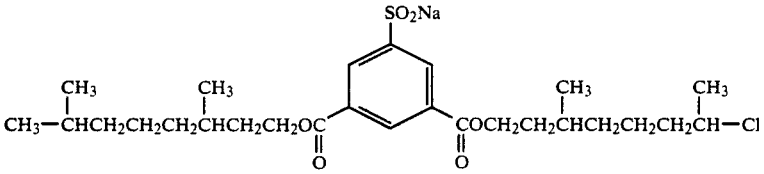
(III-24)
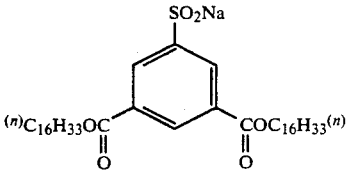
(III-25)
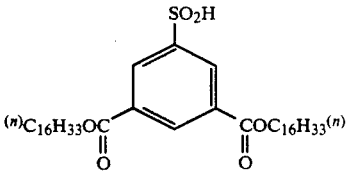
(III-26)
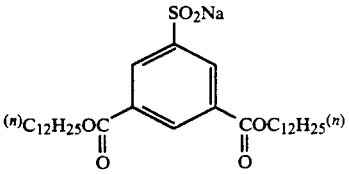
(III-27)
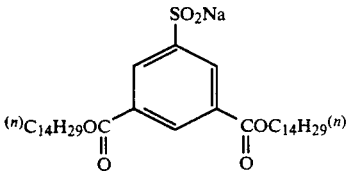

-continued
(III-28)
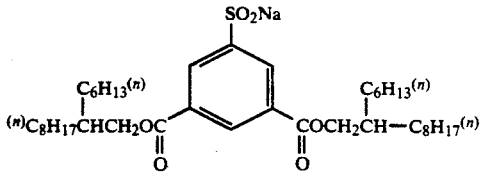
(III-29)
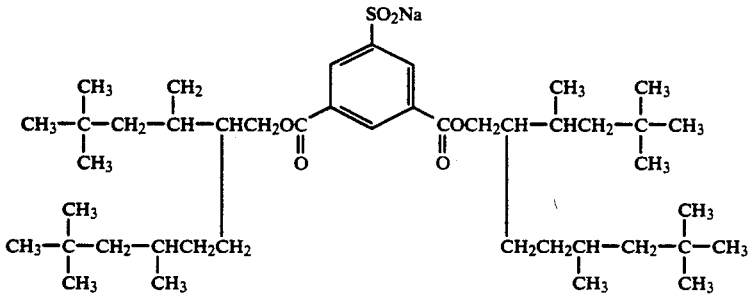
(III-30)
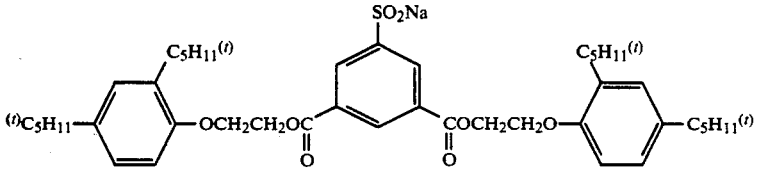
(III-31)
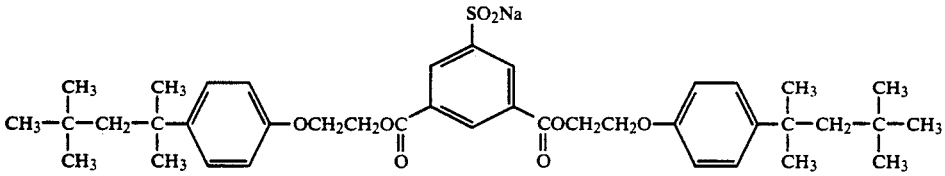
(III-32)
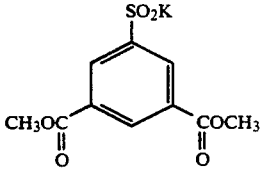
(III-33)
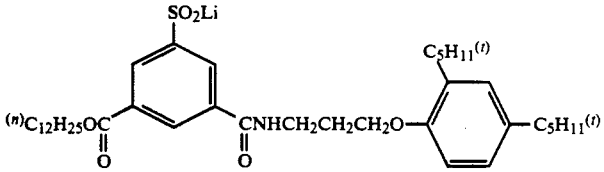
(III-34)
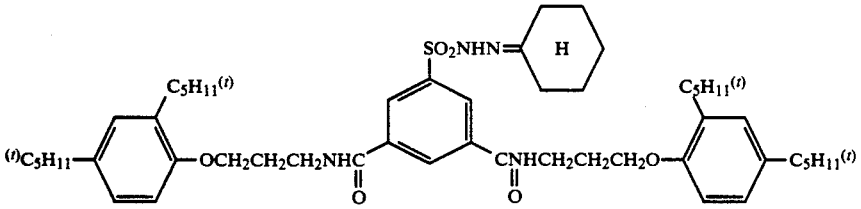
(III-35)
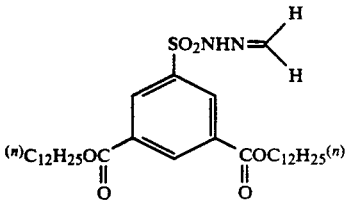

-continued
(III-36)
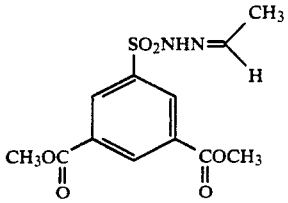
(III-37)
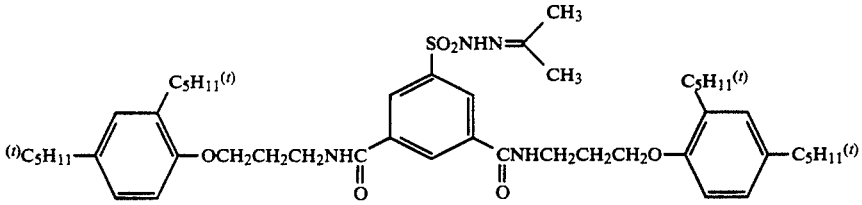
(III-38)
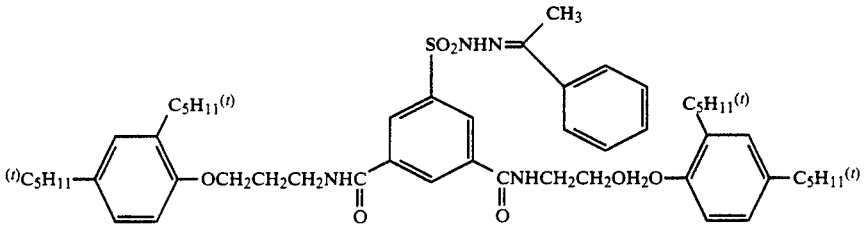
(III-39)
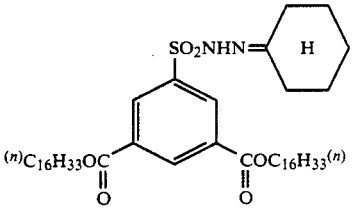
(III-40)
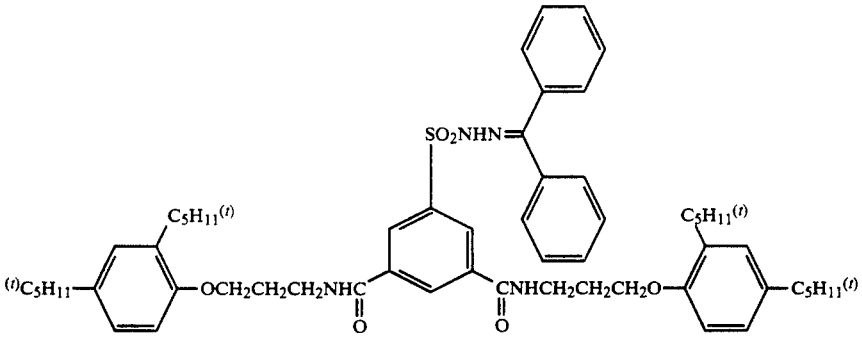
(III-41)
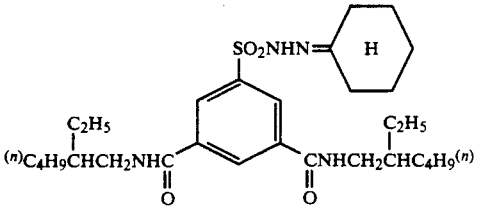

-continued
(III-42)
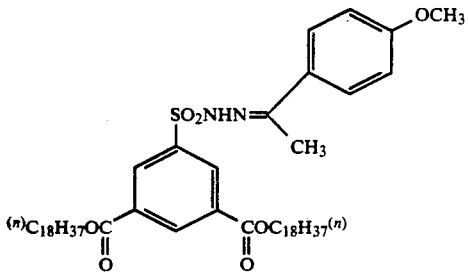
(III-43)
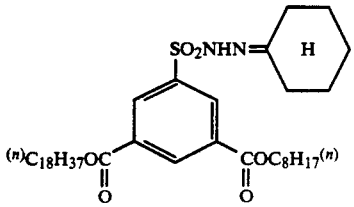
(III-44)
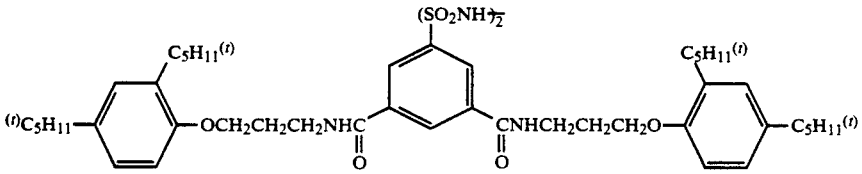
(III-45)
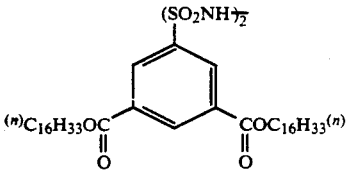
(III-46)
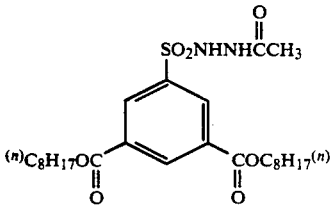
(III-47)
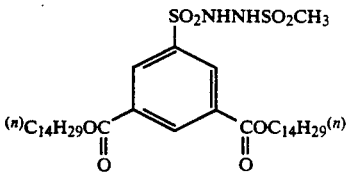
(III-48)
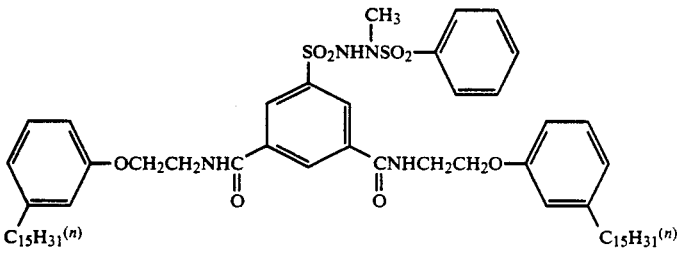

-continued
(III-49)
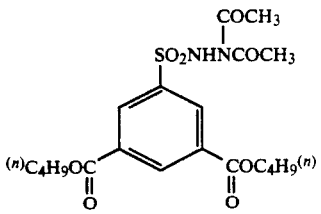
(III-50)
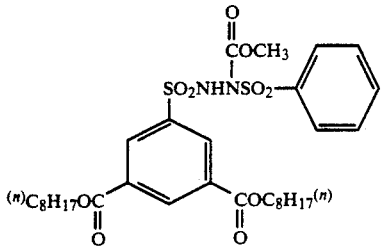
(III-51)
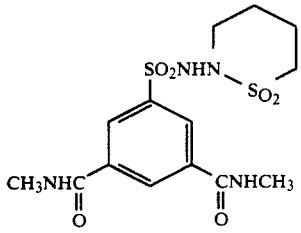
(III-52)
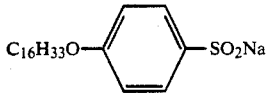
(III-53)
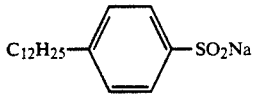
(III-54)
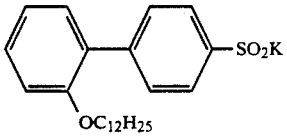
(III-55)
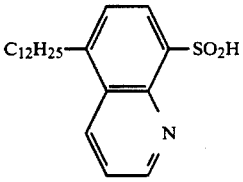
(III-56)
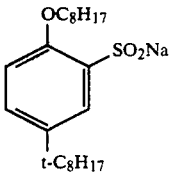

-continued
(III-57)
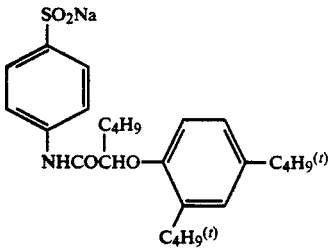
(III-58)
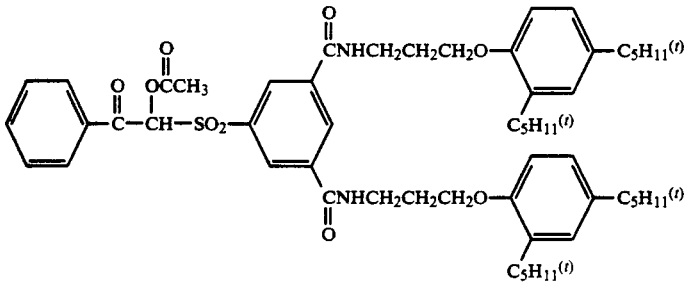
(III-59)
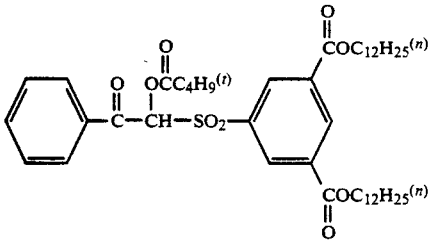
(III-60)
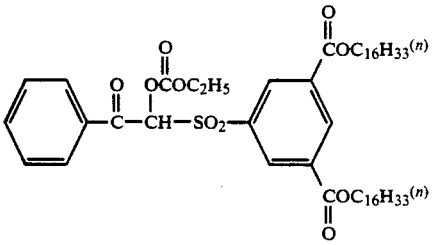
(III-61)
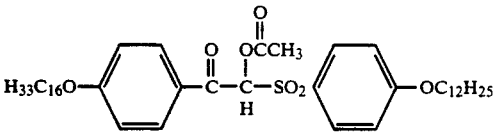
(III-62)
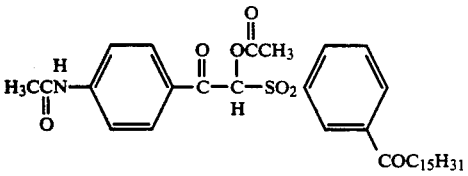
(III-63)
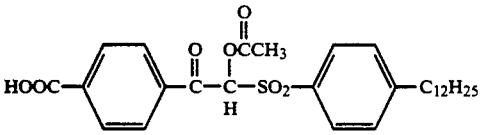
(III-64)
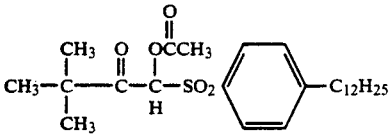

-continued

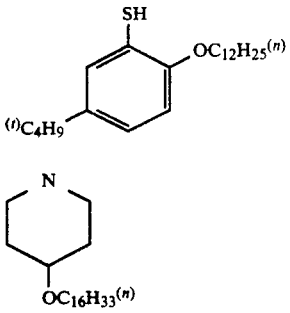

(III-65)

(III-66)

The compounds represented by the general formula (I), (II) or (III) can be synthesized according to the methods as described in EP 0,230,048A2, 0,258,662A2, and 0,255,722A2 and Japanese Patent Application (OPI) No. 229145/87 or methods analogous thereto.

Examples of synthesis of typical compounds of the present invention are set forth below.

SYNTHESIS EXAMPLE 1

(Synthesis of Compound I-7)

Synthesis of 2-ethylhexyl-4-dodecylbenzenethiocarbonate (above-mentioned Compound I-7)

150 ml of chloroform and 9.9 mol (0.071 mol) of triethylamine were added and dissolved in 18 g (0.065 mol) of 4-dodecylbenzenethiol and stirred at 25° C. To this was dropwise added 13.3 g (0.068 mol) of 2-ethylhexyl chlorocarbonate. After stirring for 30 minutes, a cold aqueous hydrochloric acid solution was added to the reaction mixture for liquid separation, and the chloroform layer separated was washed three times and with cold water and dried with Glauber's salt. After the Glauber's salt was filtered out, the chloroform was distilled out and the remaining precipitate was purified by column chromatography. The product was oily. Yield: 17.2 g, 61.2%.

| Result of elementary analysis ($C_{27}H_{46}O_2S_2$) | C | H | S |
|---|---|---|---|
| Measured data (%) | 74.34 | 10.66 | 14.91 |
| Calculated data (%) | 74.60 | 10.67 | 14.75 |

SYNTHESIS EXAMPLE 2

(Synthesis of Compound I-36)

Acetonitrile (300 ml) was added to 11.3 g of 3,3',5,5'-tetrabromobiphenylsulfone and 6.1 ml of triethylamine with stirring. To the mixture, 12.3 g of palmitic acid chloride was added dropwise at room temperature. After continued stirring for 5 hours, the reaction mixture was poured into 500 ml of water. The resulting crystal was recovered by filtration, washed with water and dried. Recrystallization with a mixed solvent of chloroform and ethyl acetate produced a crystal of Compound I-36. Yield: 17.5 g, 84.0%. Melting point: 125°-126° C.

| Result of elementary analysis ($C_{44}H_{66}Br_4O_6S$) | C | H | Br | S |
|---|---|---|---|---|
| Measured data (%) | 50.60 | 6.21 | 30.39 | 3.11 |
| Calculated data (%) | 50.68 | 6.38 | 30.66 | 3.07 |

SYNTHESIS EXAMPLE 3

(Synthesis of Compound I-38)

Acetonitrile (300 ml) was added to 14.0 g of 3,3',5,5'-chloro-4,4'-dihydroxybiphenylsulfone and 11.2 ml of triethylamine with stirring. To the mixture, 22.0 g of palmitic acid chloride was added dropwise at room temperature. After completion of the addition, the internal temperature of the reaction system was elevated to 65° to 70° C. and the mixture was stirred for 1 hour. After completion of the reaction, the reaction mixture was poured into 1,000 ml of water, and the resulting crystal was recovered by filtration, washed with water and dried. Recrystallization with a mixed solvent of chloroform and ethyl acetate produced a crystal of Compound I-38. Yield: 19.7 g, 63.3%. Melting point 125°-126° C.

| Result of elementary analysis ($C_{44}H_{66}Cl_4O_6S$) | C | H | Cl | S |
|---|---|---|---|---|
| Measured data (%) | 61.01 | 7.55 | 17.00 | 3.61 |
| Calculated data (%) | 61.10 | 7.69 | 16.40 | 3.71 |

SYNTHESIS EXAMPLE 4

(Synthesis of Compound I-41)

10.3 ml (0.0739 mol) of triethylamine was added to a solution of 15.8 g (0.0672 mol) of ethyl 3,5-chloro-4-hydroxybenzoate in 158 ml of acetonitrile. Under stirring at 0° C., 27.3 g (0.0739 mol) of chlorocarbonyl-2-ethyl-2-(2,4-di(1,1-dimethylpropyl)phenoxy)ethyl was added dropwise at room temperature and the mixture was stirred for one hour and a half. To the reaction mixture, 800 ml of ethyl acetate was added and the ethyl acetate layer was washed with a saturated aqueous solution of sodium chloride and dried with Glauber's salt. After the Glauber's salt was filtered off, the filtrate was concentrated under vacuum to obtain 42.1 g of Compound I-41 in a crude form. The crude product was purified by column chromatography on silica gel (800 g) using a hexane/ethyl acetate mixture as an eluting solvent under varying concentrations of 100/1 to 20/1. Compound I-41 was obtained as a colorless oil. Yield: 35.8 g, 94%.

| Result of elementary analysis ($C_{30}H_{40}Cl_2O_6$) | | | |
|---|---|---|---|
| | C | H | Cl |
| Measured data (%) | 63.68 | 7.06 | 12.23 |
| Calculated data (%) | 63.49 | 7.10 | 12.49 |

SYNTHESIS EXAMPLE 5

(Synthesis of Compound III-1)

i) Synthesis of 3,5-di-(2,4-di-tert-acylphenoxypropylcarbamoyl)benzenesulfonyl chloride To 10 g (0.034 mol) of 5-sulfoisophthalic acid dimethyl ester sodium salt were added 100 ml of toluene, 16 ml (0.080 mol) of a methanol solution containing 28% sodium methylate, and 24.7 g (0.085 mol) of 2,4-di-tert-amylphenoxypropylamine and the mixture was heated to 100° C. The mixture was heated for 3 hours while distilling off methanol therefrom and, after cooling the reaction mixture, cold water was added thereto. The toluene layer formed was recovered, washed twice with cold water, and then dried using Glauber's salt. Then the Glauber's salt was filtrated away, the filtrate was concentrated to dryness, dissolved in 100 ml of N,N-dimethylacetamide and 50 ml of acetonitrile and the solution was stirred at room temperature. To the solution was added 30 ml (0.326 mol) of phosphorus oxychloride and the mixture was heated to 50° C. to 60° C. for one hour. The reaction mixture was added to ice water, extracted with 300 ml of ethyl acetate, and the ethyl acetate layer formed was recovered, washed thrice with ice water, and dried over Glauber's salt. After filtrating away the Glauber's salt, ethyl acetate was distilled off from the filtrate, and the residue was purified by column chromatography to provide 11.5 g (yield of 41.9%) of the desired product.

ii) Synthesis of sodium 3,5-di-(2,4-di-tert-amylphenoxypropylcarbamoyl)benzenesulfinate (Compound III-1)

To 2 g (0.016 mol) of sodium sulfite and 2.4 g (0.029 mol) of sodium hydrogen carbonate were added 100 ml of water and 20 ml of acetonitrile and the mixture was stirred at 30° C. To the mixture was added dropwise a solution of 10.5 g (0.013 mol) of 3,5-di-(2,4-di-tert-amylphenoxypropylcarbamoyl)benzenesulfonyl chloride obtained in the aforesaid step dissolved in 100 ml of acetonitrile. After stirring the resultant mixture for one hour, the reaction mixture was poured onto ice water and extracted with 150 ml of ethyl acetate. The ethyl acetate layer was washed thrice with cold water and dried over Glauber's salt. After filtrating away the Glauber's salt, the residue was concentrated to dryness to provide 8.6 g (yield of 82.8%) of a solid product.

| Elemental Analysis for $C_{46}H_{67}N_2O_6SNa$: | | | | |
|---|---|---|---|---|
| | C | H | N | S |
| Found: | 68.75% | 8.39% | 3.32% | 3.92% |
| Calculated: | 69.14% | 8.45% | 3.51% | 4.01% |

SYNTHESIS EXAMPLE 6

(Synthesis of Compound III-25)

i) Synthesis of sodium 3,5-dihexadecyloxycarbonylbenzenesulfonate 210 ml of toluene, 4.57 ml (0.0705 mol) of methanesulfonic acid, and 68.3 g (0.282 mol) of hexadecanol were added to 20.8 g (0.0705 mol) of sodium 3,5-dimethyloxycarbonylbenzenesulfonate, and the mixture was heated for 19 hours while heating, refluxing, and distilling away the vaporizable component. After 500 ml of ethyl acetate was added thereto, the mixture was poured into 500 ml of water, and the precipitate was filtered off. The precipitate was then washed with acetonitrile and isopropanol to obtain a white solid containing sodium 3,5-dihexadecyloxycarbonylbenzenesulfonate. (Yield: 55 g, m.p.: 85°-95° C.).

ii) Synthesis of 3,5-dihexadecyloxycarbonylbenzenesulfonyl chloride 220 ml of ethyl acetate and 22 ml of DMAC were added to 36.6 g of the white solid containing sodium 3,5-dihexadecyloxycarbonylbenzenesulfonate. 28.1 ml (0.306 mol) of phosphorus oxychloride was added dropwise thereto over 14 minutes while heated to 40° C. and stirring, and the mixture was further stirred for 3 hours and 30 minutes at 40° C. and for 2 hours at 55° C. The reaction mixture was poured into 300 ml of ice water with stirring, and was twice extracted with 1 l of chloroform, followed by drying with Glauber's salt. After filtering off Glauber's salt, the solution was concentrated under reduced pressure. The residue thus obtained was recrystallized from chloroform/acetonitrile to obtain a white solid containing 3,5-dihexadecyloxycarbonylbenzenesulfonyl chloride. (Yield: 31.0 g, m.p.: 48°-50° C.).

iii) Synthesis of 3,5-dihexadecyloxycarbonylbenzenesulfinic acid (Compound III-25)

87 ml of water and 18.2 ml (0.218 mol) of 12N-HCl were added to the solution of 87 ml of chloroform and 8.65 g (0.0121 mol) of the white solid containing 3,5-dihexadecyloxycarbonylbenzenesulfonyl chloride, and then 7.93 g of zinc was added thereto at 5° C. followed by stirring for 4 hours and 30 minutes. After the insoluble component was removed therefrom, the solution was extracted with 100 ml of chloroform, washed with saturated brine, and dried with Glauber's salt. After removing Glauber's salt, the solution was concentrated under reduced pressure, and the residue was recrystallized from hot hexane to obtain a colorless crystal of 3,5-dihexadecyloxycarbonylbenzenesulfonic acid. (Yield: 4.43 g, 48% (based on sodium 3,5-dimethyloxycarbonylbenzenesulfonate), m.p.: 63°-65° C.).

SYNTHESIS EXAMPLE 7

(Synthesis of Compound III-24)

The same procedures of Synthesis Example 6 were repeated, and 500 ml of a saturated aqueous solution of sodium carbonate was added to the thus obtained 300 ml of a chloroform solution of Compound (III-24). The precipitate was collected and washed with water to obtain a colorless crystal of sodium 3,5-dihexadecyloxycarbonylbenzenesulfinate. (Yield: 32% (based on sodium 3,5-dihexadecyloxycarbonylbenzensulfonate), m.p.: 229°-231° C.).

SYNTHESIS EXAMPLE 8

(Synthesis of Compound III-39)

i) Synthesis of 3,5-dihexadecyloxycarbonylbenzenesulfonyl hydrazide

A solution of 26 ml of chloroform and 5.20 g of a white solid containing 3,5-dihexadecyloxycarbonylbenzensulfonyl chloride was added dropwise to 2.28 g (0.0364 mol) of 80% hydrazine hydrate, followed by stirring for 2 hours. Then, 200 ml of ethyl acetate was added thereto, and the mixture was washed with saturated brine and dried with Glauber's salt. After removing Glauber's salt, the solution was concentrated under reduced pressure, and the residue was recrystallized from hot ethyl acetate to obtain a white solid containing 3,5-dihexadecyloxycarbonylbenzenesulfonyl hydrazide. (Yield: 3.66 g, m.p.: 83°-88° C.).

ii) Synthesis of cyclohexane 2-(3,5-bis(hexadecyloxycarbonyl)benzenesulfonyl)hydrazone 100 ml of methanol and 0.81 mol (0.00780 mol) of cyclohexanone were added to 5.03 g (0.00709 mol) of 3,5-dihexadecyloxycarbonylbenzenesulfonyl hydrazide, and the mixture was stirred for 1 hour and 30 minutes while heating and refluxing, followed by cooled to room temperature. The precipitate was collected and recrystallized from a mixed solvent (hexane/ethyl acetate: 50/1) to obtain a white solid containing Compound (III-39). (Yield: 3.22 g, m.p.: 87°-88° C.).

SYNTHESIS EXAMPLE 9

(Synthesis of Compound III-45)

5 ml of dimethylacetamide and 15 ml of ethyl acetate were added to 1.0 g of 3,5-dihexadecyloxycarbonylbenzenesulfonyl hydrazide, and 1.01 g of crystals of 3,5-dihexadecyloxycarbonylbenzenesulfonyl chloride was further added thereto while stirring. After stirring for 30 minutes at room temperature, 0.2 ml of pyridine was added dropwise thereto, and stirred further for 5 hours. After the completion of reaction, the reaction mixture was poured into 100 ml of water, and crystals thus-precipitated was collected and dried. The crystals were purified with a silica gel column chromatography to obtain crystals of Compound (III-45). (Yield: 0.4 g (20.5%), m.p.: 148°-150° C.).

Now, the compounds represented by the general formula (IV) are described in more detail below.

The aliphatic group, aromatic group and heterocyclic group represented by $R_{30}$, $R_{31}$ or $R_{35}$ each has the same meaning as defined for the aliphatic group, aromatic group and heterocyclic in the general formula (I), (II) or (III).

$R_{32}$, $R_{33}$ and $R_{34}$, which may be the same or different, each represents a straight chain, branched chair or cyclic alkyl group (e.g., a methyl group, an ethyl group, an isopropyl group, a tert-butyl group, a benzyl group, an octyl group, a cyclohexyl group, a hexadecyl group, etc.), an alkenyl group (e.g., a vinyl group, an allyl group, etc.), an aryl group (e.g., a phenyl group, a p-methylphenyl group, a 2-chlorophenyl group, a 3-methoxyphenyl group, a 2,4-dimethoxyphenyl group, a 4-hexadecyloxyphenyl group, a 3-pentadecylphenyl group, a 4-bromophenyl group, a naphthyl group, etc.), an alkoxy group (e.g., a methoxy group, an ethoxy group, an isopropoxy group, a cyclohexyloxy group, a benzyloxy group, a hexadecyloxy group, a methoxyethoxy group, etc.), an alkenoxy group (e.g., an allyloxy group, etc.), or an aryloxy group (e.g.., a phenoxy group, a 4-methoxyphenoxy group, a 3-chlorophenoxy group, a 2-methylphenoxy group, a 2-tert-butyl-4-methylphenoxy group, a 4-hexadecyloxyphenoxy group, a naphthyloxy group, etc.).

Of the compounds represented by the general formula (IV), preferred compounds are these represented by the following general formula (IV-a), (IV-b), (IV-c), (IV-d), (IV-e) or (IV-f):

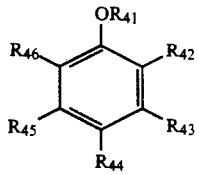
(IV-a)

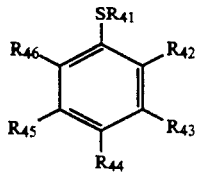
(IV-b)

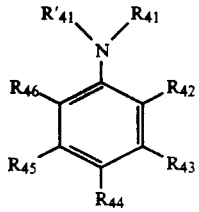
(IV-c)

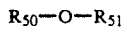
(IV-d)

(IV-e)

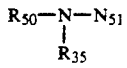
(IV-f)

wherein $R_{41}$ represents a hydrogen atom, an aliphatic group, an aromatic group, a heterocyclic group, or

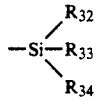

(wherein $R_{32}$, $R_{33}$, and $R_{34}$ each has the same meaning as defined in the general formula (IV); $R_{42}$, $R_{43}$, $R_{44}$, $R_{45}$ and $R_{46}$, which may be the same or different, each represents a hydrogen atom, —W—$R_{31}$, an aliphatic group, an aromatic group, a heterocyclic group, a diacylamino group, a halogen atom, an aliphatic or aromatic sulfonyl group, an aliphatic or aromatic sulfinyl group, an alkoxycarbonyl group, an aryloxycarbonyl group, a ureido group, a urethane group, a sulfamoyl group, a carbamoyl group, a cyano group, a nitro group, an aliphatic or aromatic carbonyloxy group, an aliphatic or aromatic sulfonyloxy group, a silyloxy group, or an imido group, —W—$R_{31}$ has the same meaning as defined in the general formula (IV), wherein $R_{41}$ and $R_{42}$ may be connected to each other to form a 5-membered to 7-membered ring, or two substituents of $R_{42}$ to $R_{46}$ which are present at the o-position to each other may be connected to each other to form a 5-membered to 7-membered ring, and wherein $R_{31}$ or $R_{35}$ when W represents

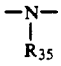

may be connected to a group present at the ortho position thereto to form a 5-membered to 7-membered ring.

The 5-membered to 7-membered ring described above may be a monocyclic ring, a condensed ring, a spiro ring, or a bicyclo ring, and the resulting condensed ring may be an alicyclic ring, an aromatic ring, a heterocyclic ring, or a heteroaromatic ring, and these rings may be substituted with one or more substituents.

$R'_{41}$ has the same meaning as $R_{35}$ defined in the general formula (IV), and $R'_{41}$ may be connected with $R_{41}$ or $R_{42}$ to form a 5-membered to 7-membered ring same as defined for $R_{41}$.

$R_{50}$ represents an aliphatic group, a heteroaromatic group, a heterocyclic group; $R_{51}$ represents a hydrogen atom, an aliphatic group, a heteroaromatic group or a heterocyclic group; and $R_{35}$ has the same meaning as defined in the general formula (IV), and $R_{50}$ and $R_{51}$ or $R_{50}$ and $R_{35}$ may be connected to each other to form a 5-membered to 7-membered ring which is the same as defined above for $R_{41}$.

Of the compounds represented by the general formulae (IV-a) to (IV-f), those represented by the general formula (IV-a) or (IV-f) are more preferred, and compounds represented by the general formula (IV-a1) to (IV-a8) and (IV-f1) described below are further more preferred.

(IV-a1)

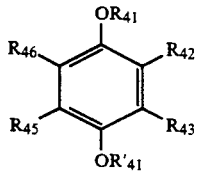

(IV-a2)

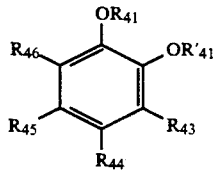

(IV-a3)

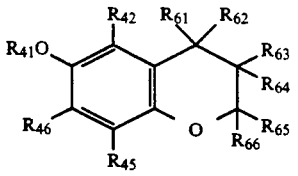

(IV-a4)

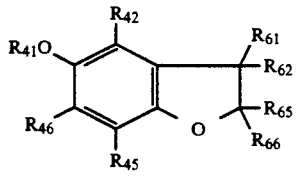

(IV-a5)

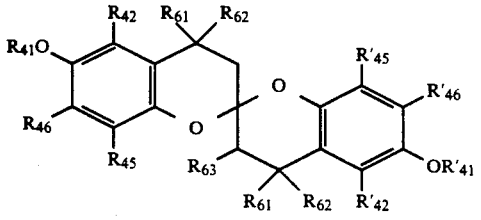

-continued (IV-a6)

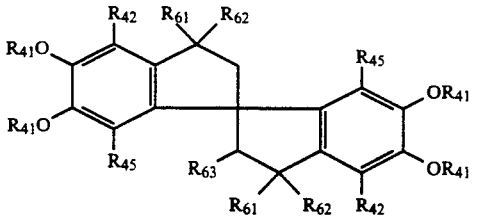

(IV-a7)

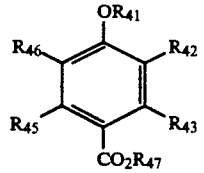

(IV-a8)

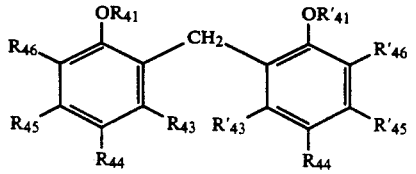

(IV-f1)

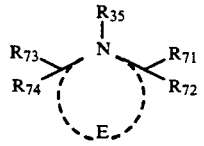

wherein $R_{41}$ to $R_{46}$ each has the same meaning as defined in the general formula (IV-a), $R'_{41}$ and $R'_{42}$ to $R'_{46}$ each has the same meaning as defined for $R_{41}$ and $R_{42}$ to $R_{46}$ respectively, and each group may be connected to each other to form a 5-membered to 7-membered ring which is the same as defined in the general formula (IV-a); $R_{47}$ represents an aliphatic group, an aromatic group or a heterocyclic group; $R_{61}$ to $R_{64}$, which may be the same or different, each represents a hydrogen atom, an aliphatic group, an aromatic group or a heterocyclic group; $R_{65}$ and $R_{66}$, which may be the same or different, each represents a hydrogen atom, an aliphatic group, an aromatic group, a heterocyclic group, an alkoxy group, an aryloxy group, an alkylthio group, an arylthio group, an alkylamino group, an acyl amino group, or

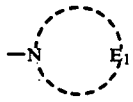

wherein $E_1$ represents a non-metallic atomic group necessary to form a 5-membered to 7-membered ring; $R_{35}$ has the same meaning as defined in the general formula (IV-f); E represents a non-metallic aromatic group necessary to form a 5-membered to 7-membered ring; and $R_{71}$ to $R_{74}$, which may be the same or different, each represents a hydrogen atom or an alkyl group.

In the case of adding the compound represented by the general formula (IV) to the photographic material during the production thereof, the total number of carbon atoms of the compound is that which provides the compound non-diffusible. On the other hand, in the case of adding the compound (having no water-solubilizing group) to a processing solution the total number of carbon atoms is that which renders the compound water soluble.

Now, the organic metal complexes used in the present invention are described in more detail below.

The organic metal complex which can be used in the present invention is characterized by containing copper, cobalt, nickel, palladium or platinum, as the central metal, and have at least one organic ligand having a bidentate or more conformation. As the central metal, nickel is particularly preferred. As the atom coordinated to the central metal, a nitrogen atom, a sulfur atom, an oxygen atom or a phosphorus atom is preferred.

Of the organic metal complexes used in the present invention, particularly preferred complexes are represented by the following general formula (V-a), (V-b), (V-c) or (V-d):

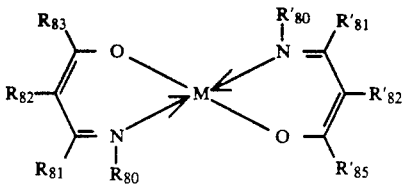
(V-a)

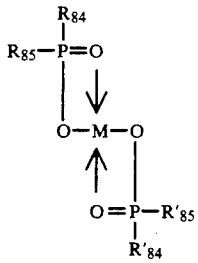
(V-b)

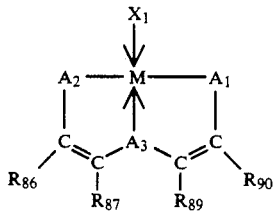
(V-c)

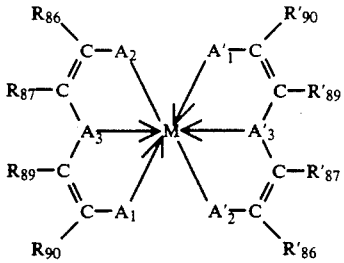
(V-d)

wherein M represents copper, cobalt, nickel, palladium or platinum; $R_{80}$ and $R'_{80}$, which may be the same or different, each represents a hydrogen atom, an alkyl group, an aryl group or a hydroxy group, wherein $R_{80}$ and $R'_{80}$ may be connected to each other; $R_{81}$, $R_{82}$, $R_{83}$, $R'_{81}$, $R'_{82}$ and $R'_{83}$, which may be the same or different, to each represents a hydrogen atom, an alkyl group or an aryl group, wherein $R_{82}$ and $R_{83}$ or $R'_{82}$ and $R'_{83}$ may be connected to each other to form an aromatic ring or a 5-membered to 8-membered ring; $R_{84}$, $R_{85}$, $R'_{84}$ and $R'_{85}$, which may be the same or different, each represents an alkyl group, an aryl group, an alkylthio group, an arylthio group, an alkoxy group, an aryloxy group, an alkylamino group or an arylamino group; $R_{86}$, $R_{87}$, $R_{88}$, $R_{89}$, $R_{90}$, $R'_{86}$, $R'_{87}$, $R'_{88}$, $R'_{89}$ and $R'_{90}$, which may be the same or different, each represents a hydrogen atom, an alkyl group or an aryl group, wherein at least one of $R_{86}$ and $R_{87}$, $R_{89}$ and $R_{90}$, $R'_{86}$ and $R'_{87}$ and $R'_{89}$ and $R'_{90}$ may be connected to each other to form an aromatic ring or a 5-membered to 8-membered ring; $X_1$ represents a compound capable of coordinating to M; $A_1$, $A_2$, $A'_1$ and $A'_2$, which may be the same or different, each represents an oxygen atom, a sulfur atom, —$NR_{91}$—, a hydroxy group, an alkoxy group, an alkylthio group or

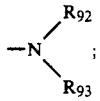

$R_{91}$ represents a hydrogen atom, an alkyl group, an aryl group, a hydroxy group or an alkoxy group; $R_{92}$ and $R_{93}$, which may be the same or different, each represents a hydrogen atom or an alkyl group; and $A_3$ and $A'_3$ each represents an oxygen atom, a sulfur atom or —NH—.

In the general formulae (V-a), (V-b), (V-c) and (V-d), an alkyl group or an alkyl moiety preferably has from 1 to 25 carbon atoms, and an aryl group or an aryl moiety preferably has from 6 to 25 carbon atoms.

Specific examples of the organic color fading preventing agents and the organic metal complexes used in the present invention are set forth below, but the present invention should not be construed as being limited thereto.

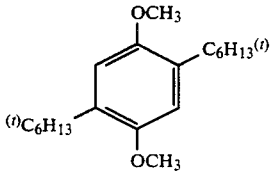
A-1

-continued
A-2
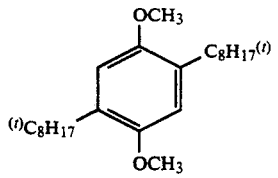
A-3
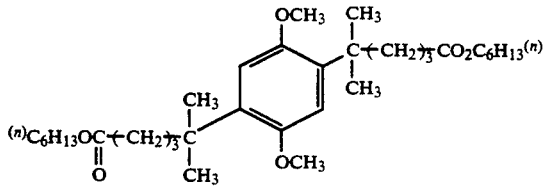
A-4
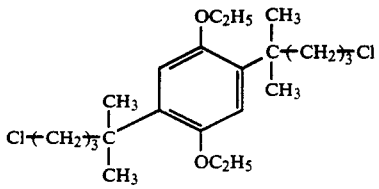
A-5
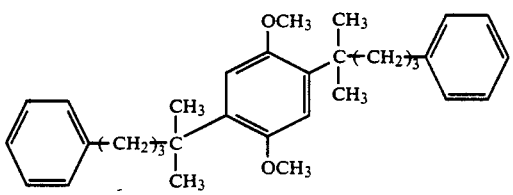
A-6
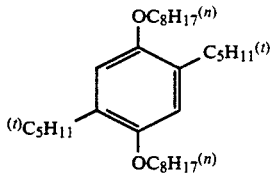
A-7
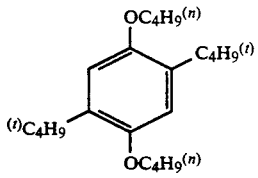
A-8
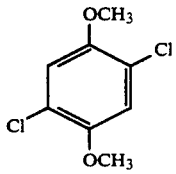
A-9
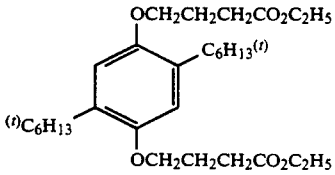

-continued
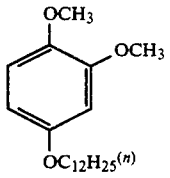
A-10
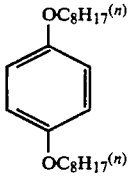
A-11
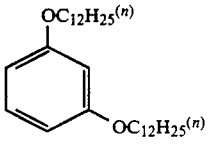
A-12
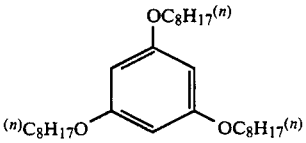
A-13
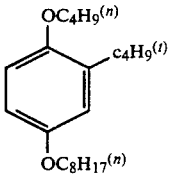
A-14
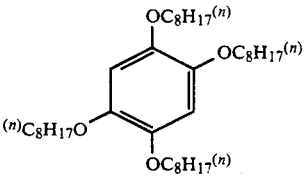
A-15
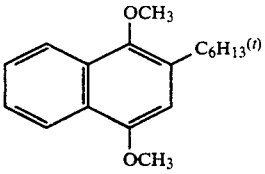
A-16
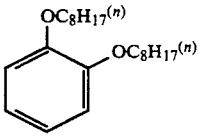
A-17
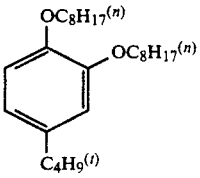
A-18

-continued
A-19
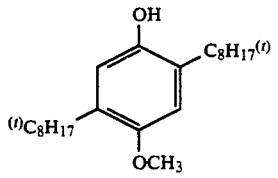
A-20
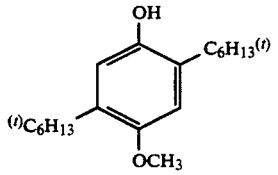
A-21
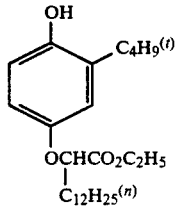
A-22
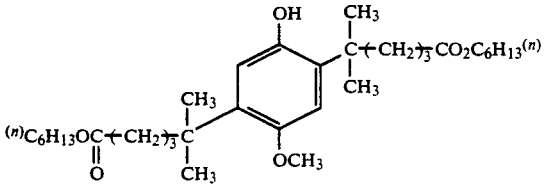
A-23
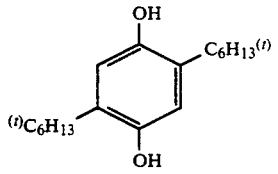
A-24
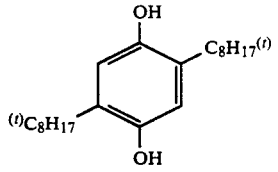
A-25
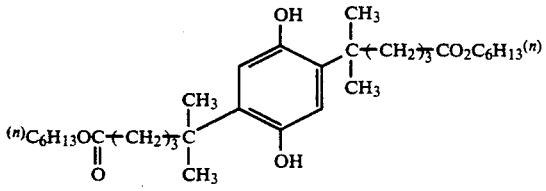
A-26
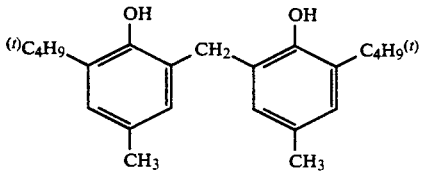

-continued
A-27
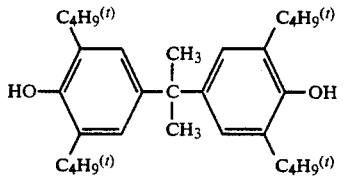
A-28
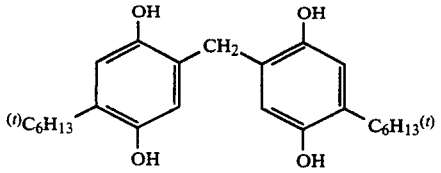
A-29
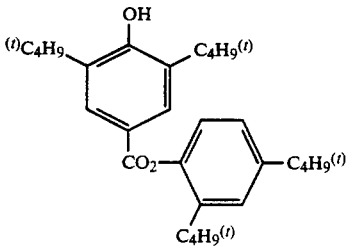
A-30
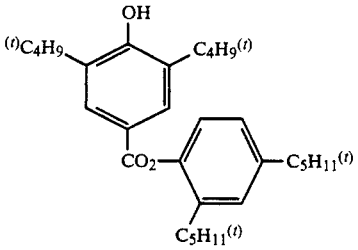
A-31
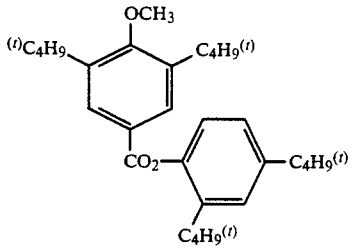
A-32
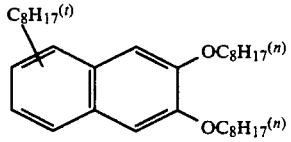
A-33
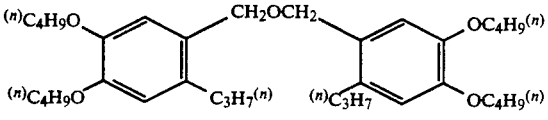
A-34
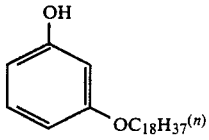

-continued
A-35
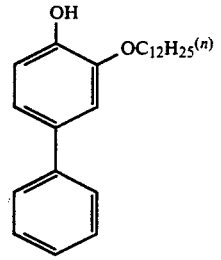
A-36
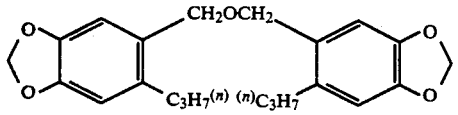
A-37
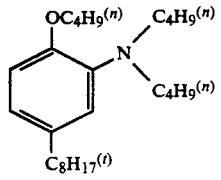
A-38
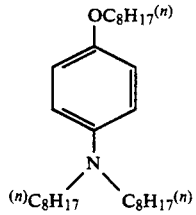
A-39
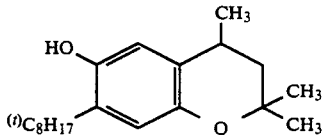
A-40
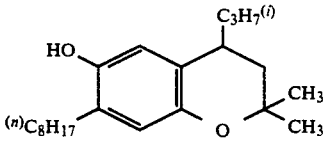
A-41
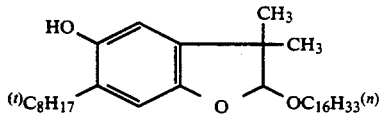
A-42
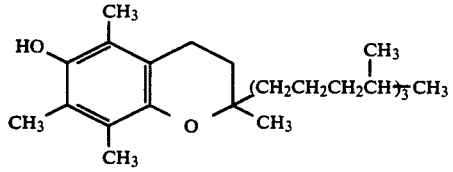
A-43
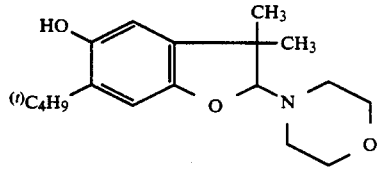

-continued
A-44
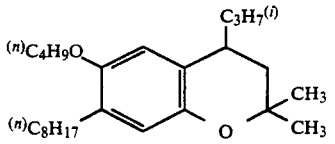
A-45
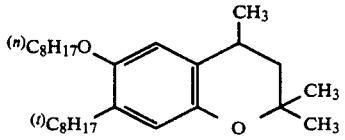
A-46
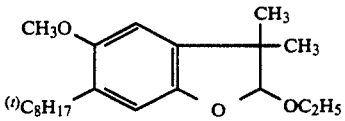
A-47
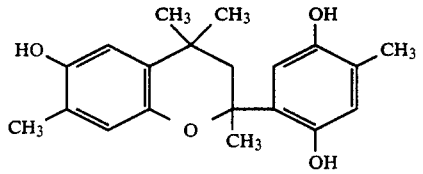
A-48
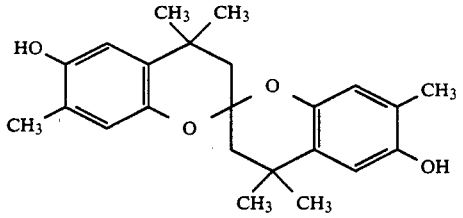
A-49
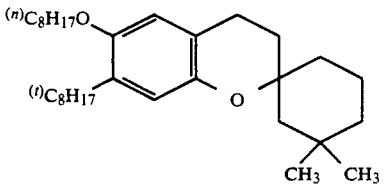
A-50
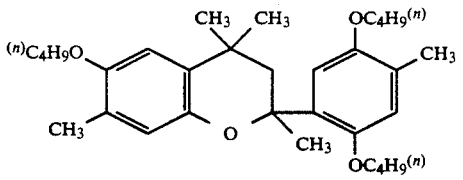
A-51
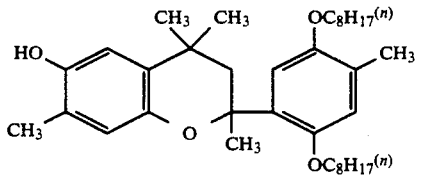
A-52
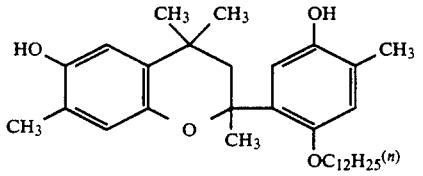

-continued
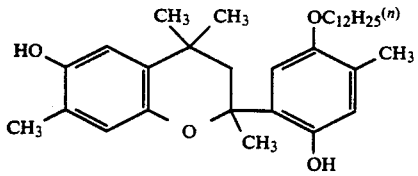
A-53
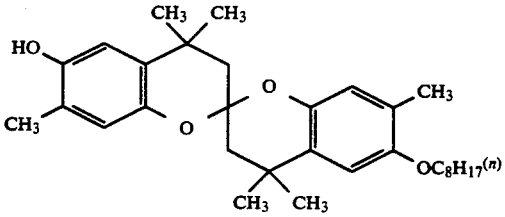
A-54
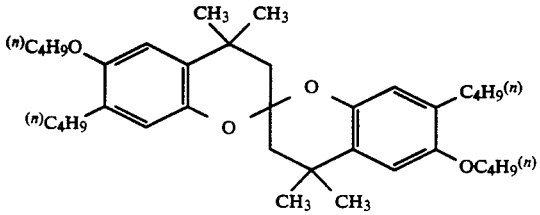
A-55
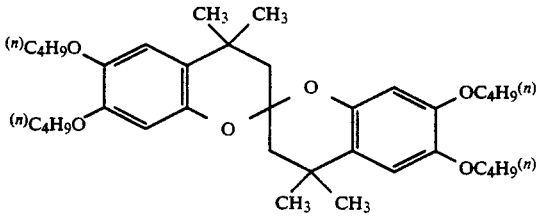
A-56
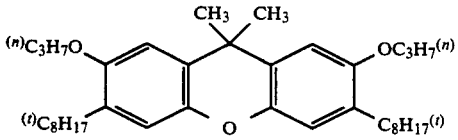
A-57
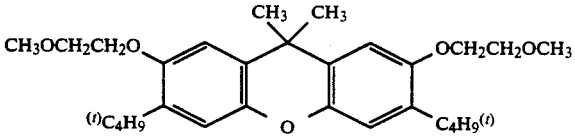
A-58
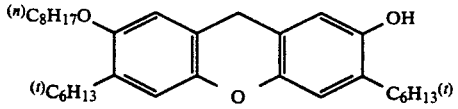
A-59
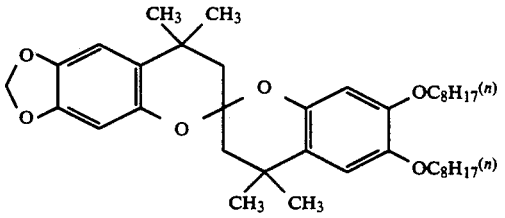
A-60
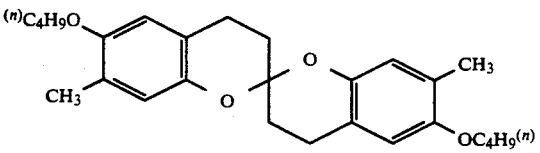
A-61

-continued
A-62
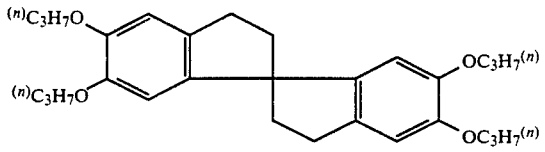
A-63
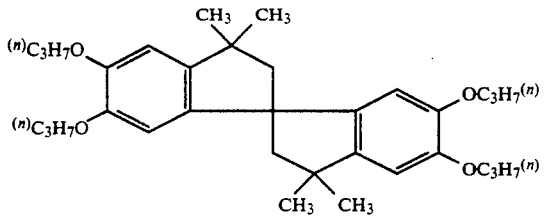
A-64
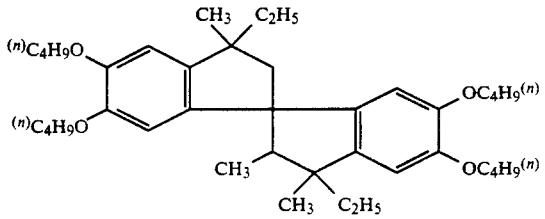
A-65
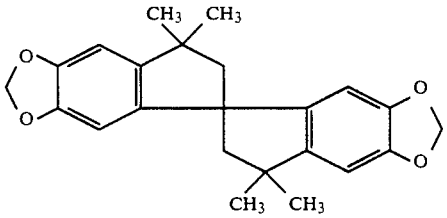
A-66
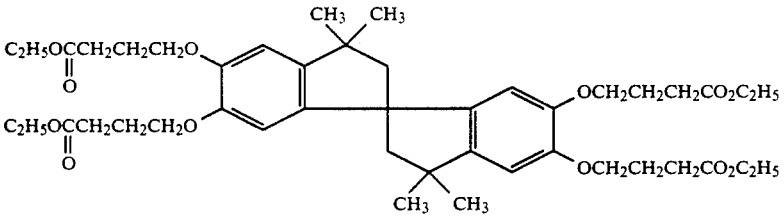
A-67
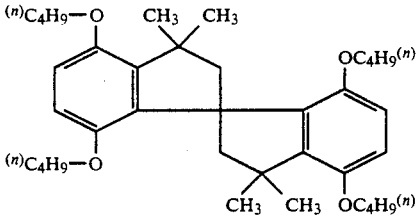
A-68
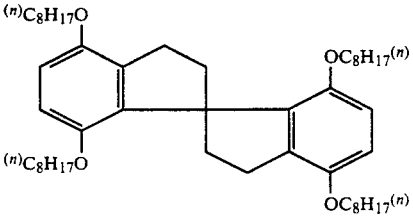

-continued
A-69
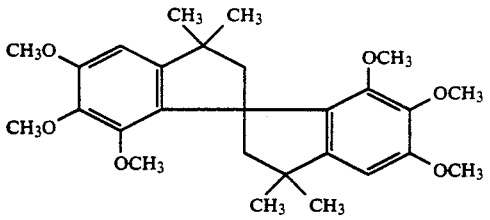
A-70
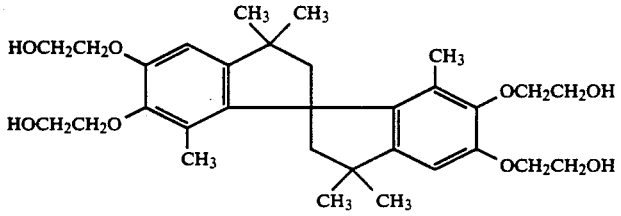
A-71
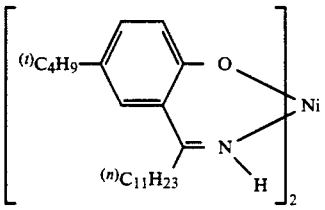
A-72
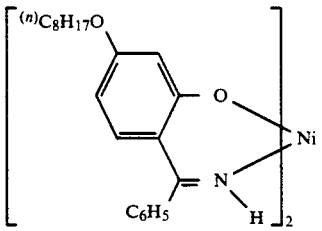
A-73
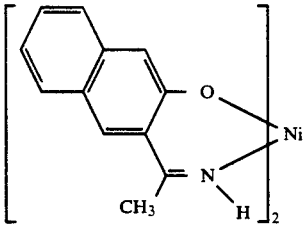
A-74
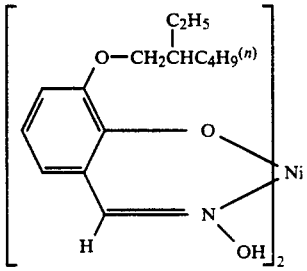

-continued
A-75
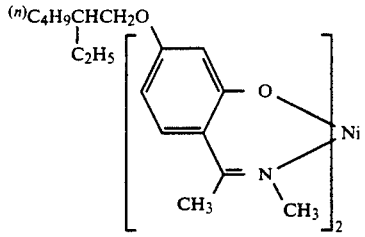
A-76
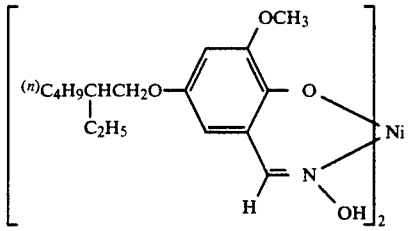
A-77
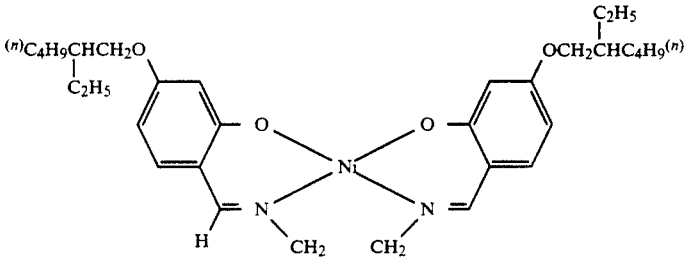
A-78
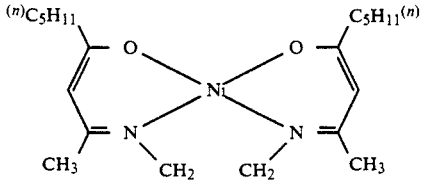
A-79
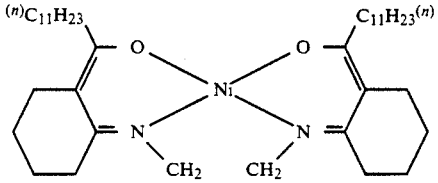
A-80
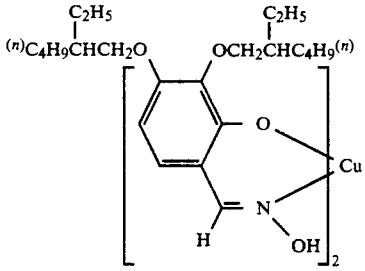
A-81
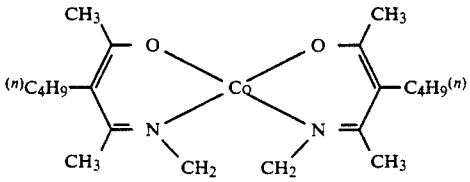

-continued
A-82
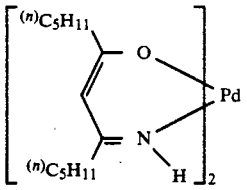
A-83
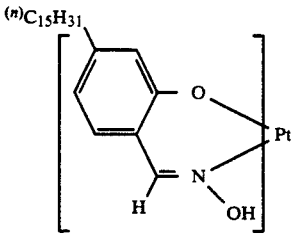
A-84
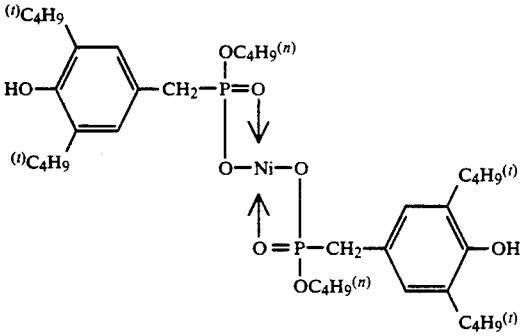
A-85
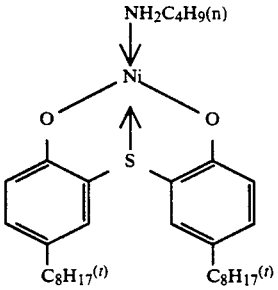
A-86
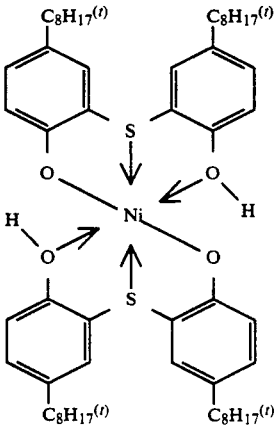

-continued
A-87
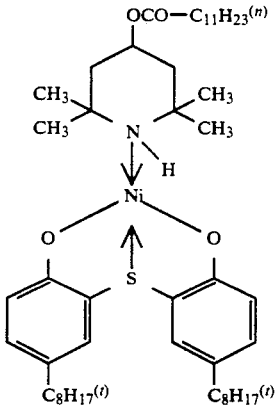
A-89
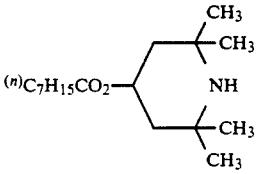
A-90
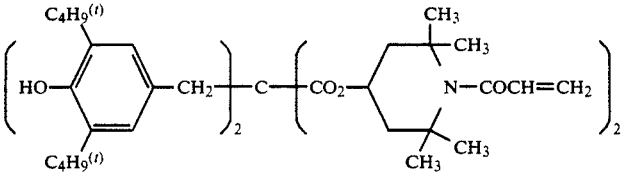
A-91
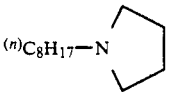
A-92
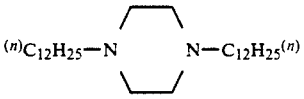
A-93
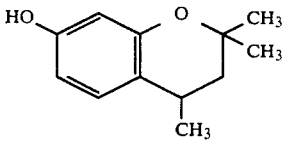
A-94
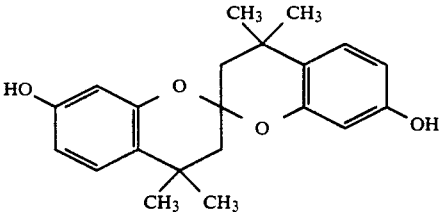
A-95
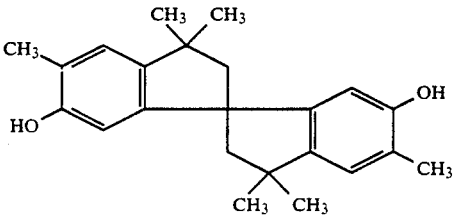
$CH_2{=}CH_2OC_{14}H_{29}{}^{(n)}$ A-96

-continued
A-97
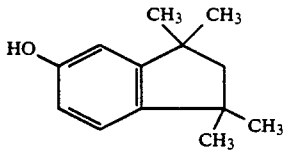
A-98
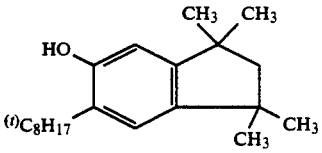
A-99
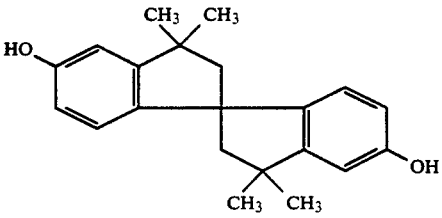
A-100
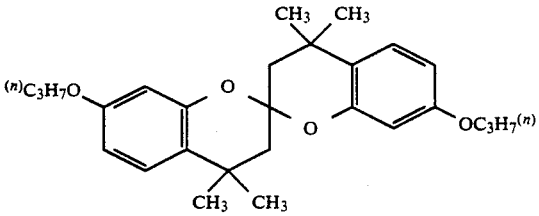
A-101
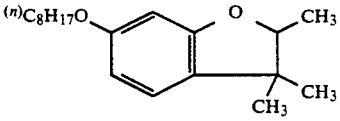
A-102
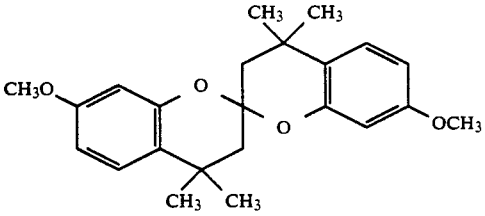
A-103
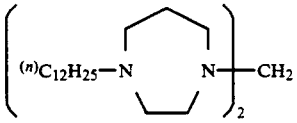
A-104
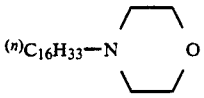
A-105
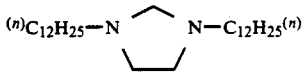
A-106
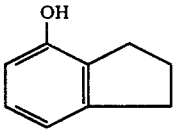

-continued
A-107
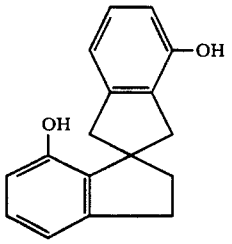
A-108
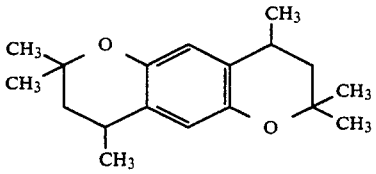
A-109
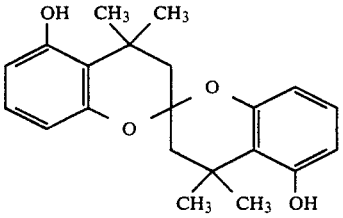
A-110
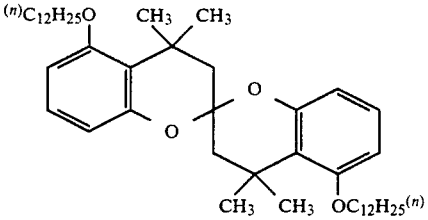
A-111
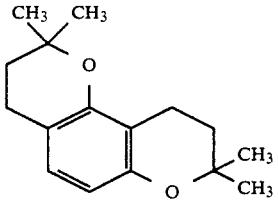
A-112
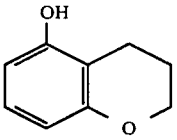
A-113
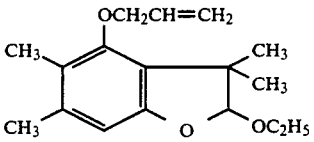
A-114
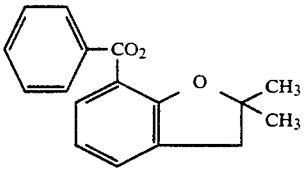

-continued
A-115
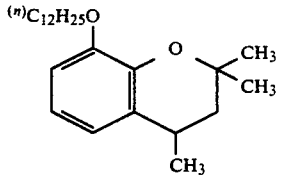
A-116
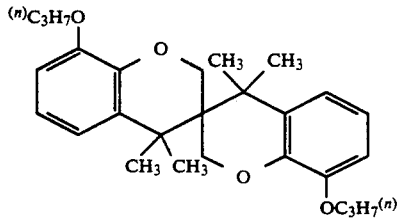
A-117
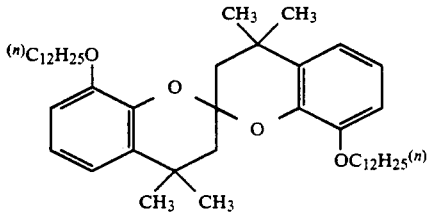
A-118
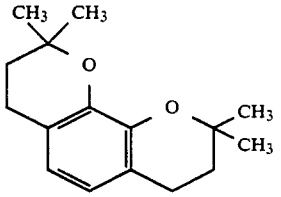
A-119
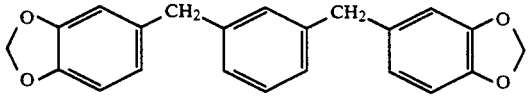
A-120
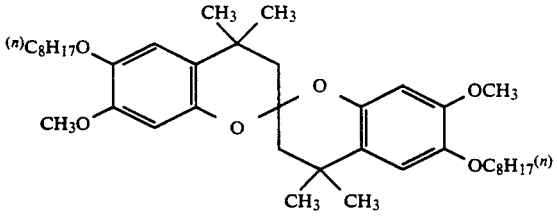
A-121
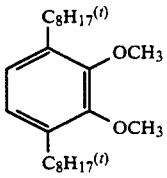
A-122
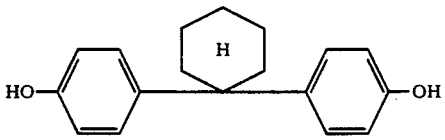

-continued
A-123
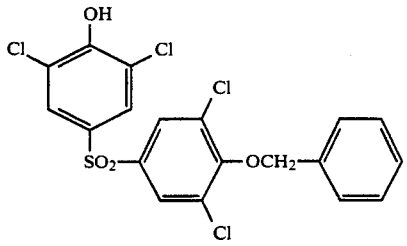
A-124
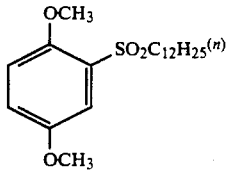
A-125
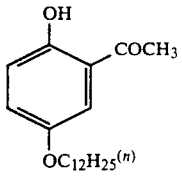
A-126
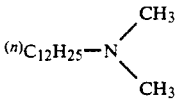
A-127
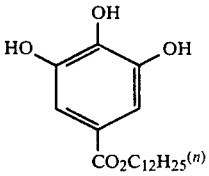
A-128
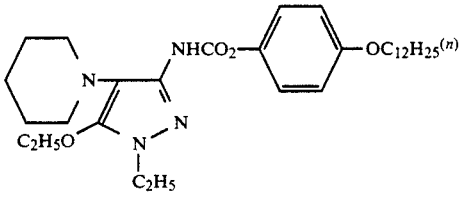
A-129
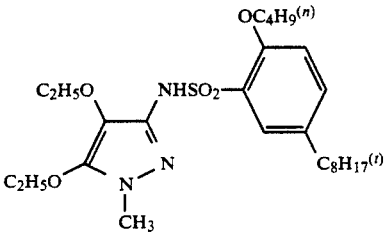
A-130
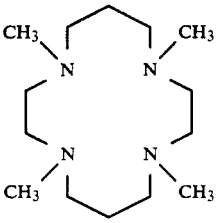

-continued
A-131
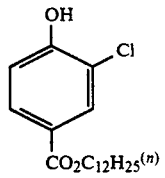
A-132
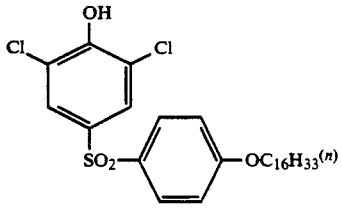
A-133
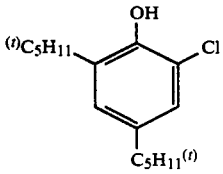
A-134
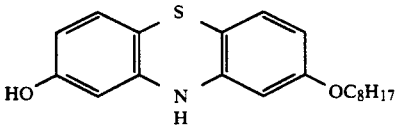
A-135
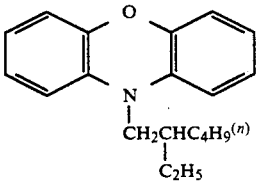
A-136
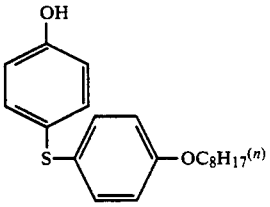
A-137
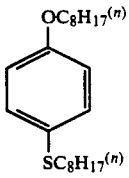
A-138
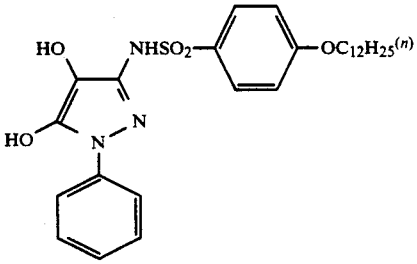

-continued
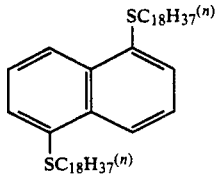
A-139
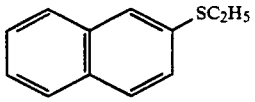
A-140
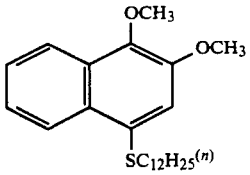
A-141
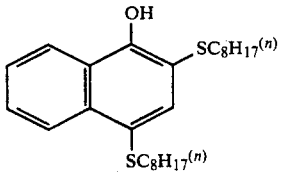
A-142
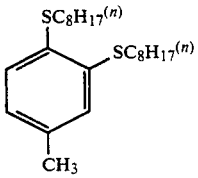
A-143
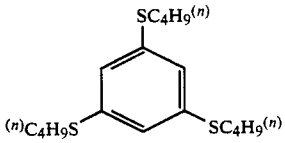
A-144
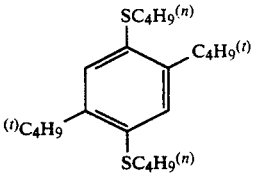
A-145
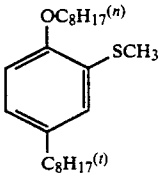
A-146
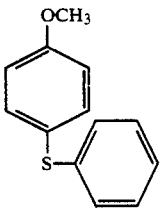
A-147

-continued
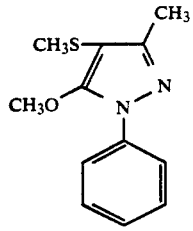
A-148
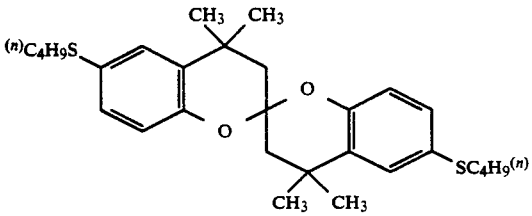
A-149
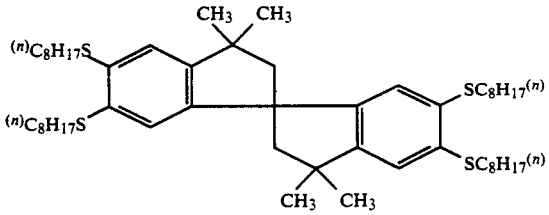
A-150
$^{(n)}C_8H_{17}OC_8H_{17}^{(n)}$ A-151
$^{(n)}C_6H_{13}OCH_2CH_2OC_6H_{13}^{(n)}$ A-152
$^{(n)}C_{12}H_{25}SCH_2CH_2OC_2H_5$ A-153
$^{(n)}C_{12}H_{25}SCH_2CH_2SC_{12}H_{25}^{(n)}$ A-154
$^{(n)}C_{12}H_{25}OCH_2CH_2OC_{12}H_{25}^{(n)}$ A-155
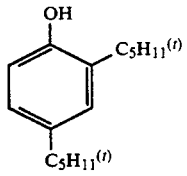
A-156
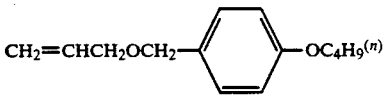
A-157
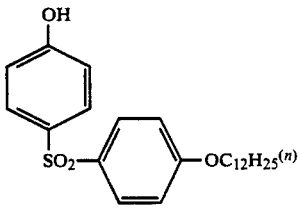
A-158
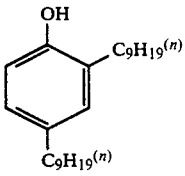
A-159

-continued
A-160
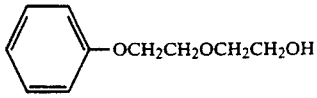
A-161
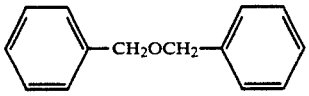
A-162
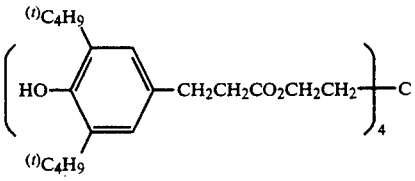
A-163
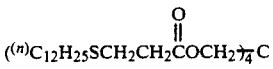
A-164
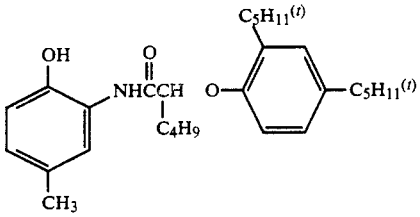
A-165
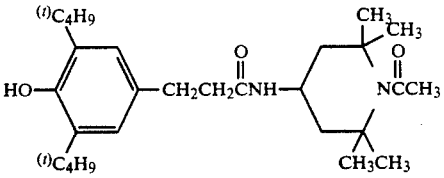
A-166
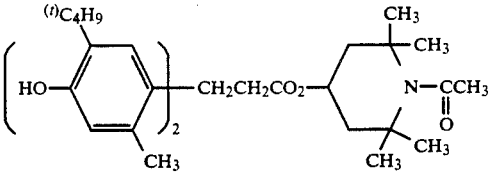
A-167
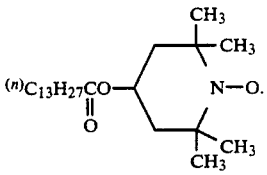
A-168
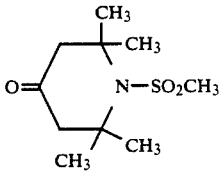

-continued

A-169

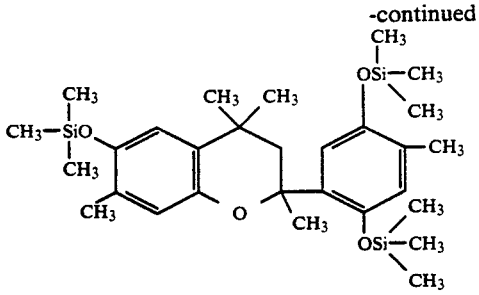

A-170

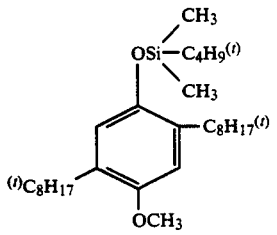

A-171

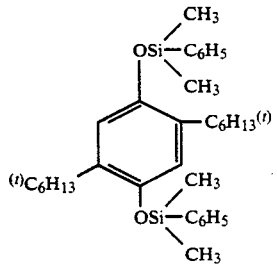

Compounds represented by the general formula (IV) and the complexes can be synthesized according to the methods as described in U.S. Pat. Nos. 3,336,135, 3,432,300, 3,573,050, 3,574,627, 3,700,455, 3,764,337, 3,935,016, 3,982,944, 4,254,216 and 4,279,990, British Patents 1,347,556, 2,062,888, 2,066,975 and 2,077,455, Japanese Patent Application (OPI) Nos. 97353/85, 152225/77, 17729/78, 20327/78, 145530/79, 6321/80, 21004/80, 24141/83, 10539/84 and 67536/87, Japanese Patent Publication Nos. 31625/73 and 12337/79, etc. or methods analogous thereto.

The compounds for use in the present invention which have low molecular weight or are easily soluble in water may be added to at least one processing solution such as a color developing solution, a bleaching solution, fixing solution, a blixing solution, water for washing and a stabilizing solution and carried over into the color photographic material during development processing of the color photographic material. However, it is preferred to incorporate the compounds into the color photographic material during the step of producing the color photographic material. In the latter case, the compounds are usually dissolved in a high-boiling point solvent (an oil) having a boiling point of at least 170° C. at atmospheric pressure or a low-boiling point solvent, or a mixture of the above described oil and low-boiling solvent, and the solution is dispersed by emulsification in an aqueous solution of a hydrophilic colloid such as gelatin, etc. The compounds for use in the present invention described above are preferably soluble in the high-boiling organic solvent. There is no particular restriction on the particle size of the emulsified dispersion particles of the compounds, but the particle size is preferably from 0.05 μm to 0.5 μm, particularly preferably from 0.1 μm to 0.3 μm. Further, it is particularly preferred that the compounds for use in the present invention be co-emulsified with coupler(s) to achieve the effects of the present invention. In this case, the ratio of oil/coupler is preferably from 0.00 (containing no oil) to 2.0 by weight ratio.

Each amount of the above described compounds of (1) and (2) is from $1\times10^{-2}$ mol to 10 mols, preferably from $3\times10^{-2}$ mols to 5 mols per mol of the coupler in the same layer. The molar ratio of the amount of the compound(s) of (1) to that of the compound(s) of (2) is preferably from 0.1 to 10.

Specific examples of the above described oil which can be used in the case of incorporating the compound according to the present invention in the color photographic material include alkyl phthalates (e.g., dibutyl phthalate, dioctyl phthalate, diisodecyl phthalate, dimethoxyethyl phthalate), phosphoric acid esters (e.g., diphenyl phosphate, triphenyl phosphate, tricresyl phosphate, dioctylbutyl phosphate, monophenyl-p-tert-butylphenyl phosphate), citric acid esters (e.g., tributyl acetylcitrate), benzoic acid esters (e.g., octyl benzoate), alkylamides (e.g., diethyllaurylamide, dibutyllaurylamide), fatty acid esters (e.g., dibutoxyethyl succinate, diethyl azelate, dioctyl sebacate, trimesic acid esters (e.g., tributyl trimesate), compounds having an epoxy ring (e.g., those as described in U.S. Pat. No. 4,540,657) phenols

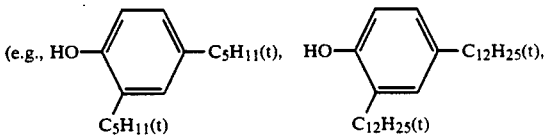

-continued

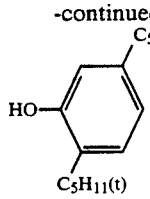

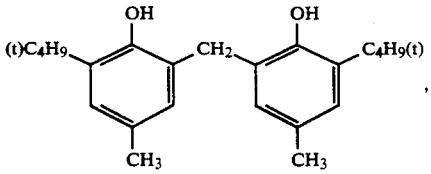

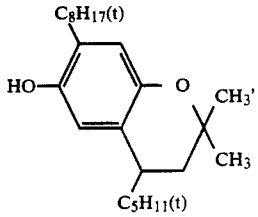

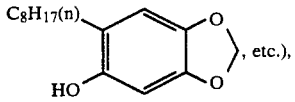

ethers (e.g., phenoxyethanol, diethylene glyclol monophenyl ether), etc.

Also, the low-boiling solvent which can be used as an auxiliary solvent in the case of incorporating the above described compounds according to the present invention into the color photographic material preferably is an organic solvent having a boiling point of from about 30° C. to about 150° C. at atmospheric pressure and examples thereof include lower alkyl acetates (e.g., ethyl acetate, isopropyl acetate, butyl acetate, etc.), ethyl propionate, methanol, ethanol, secondary butyl alcohol, cyclohexanol, fluorinated alcohol, ethyl isobutyl ketone, β-ethoxyethyl acetate, methyl cellosolve acetate, acetone, methylacetone, acetonitrile, dioxane, dimethylformamide, dimethylsulfoxide, chloroform, cyclohexane, etc.

Furthermore, in place of the high-boiling organic solvent, an oily solvent for additives such as coupler(s), etc. (including a solvent which is solid at room temperature, such as wax, etc.) as well as a latex polymer can be used. Additives themselves, such as a coupler, a color mixing preventing agent, an ultraviolet light absorbing agent, etc., may be used as an oily solvent for dissolving the compounds for use in the present invention.

As the latex polymer as described above, there are latex polymers produced by using such as monomers acrylic acid, methacrylic acid, esters of these acids (e.g., methyl acrylate, ethyl acrylate, butyl methacrylate, etc.), acrylamide, methacrylamide, vinyl esters (e.g., vinyl acetate, vinyl propionate, etc.), acrylonitrile, styrene, divinylbenzene, vinyl alkyl ethers (e.g., vinyl ethyl ether, etc.), maleic acid esters (e.g., maleic acid methyl ester, etc.), N-vinyl-2-pyrrolidone, N-vinylpyridine, 2-vinylpyridine, and 4-vinylpyridine, singly or as a mixture of two or more.

In the case of dispersing the solution of the compound for use in the present invention alone or together with coupler(s) in an aqueous solution of a hydrophilic protective colloid, a surface active agent is usually used and examples of the surface active agent include saponin, sodium alkylsulfosuccinate, sodium alkylbenzenesulfonate, etc.

The compounds according to the present invention described above can be used in combination with a yellow coupler, a magenta coupler, or a cyan coupler. In these cases, it is particularly preferred, to achieve the effects of the present invention, to use the compounds in combination with a magenta coupler.

The coupler which is used in combination with the above described compounds may be 4-equivalent or 2-equivalent for silver ion, and also may be in the form of a polymer or an oligomer. Furthermore, the couplers which are used in combination with the above described compounds of the present invention may be used singly or as a mixture of two or more kinds thereof.

Couplers which can be preferably used in the present invention are those represented by the following general formula (C-I), (C-II), (M-I), (M-II) or (Y);

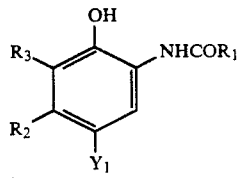

(C-I)

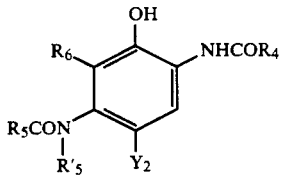

(C-II)

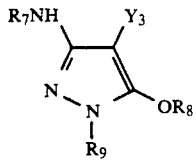

(M-I)

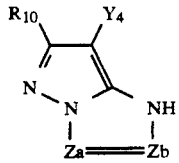

(M-II)

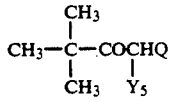

(Y)

wherein, $R_1$, $R_4$, and $R_5$ each represents an aliphatic group, an aromatic group, a heterocyclic group, an aromatic amino group or a heterocyclic amino group; $R_2$ represents an aliphatic group; $R_3$ and $R_6$ each represents a hydrogen atom, a halogen atom, an aliphatic group, an aliphatic oxy group, or an acylamino group; $R_5'$ represents a hydrogen atom, or a group represented by $R_5$ defined above; $R_7$ and $R_9$ each represents a substituted or unsubstituted phenyl group; $R_8$ represents a hydrogen atom, an aliphatic acyl group, an aromatic acyl group, an aliphatic sulfonyl group, or an aromatic sulfonyl group; $R_{10}$ represents a hydrogen atom or a substituent; Q represents a substituted or unsubstituted N-phenylcarbamoyl group; Za and Zb each represents a methine group, a substituted methine group, or =N—; and $Y_1$, $Y_2$, $Y_3$, $Y_4$, and $Y_5$ each represents a hydrogen atom, or a group capable of releasing upon a coupling reaction with the oxidation product of a color developing agent (hereinafter, the group is referred to as a releasing group).

In the general formulae (C-I) and (C-II) described above, $R_2$ and $R_3$ or $R_5$ and $R_6$ may be connected to each other to form a 5-membered, 6-membered, or 7-membered ring.

Furthermore, the coupler represented by the above described formula may form a dimer or a higher polymer through $R_1$, $R_2$, $R_3$ or $Y_1$; $R_4$, $R_5$, $R_6$ or $Y_2$; $R_7$, $R_8$, $R_9$ or $Y_3$; $R_{10}$, Za, Zb Or $Y_4$; or Q or $Y_5$.

The aliphatic group described above is a straight chain, branched chain or cyclic alkyl, alkenyl, or alkynyl group.

Detailed description for the above-described couplers can be seen in the following U.S. patents:

Couplers represented by the general formula (C-1): U.S. Pat. Nos. 3,772,002, 4,564,590, 4,511,647 and 4,518,687

Couplers represented by the general formula (C-2): U.S. Pat. Nos. 2,895,826, 4,557,999, 4,565,777, 4,124,396, 4,613,564, 4,327,173, 4,564,586 and 4,430,423

Couplers represented by the general formula (M-I): U.S. Pat. Nos. 2,311,082, 2,343,703, 2,600,788, 2,908,573, 3,062,653, 3,152,896 and 3,936,015

Couplers represented by the general formula (M-II): U.S. Pat. Nos. 4,540,654 and 4,500,630

Couplers represented by the general formula (Y): U.S. Pat. Nos. 4,622,287 and 4,623,616

Preferred specific examples of the cyan couplers represented by the general formulae (C-I) and (C-II) are illustrated below, but the present invention should not be construed as being limited thereto.

(C-1)

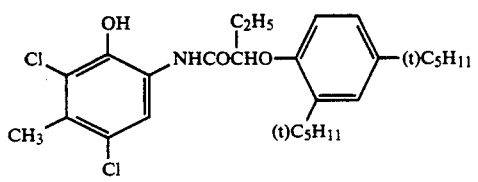

(C-2)

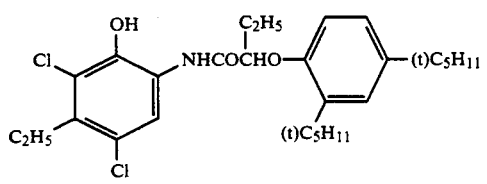

(C-3)

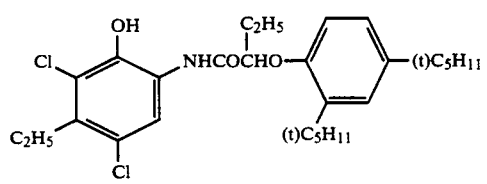

(C-4)

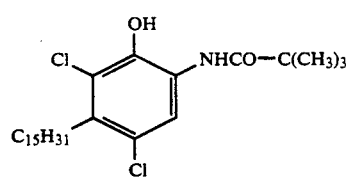

(C-5)

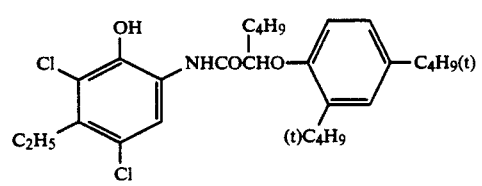

(C-6)

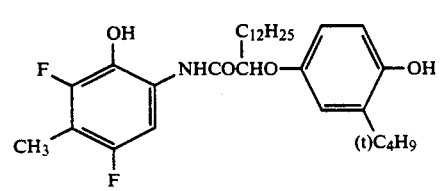

-continued
(C-7)
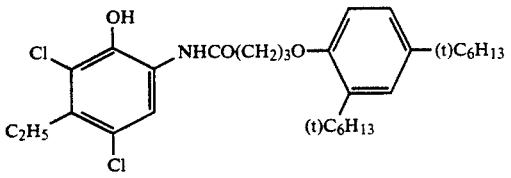
(C-8)
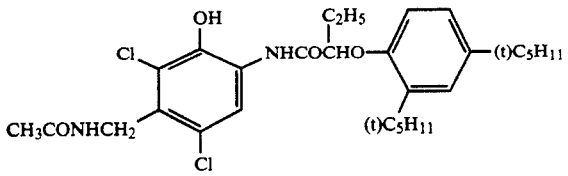
(C-9)
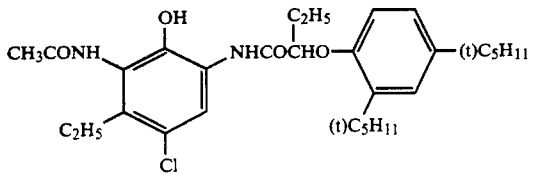
(C-10)
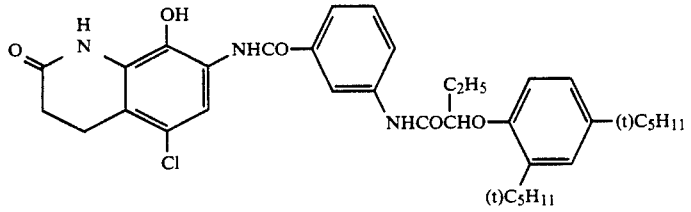
(C-11)
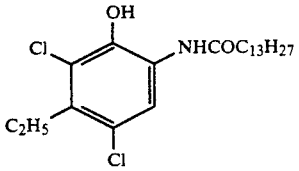
(C-12)
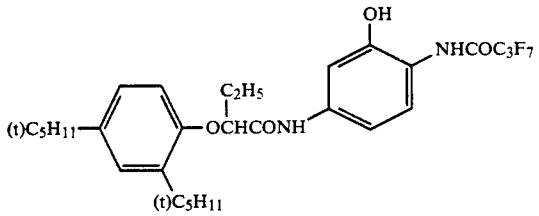
(C-13)
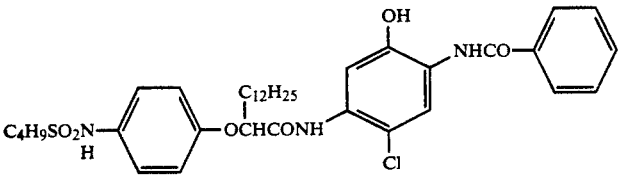
(C-14)
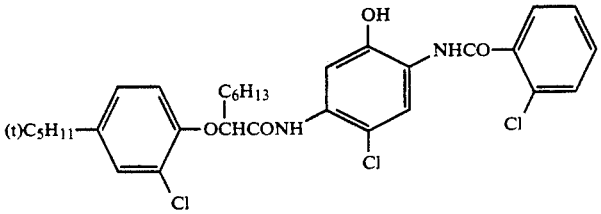

-continued
(C-15)
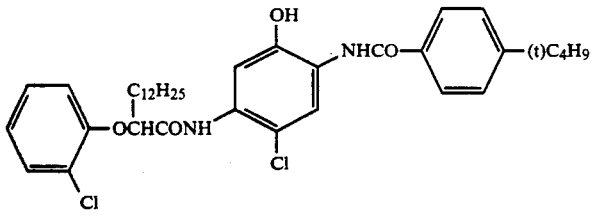
(C-16)
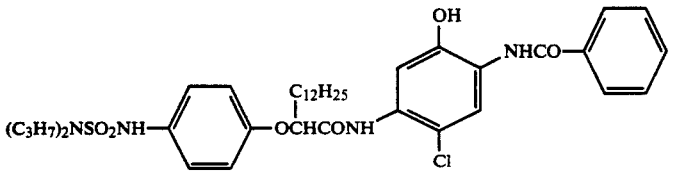
(C-17)
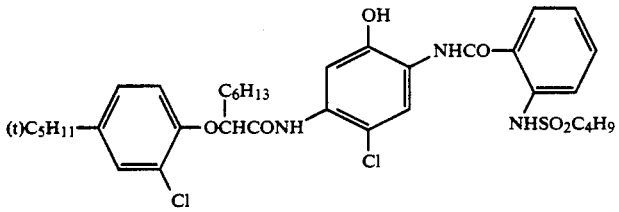
(C-18)
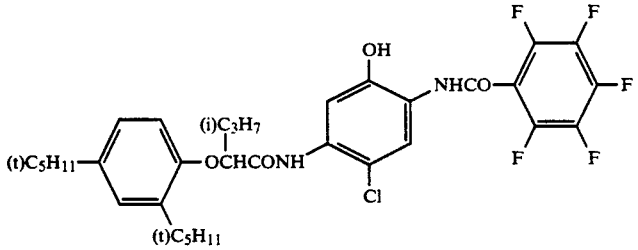
(C-19)
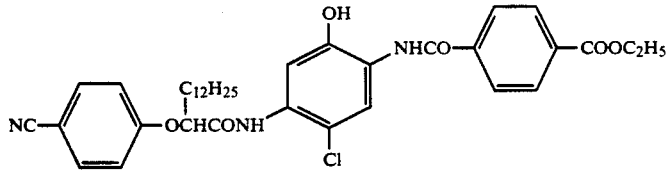
(C-20)
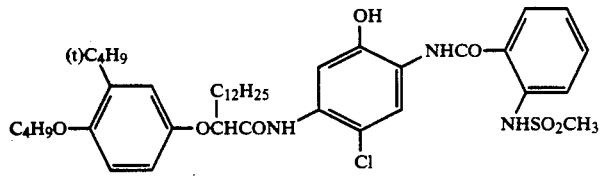
(C-21)
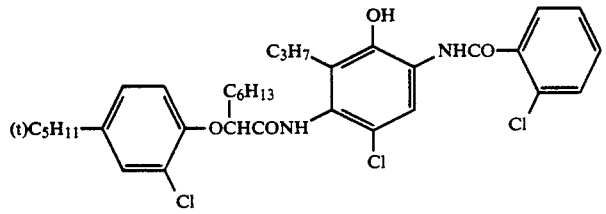

-continued
(C-22)
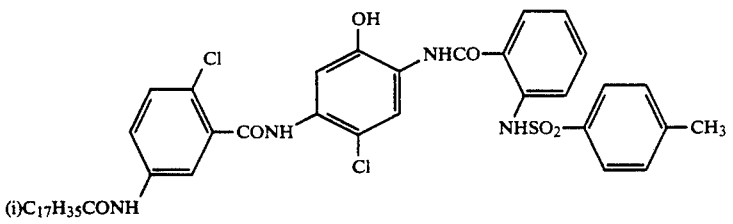
(C-23)
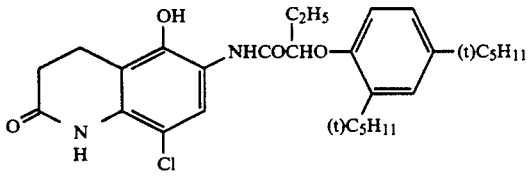
(C-24)
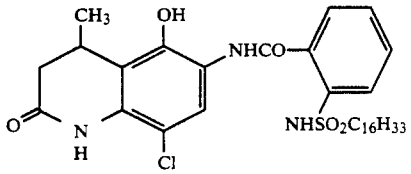
(C-25)
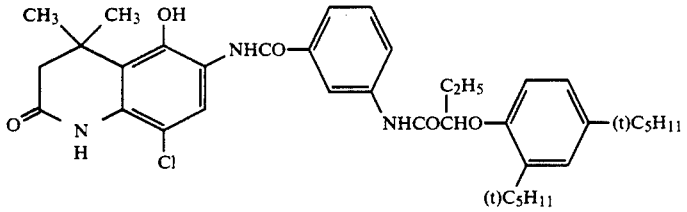
(C-26a)
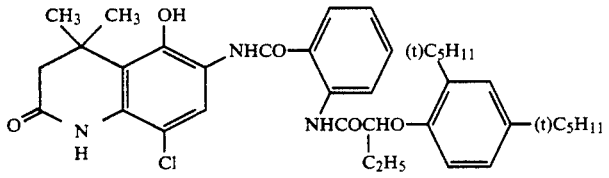
(C-26b)
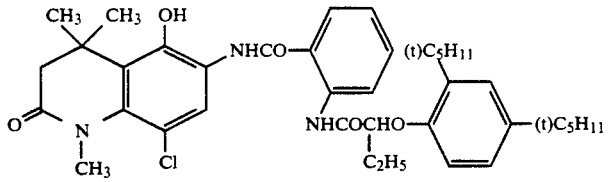
(C-27)
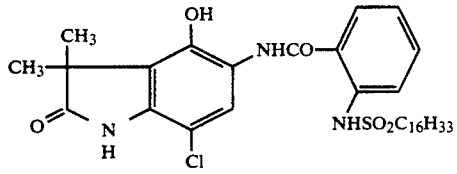
(C-28)
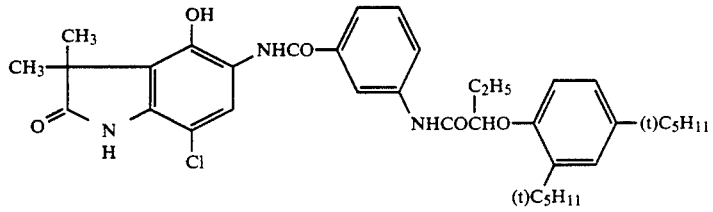

-continued
(C-29)
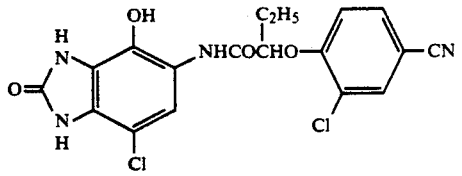
(C-30)
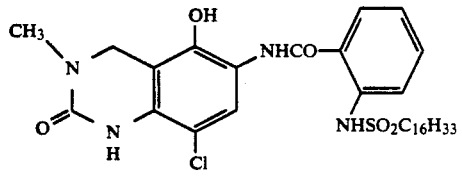
(C-31)
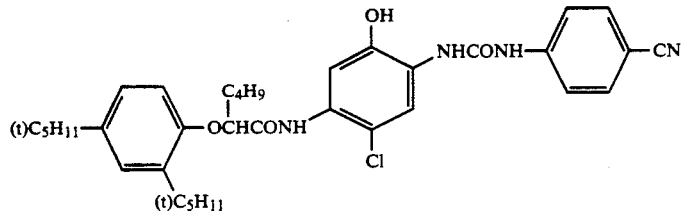
(C-32)
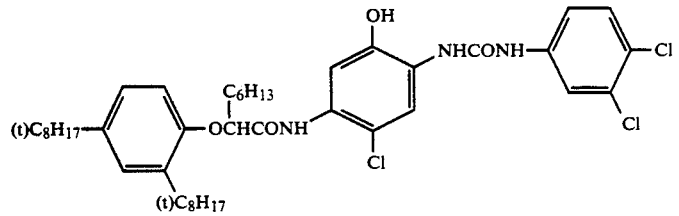
(C-33)
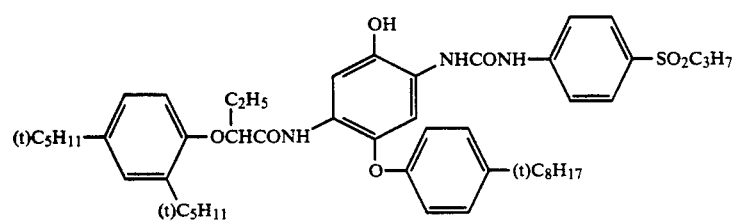
(C-34)
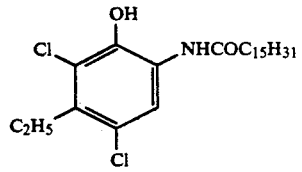
(C-35)
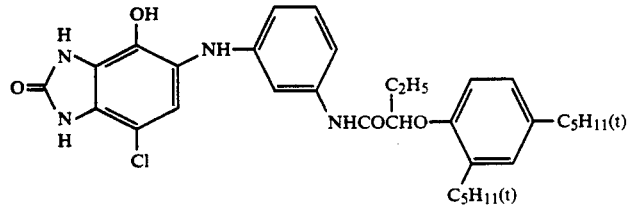

-continued
(C-36)
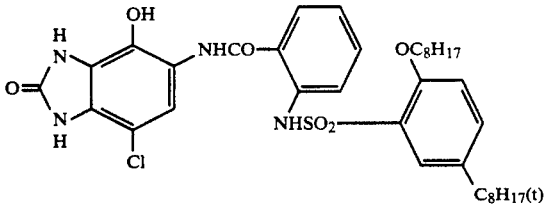
(C-37)
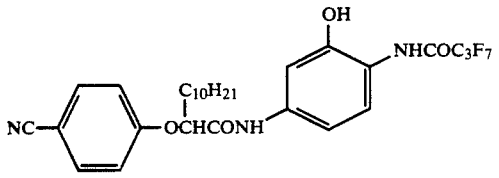
(C-38)
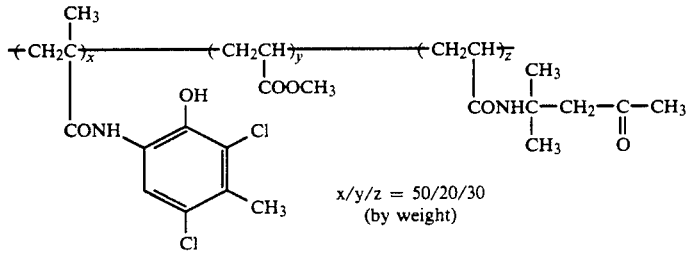
x/y/z = 50/20/30
(by weight)
(C-39)
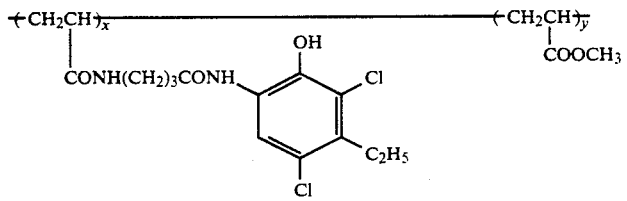
x/y = 55/45
(by weight)
(C-40)
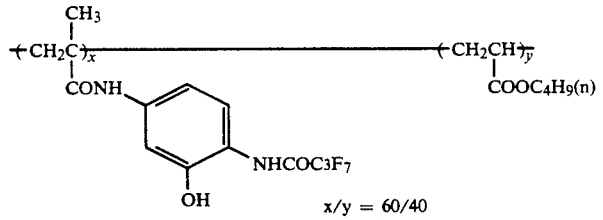
x/y = 60/40
(by weight)
(C-41)
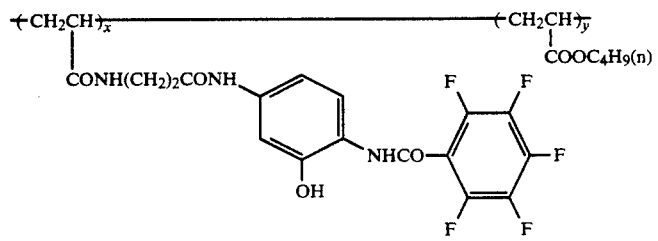
x/y = 50/50
(by weight)

-continued
(C-42)
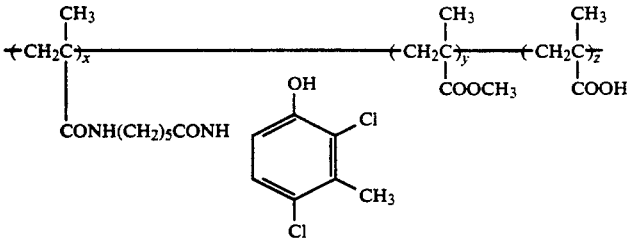
x/y/z = 55/40/5
(by weight)
(C-43)
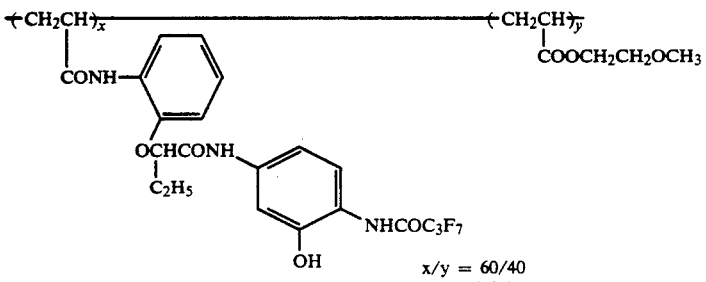
x/y = 60/40
(by weight)
(C-44)
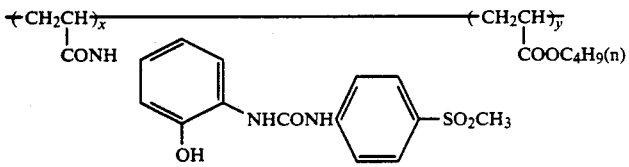
x/y = 50/50
(by weight)
(C-45)
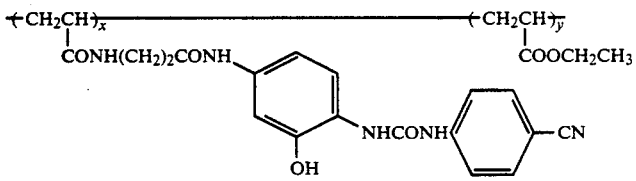
x/y = 45/55
(by weight)
(C-46)
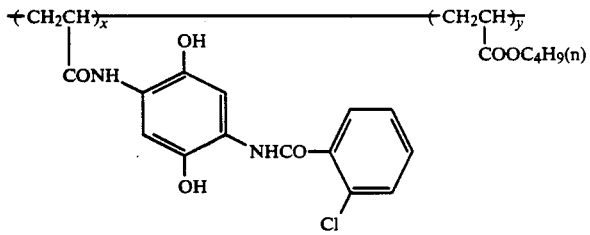
x/y = 50/50
(by weight)
(C-47)
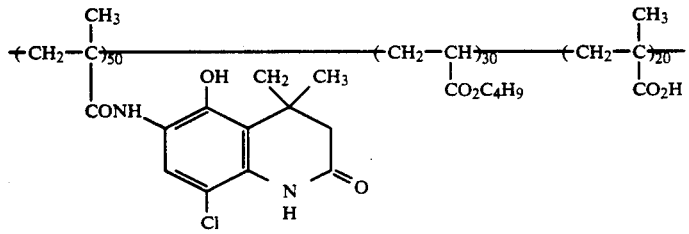

-continued
(C-48)
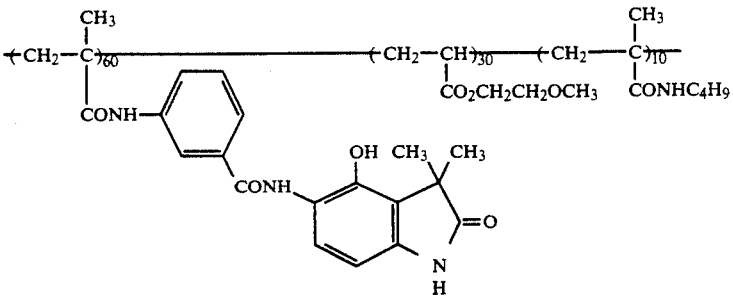
(C-49)
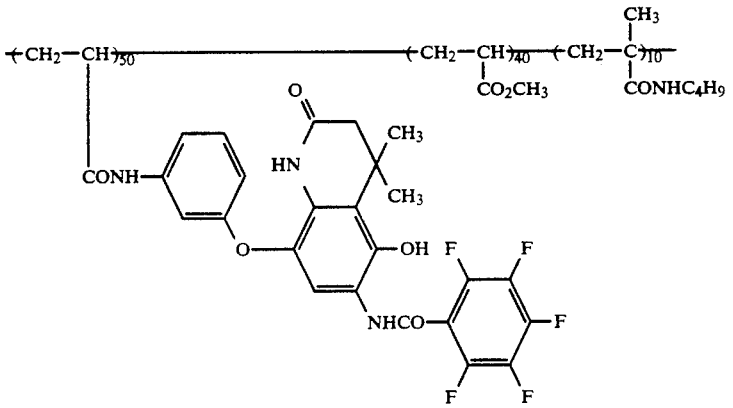
Preferred specific examples of the magenta couplers represented by the general formulae (M-I) and (M-II) are illustrated below, but the present invention should not be construed as being limited thereto.
(M-1)
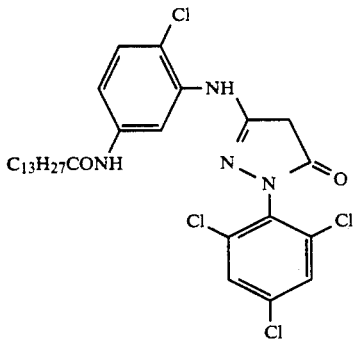
(M-2)
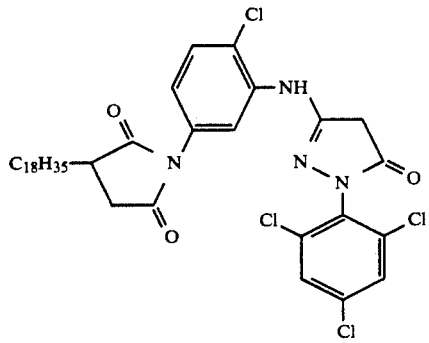

-continued
(M-3)
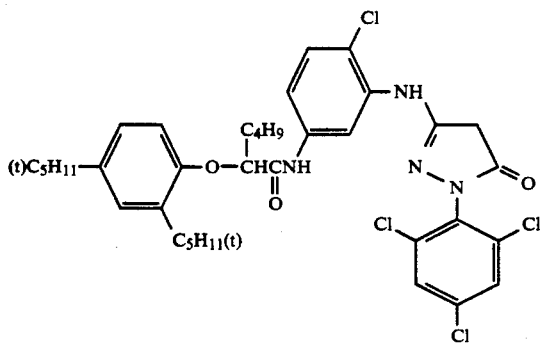
(M-4)
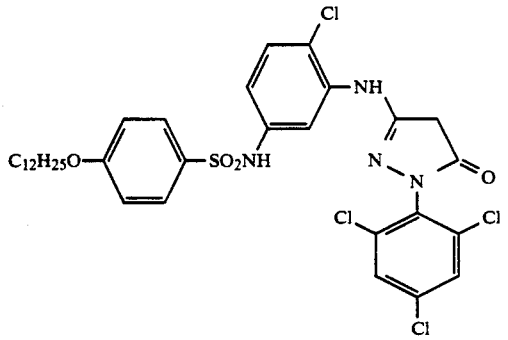
(M-5)
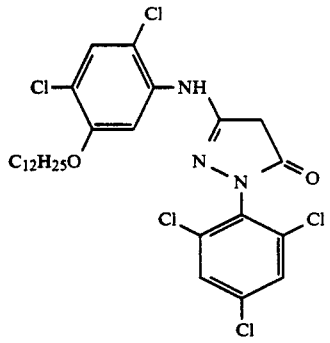
(M-6)
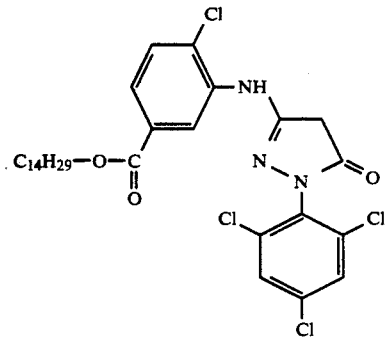

-continued
(M-7)
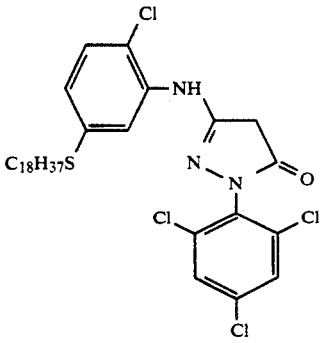
(M-8)
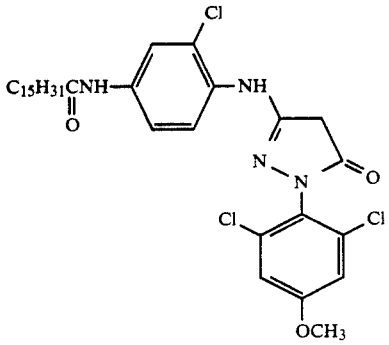
(M-9)
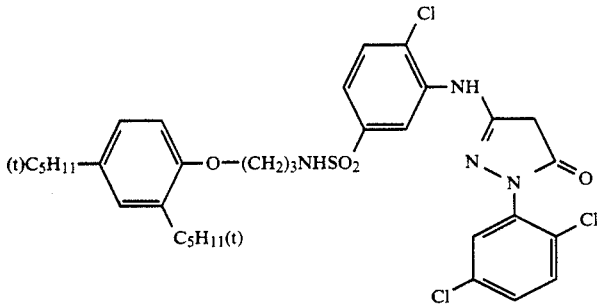
(M-10)
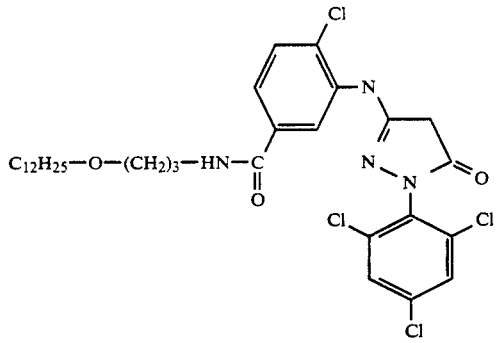
(M-11)
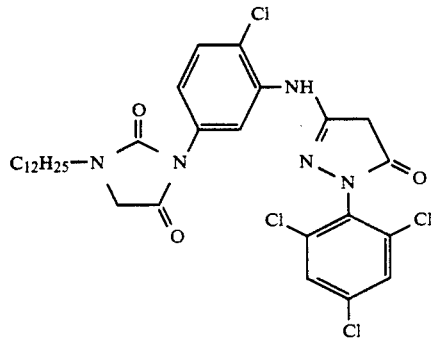

-continued
(M-12)
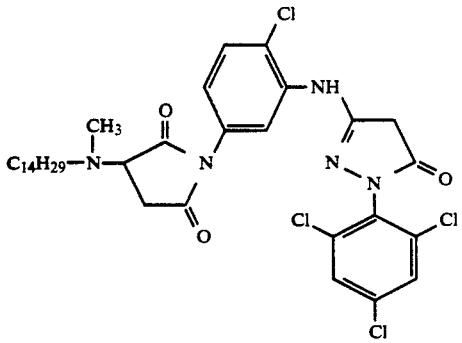
(M-13)
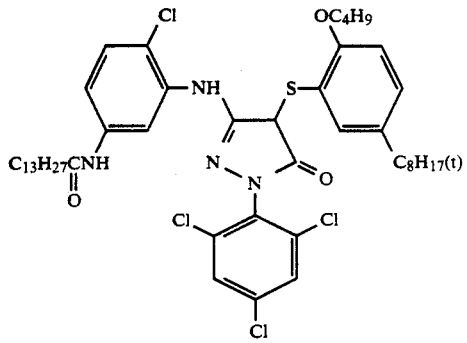
(M-14)
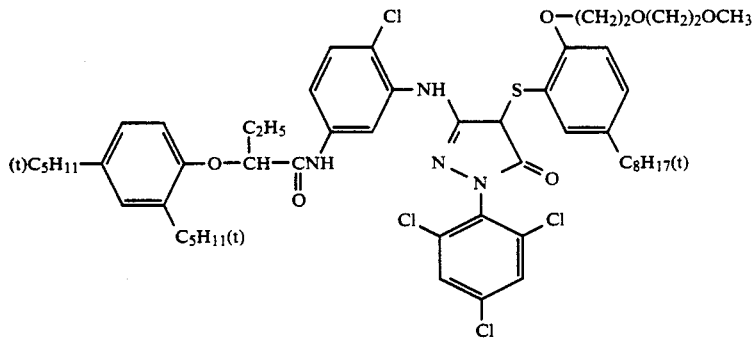
(M-15)
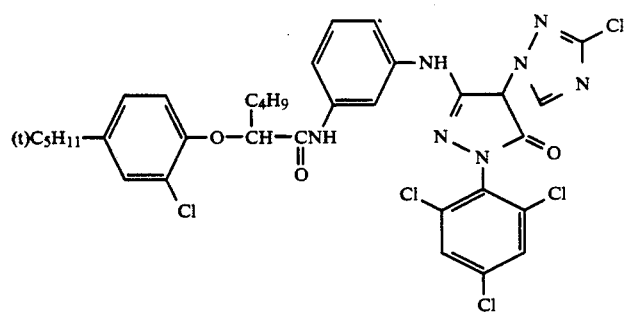
(M-16)
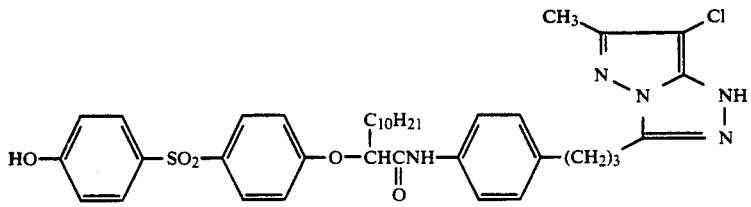

-continued
(M-17)
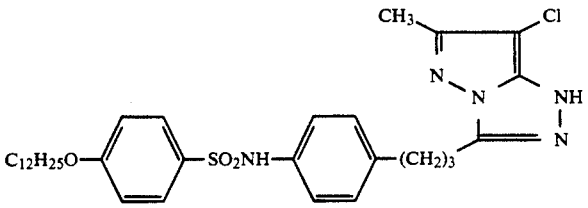
(M-18)
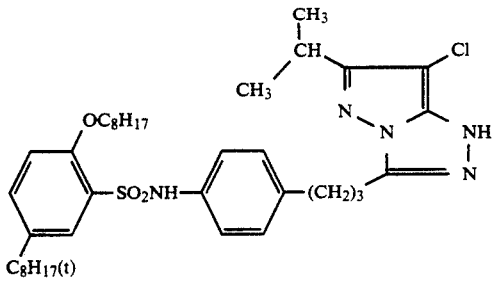
(M-19)
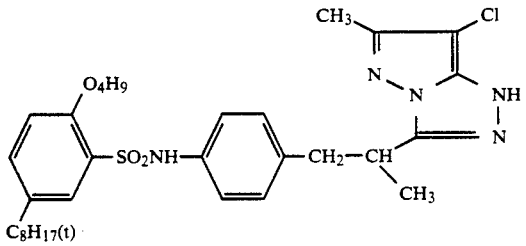
(M-20)
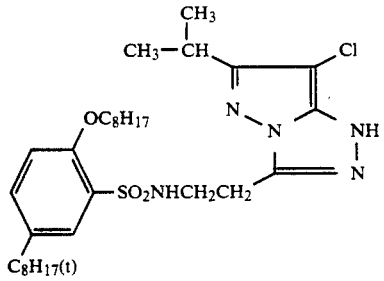
(M-21)
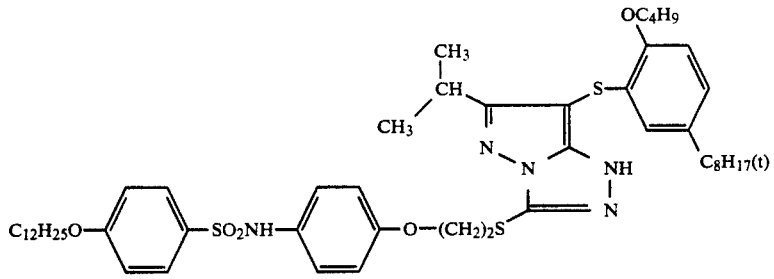
(M-22)
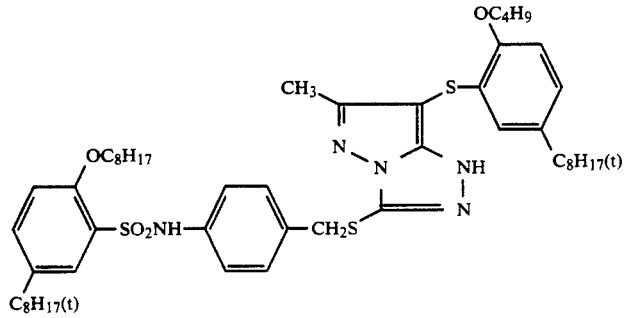

-continued
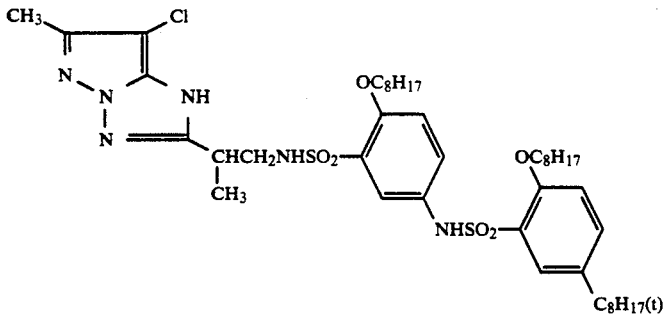
(M-23)
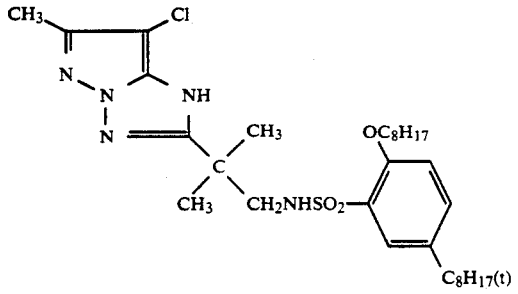
(M-24)
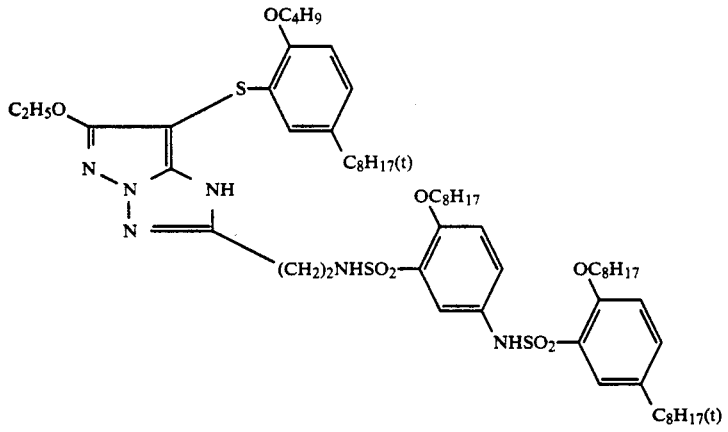
(M-25)
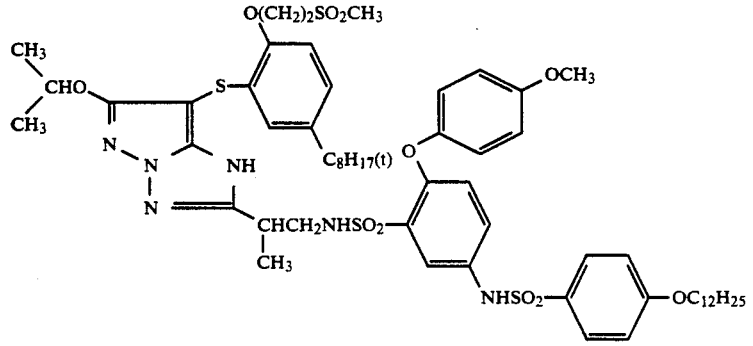
(M-26)

-continued
(M-27)
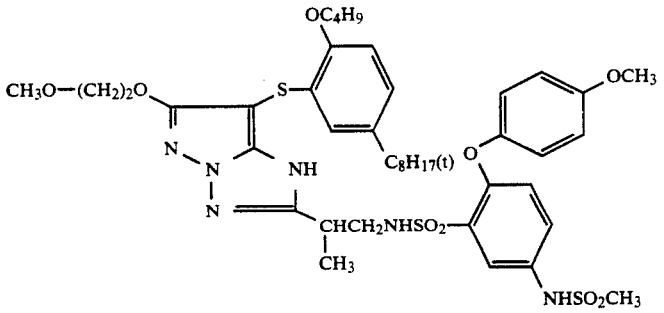
(M-28)
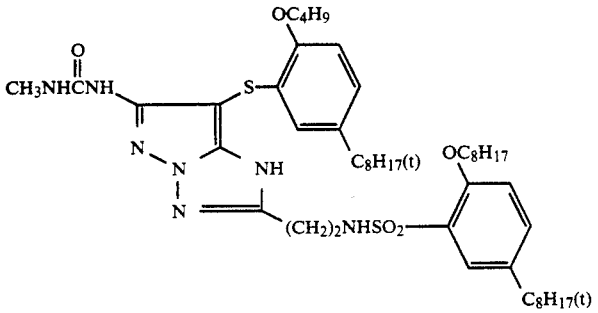
(M-29)
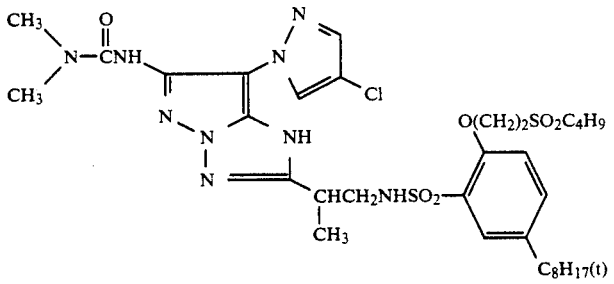
(M-30)
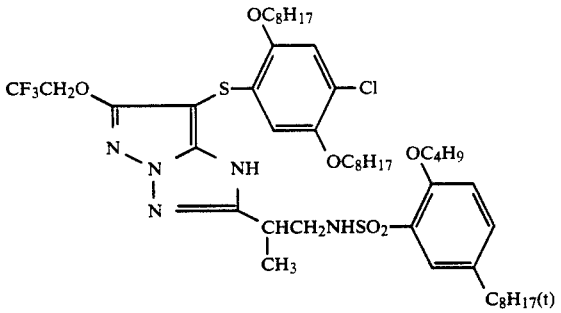
(M-31)
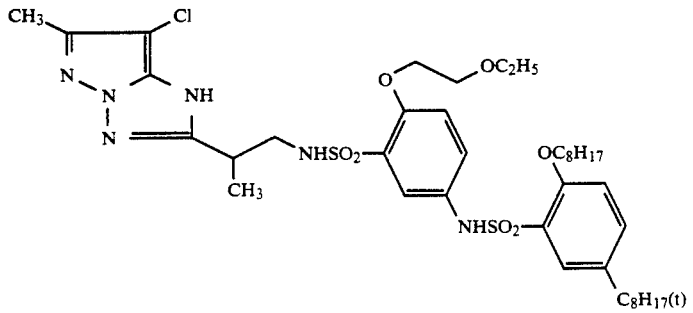

-continued
(M-32)
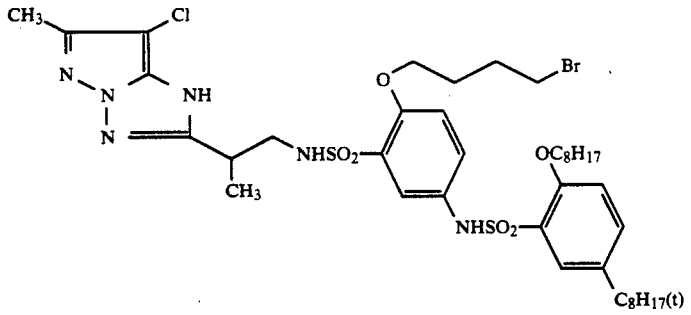
(M-33)
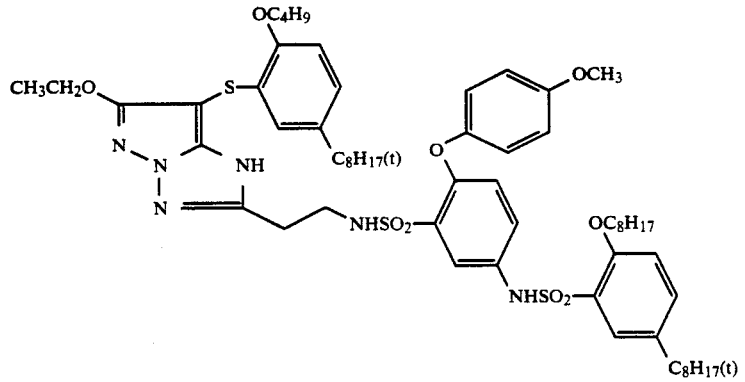
(M-34)
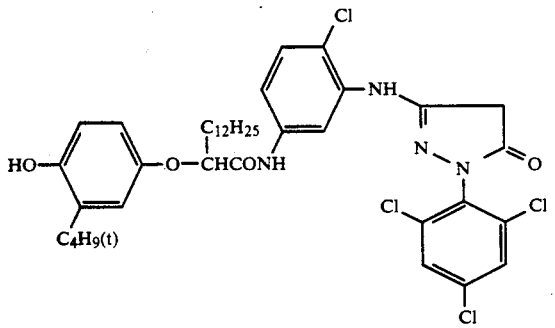
(M-35)
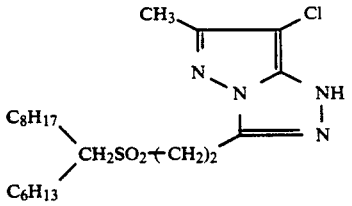
(M-36)
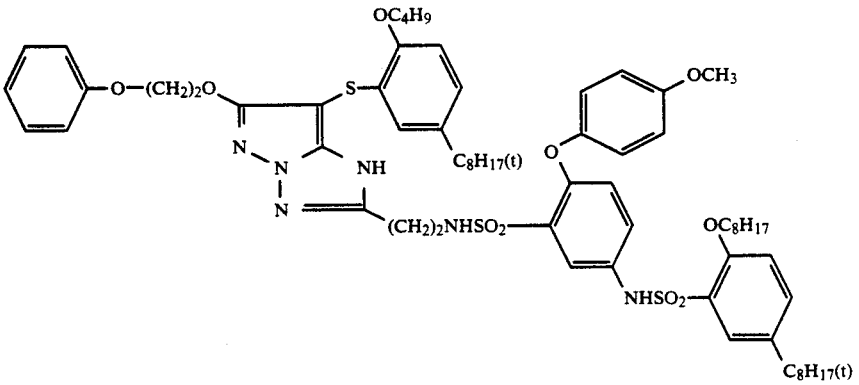

-continued
(M-37)
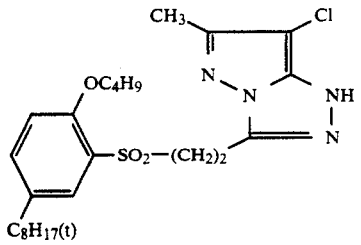
(M-38)
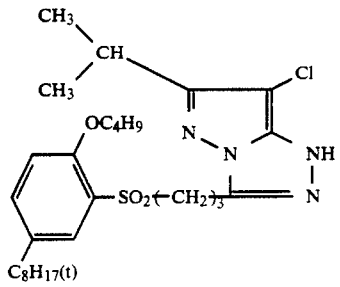
(M-39)
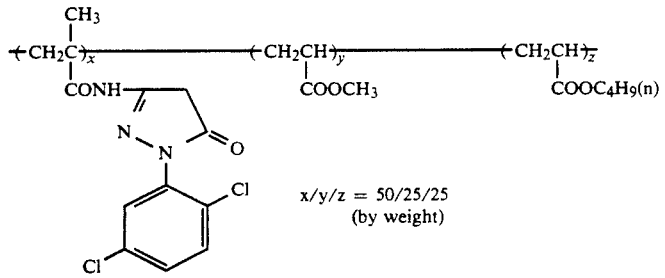
x/y/z = 50/25/25
(by weight)
(M-40)
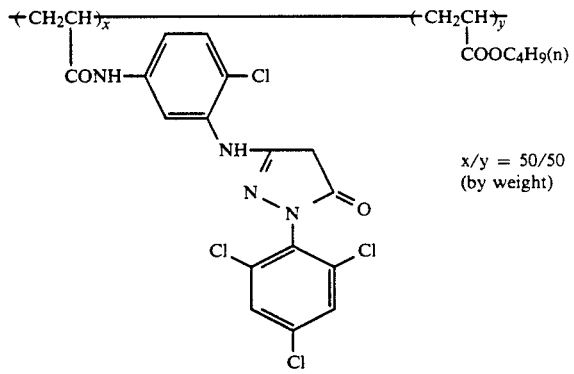
x/y = 50/50
(by weight)
(M-41)
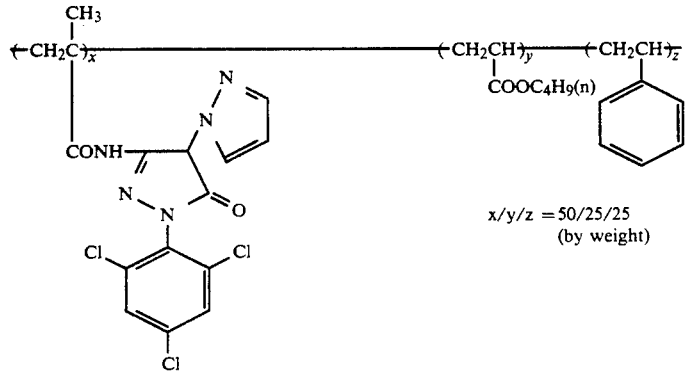
x/y/z = 50/25/25
(by weight)

-continued
(M-42)
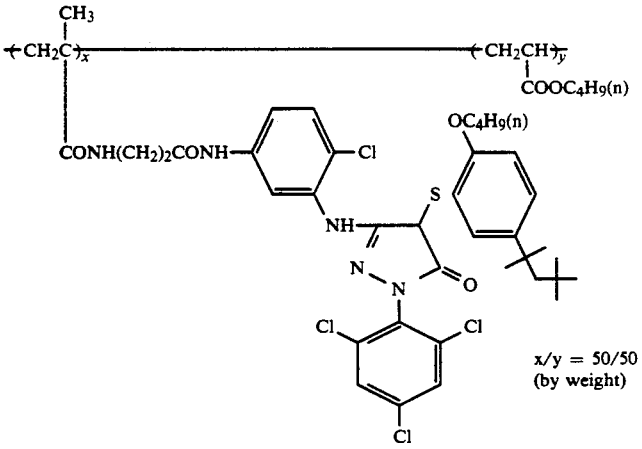
x/y = 50/50
(by weight)
(M-43)
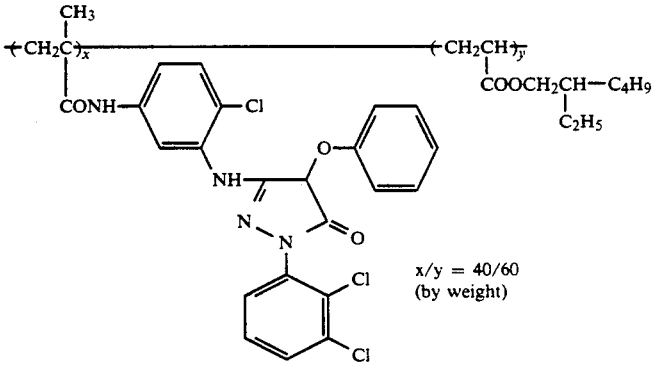
x/y = 40/60
(by weight)
(M-44)
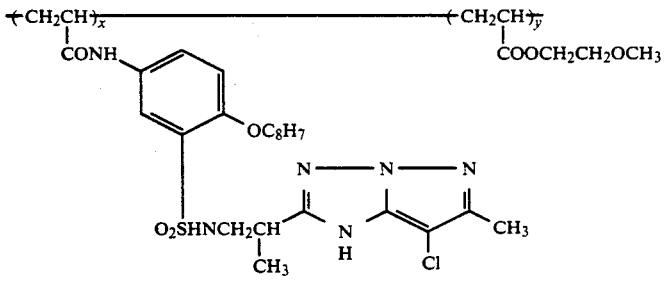
x/y = 45/55
(by weight)
(M-45)
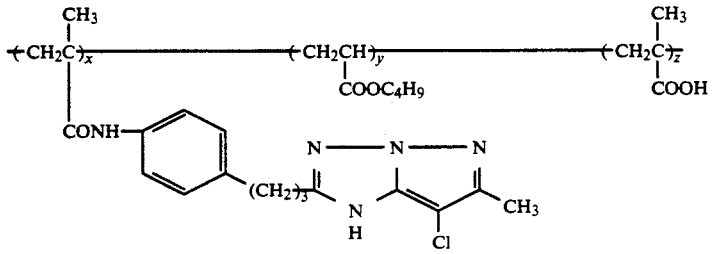
x/y/z = 50/45/5
(by weight)

-continued
(M-46)
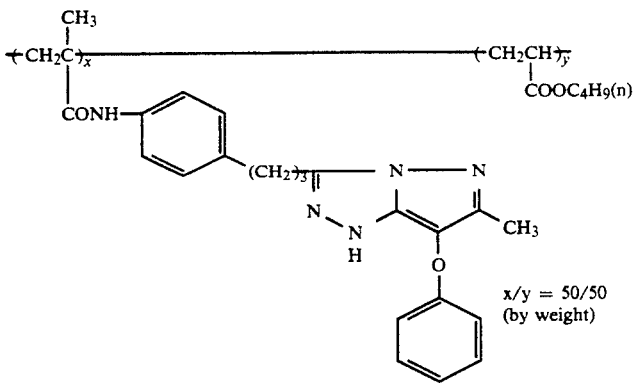
x/y = 50/50
(by weight)
(M-47)
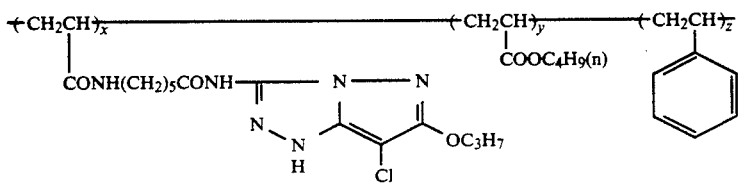
x/y/z = 45/50/5
(by weight)
(M-48)
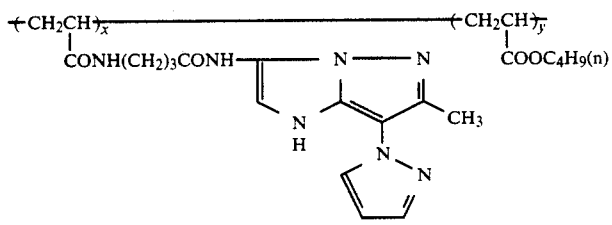
x/y = 50/50
(by weight)
(M-49)
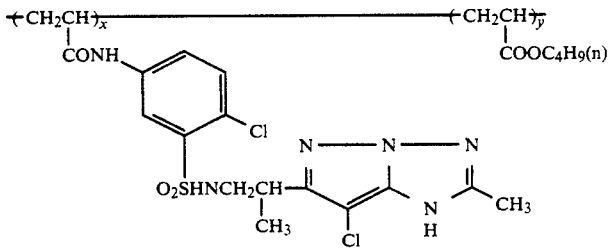
x/y = 50/50
(by weight)
(M-50)
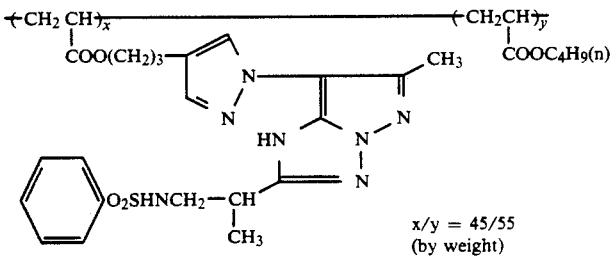
x/y = 45/55
(by weight)
Preferred specific examples of the yellow couplers represented by the general formula (Y) are illustrated below, but the present invention should not be construed as being limited thereto.

(Y-1)
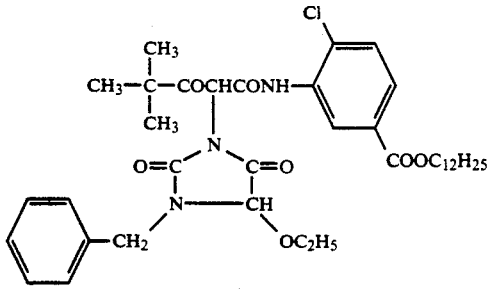
(Y-2)
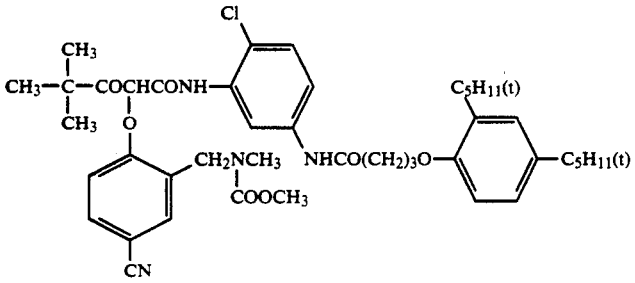
(Y-3)
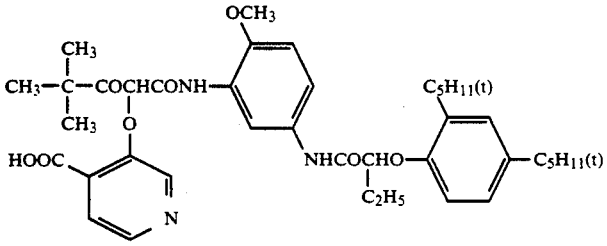
(Y-4)
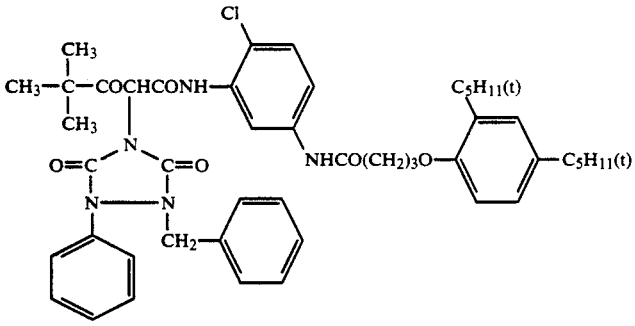
(Y-5)
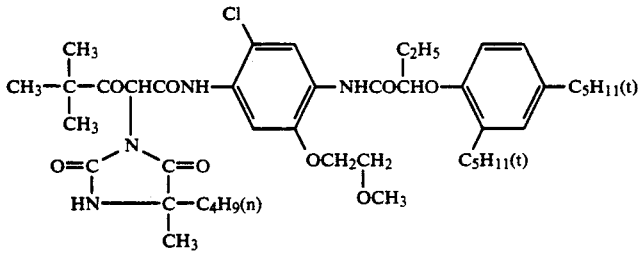
(Y-6)
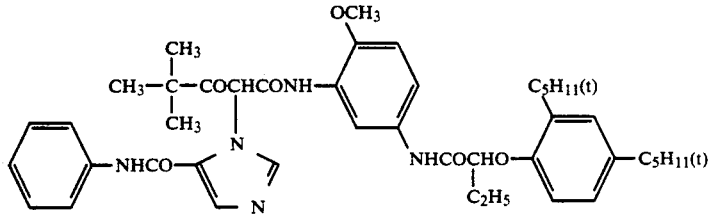

-continued
(Y-7)
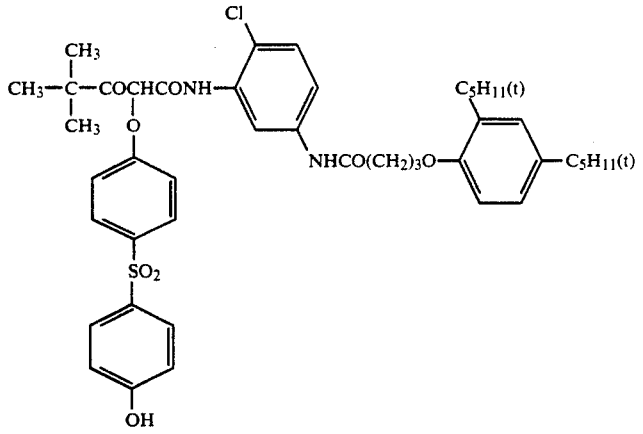
(Y-8)
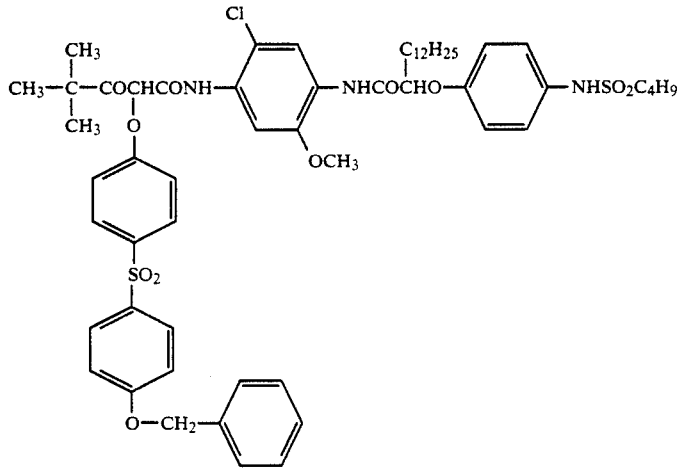
(Y-9)
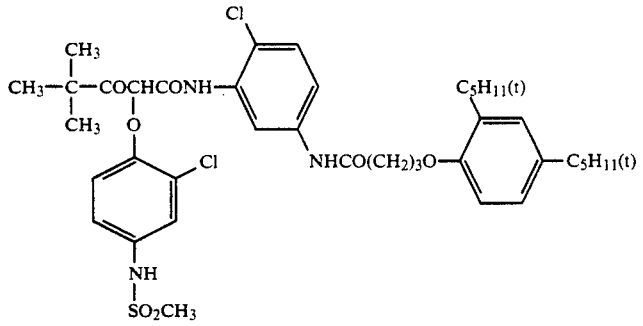
(Y-10)
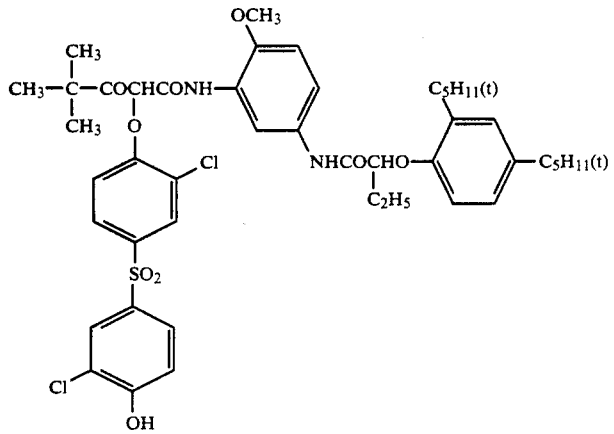

-continued
(Y-11)
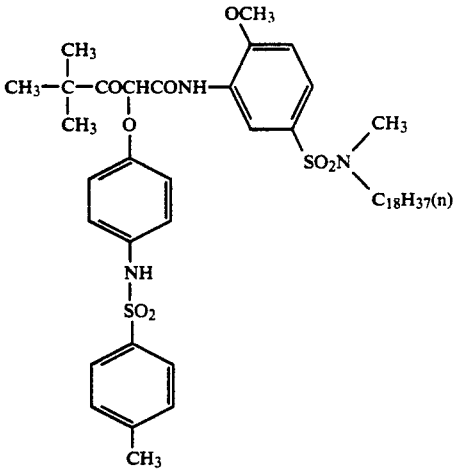
(Y-12)
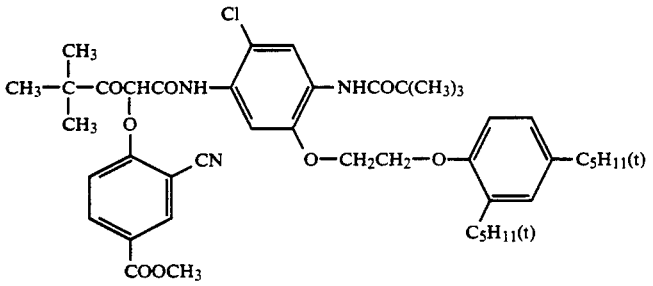
(Y-13)
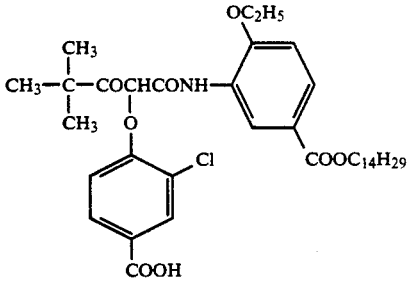
(Y-14)
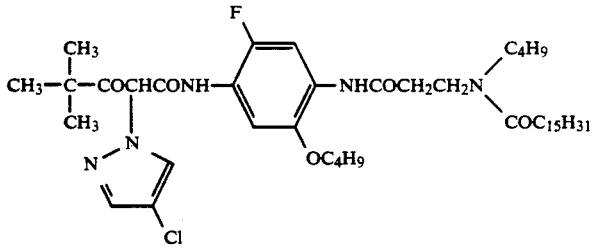
(Y-15)
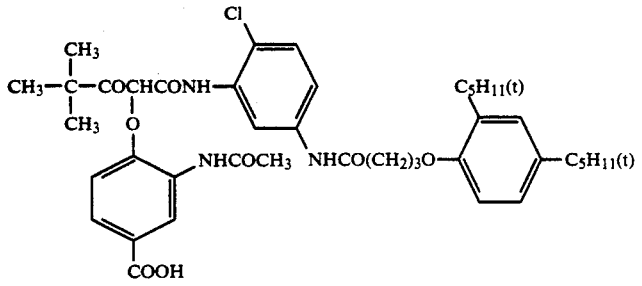

-continued
(Y-16)
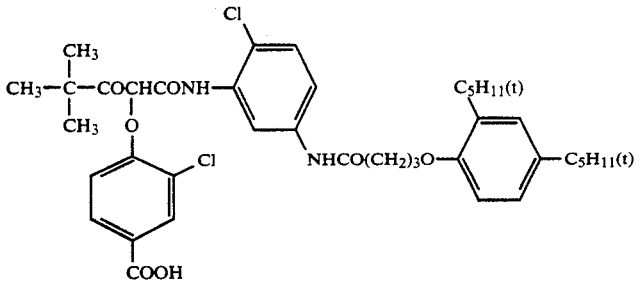
(Y-17)
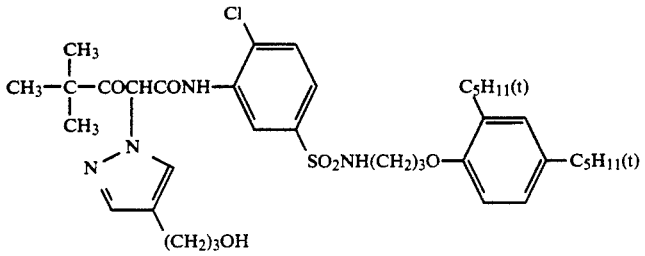
(Y-18)
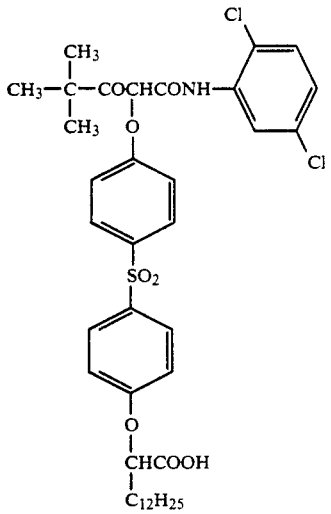
(Y-19)
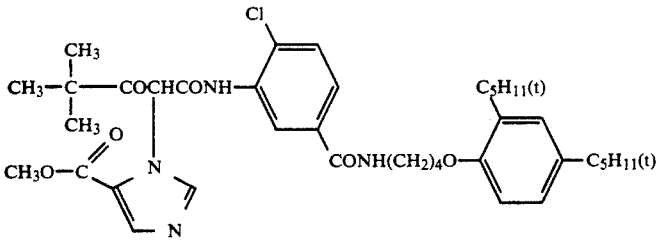
(Y-20)
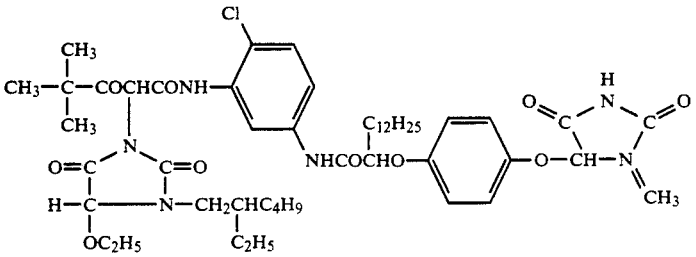

-continued
(Y-21)
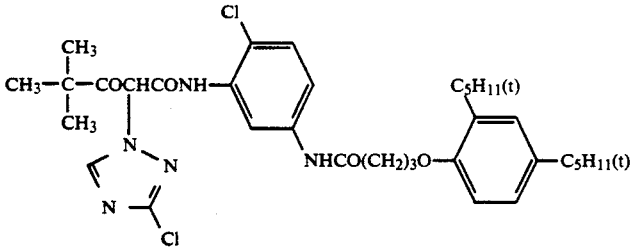
(Y-22)
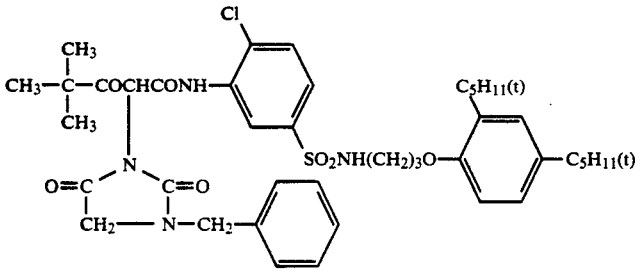
(Y-23)
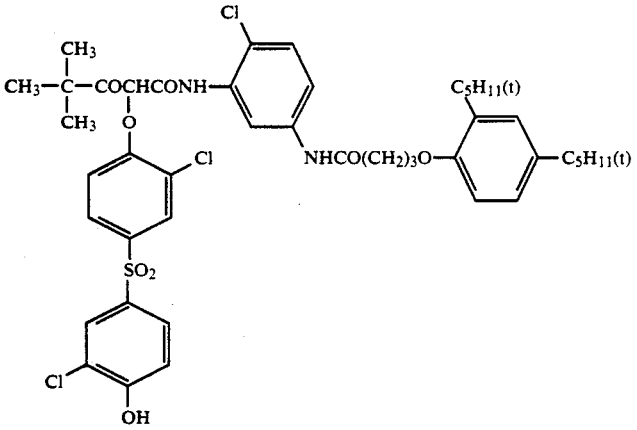
(Y-24)
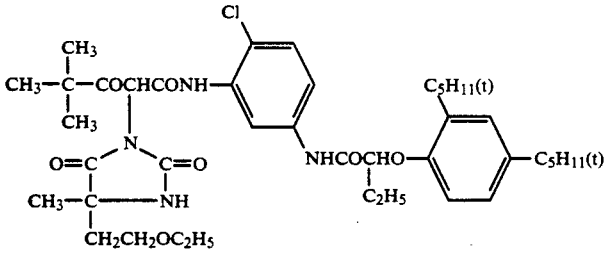
(Y-25)
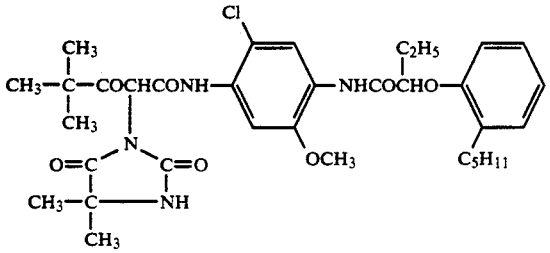

-continued
(Y-26)
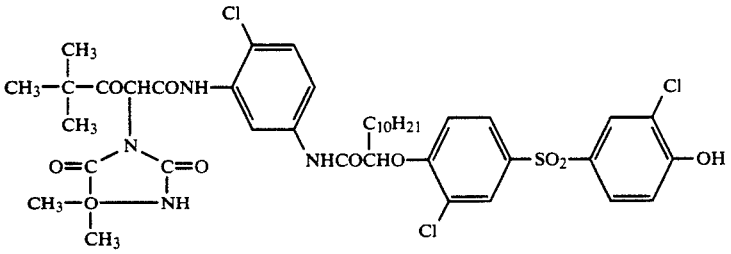
(Y-27)
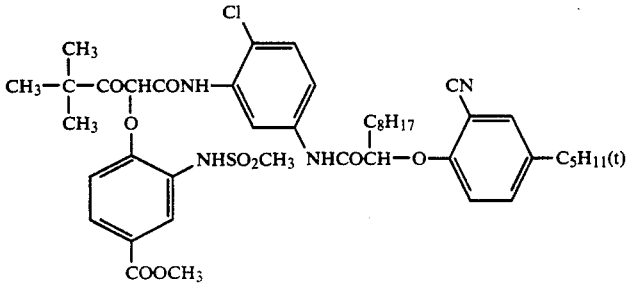
(Y-28)
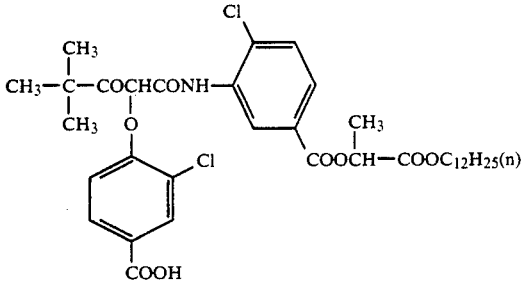
(Y-29)
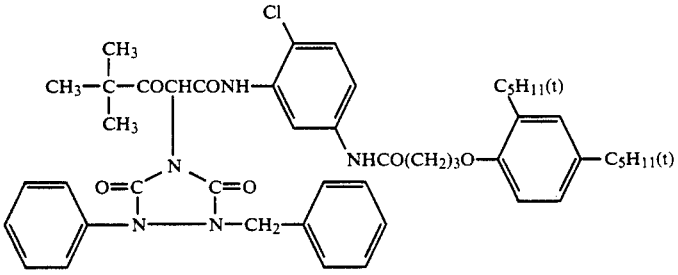
(Y-30)
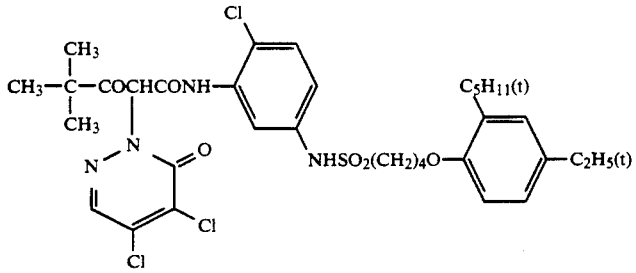
(Y-31)
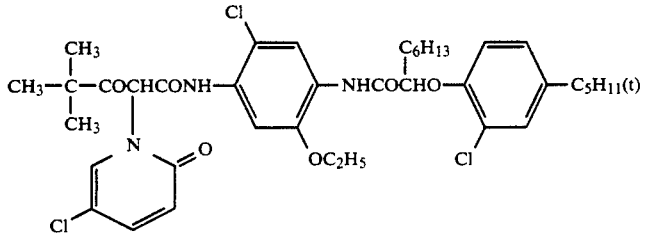

-continued
(Y-32)
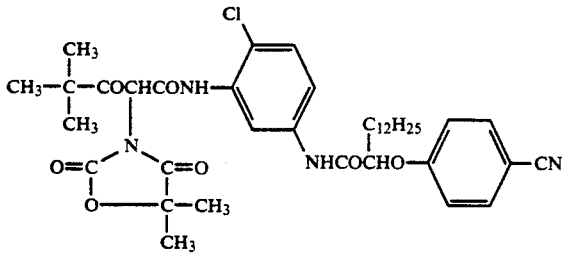
(Y-33)
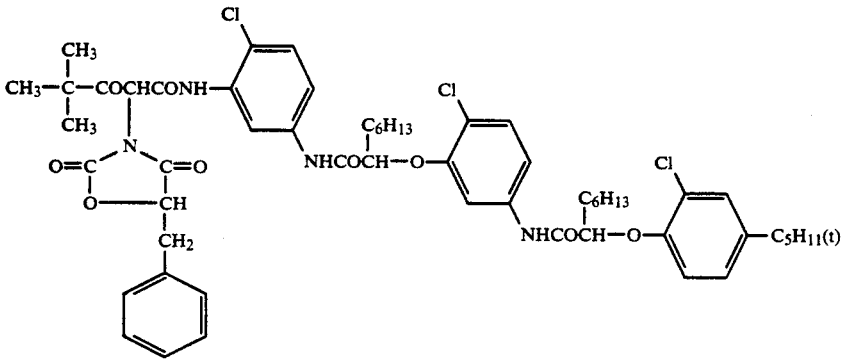
(Y-34)
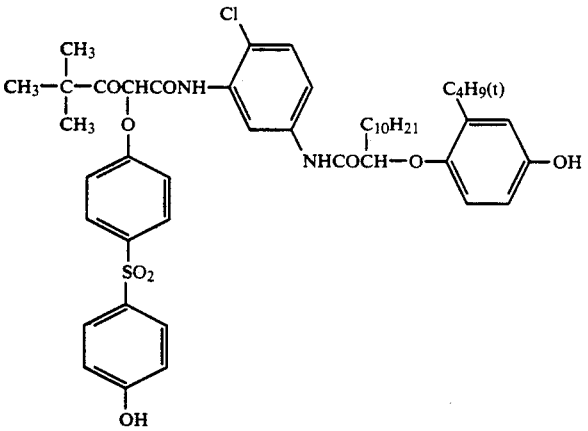
(Y-35)
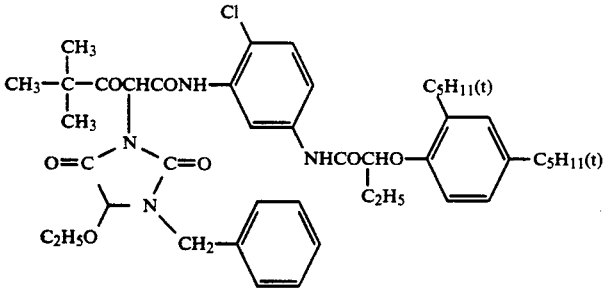
(Y-36)
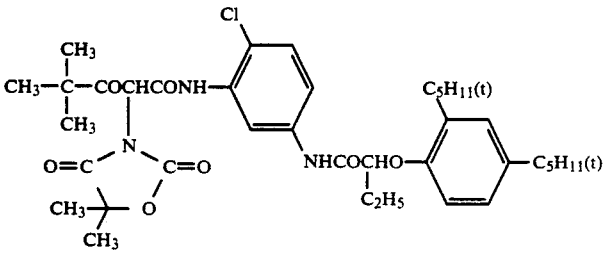

-continued
(Y-37)
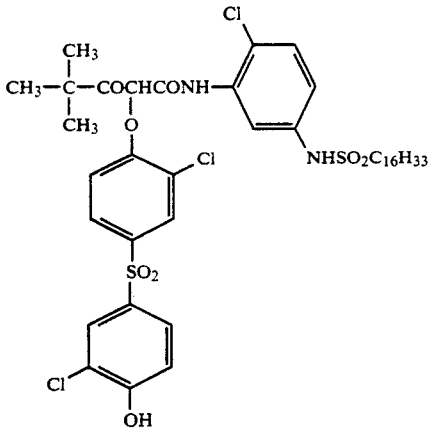
(Y-38)
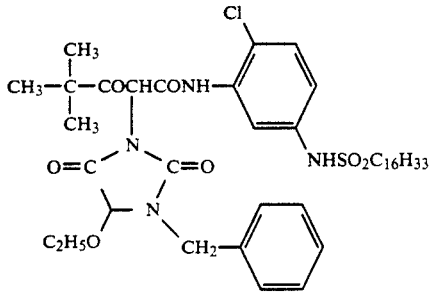
(Y-39)
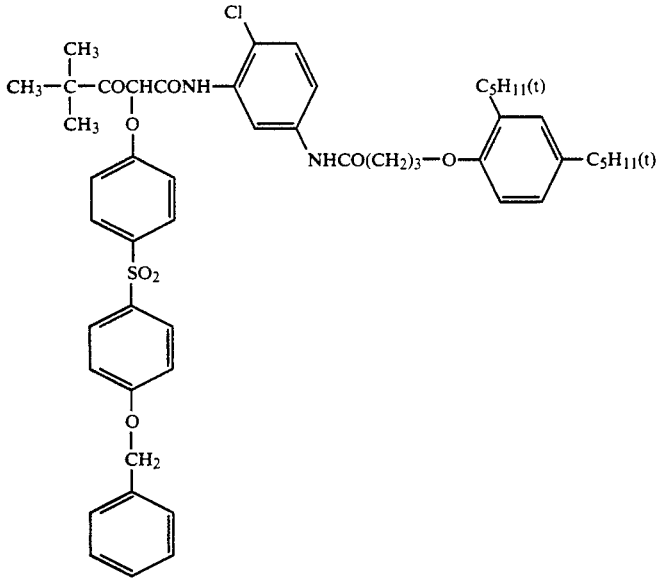
(Y-40)
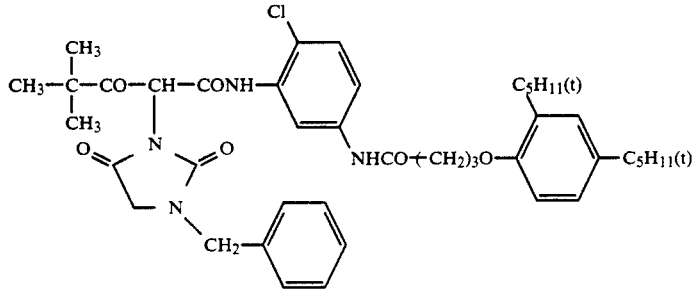

-continued
(Y-41)
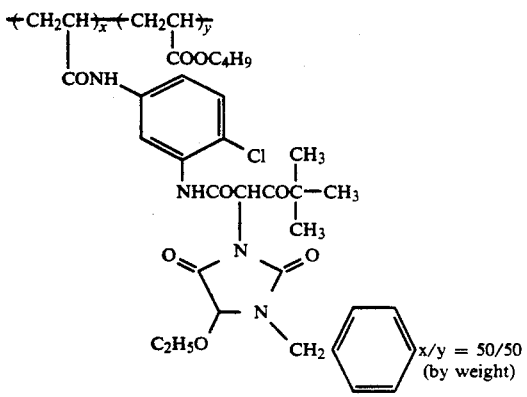
(Y-42)
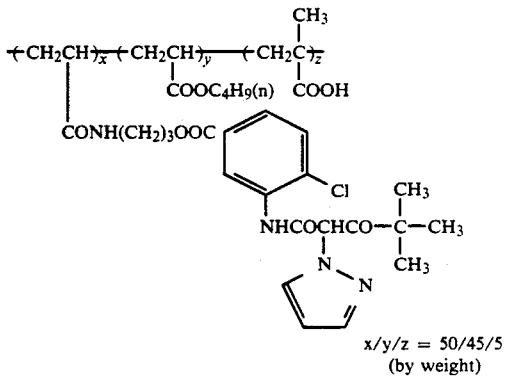
(Y-43)
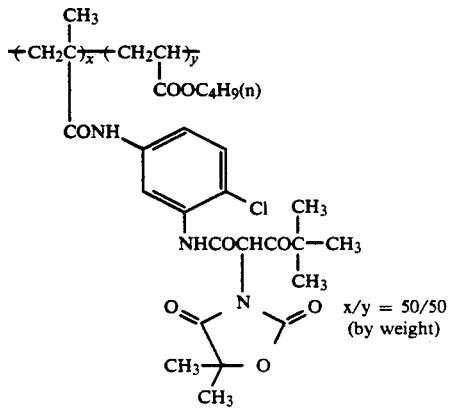

-continued (Y-44)

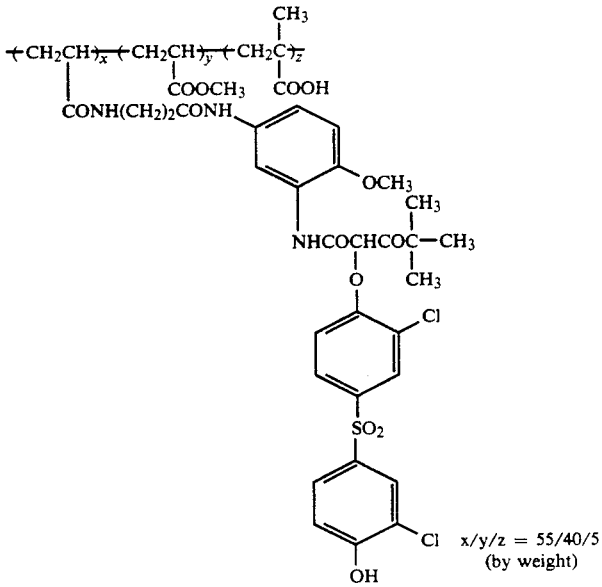

(Y-45)

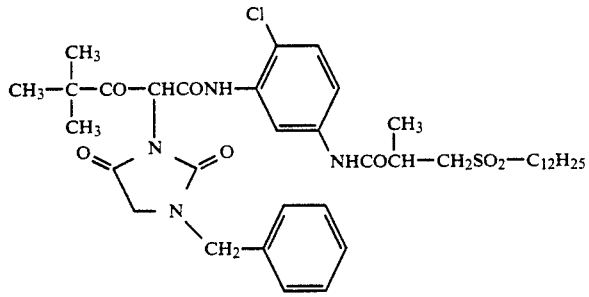

Examples of the couplers represented by the general formulae (C-I) to (Y) described above and others and synthesizing methods for them are described in the literature shown below.

The cyan couplers represented by the general formula (C-I) or (C-II) can be synthesized by the following known methods. For example, the cyan couplers represented by the general formula (C-I) can be synthesized by the methods as described in U.S. Pat. Nos. 2,423,730 and 3,772,002, etc., and the cyan couplers represented by the general formula (C-II) can be synthesized by the methods as described in U.S. Pat. Nos. 2,895,826, 4,333,999 and 4,327,173, etc.

The magenta couplers represented by the general formula (M-I) can be synthesized by the methods as described in Japanese Patent Application (OPI) Nos. 74027/74 and 74028/74, Japanese Patent Publication Nos. 27930/73 and 33846/78, U.S. Pat. No. 3,519,429, etc. Also the magenta couplers represented by the general formula (M-II) can be synthesized by the methods as described in U.S. Pat. No. 3,725,067 and Japanese Patent Application (OPI) Nos. 162548/74, 171956/74 and 33552/85, etc.

The yellow couplers represented by the general formula (Y) can be synthesized by the methods as described in Japanese Patent Application (OPI) No. 48541/79, Japanese Publication No. 10739/83, U.S. Pat. No. 4,326,024, *Research Disclosure*, No. 18053, etc.

Each of these couplers is generally incorporated into a silver halide emulsion layer in an amount of from $2\times10^{-3}$ mol to $5\times10^{-1}$ mol, and preferably from $1\times10^{-2}$ mol to $5\times10^{-1}$ mol per mol of silver in the layer.

The compounds according to the present invention preferably are employed in combination with the coupler represented by the general formula (C I), (C-II), (M-I) or (M-II), more particularly with the magenta coupler represented by the general formula (M-I) or (M-II) in order to achieve the effects of the present invention.

In the case of employing the magenta coupler represented by the general formula (M-II) wherein $Z_a$ represents —N=, $Z_b$ represents a substituted methine group and $Y_4$ represents a chlorine atom in combination with the compound represented by the general formula (I-c) wherein $Z_1$ represents an atomic group necessary to form a 2-pyrazoline ring, the effect of improving lightfastness of magenta dye is relatively small in comparison with cases using other compounds of the general formula (I-C).

When the color photographic material according to the present invention contains dye(s) and ultraviolet light absorbing agent(s) in the hydrophilic colloid layer(s) thereof, these additives may be mordanted by a cationic polymer, etc.

The color photographic material according to the present invention may further contain a hydroquinone derivative, an aminophenol derivative, a gallic acid derivative, an ascorbic acid derivative, etc., as a color fog preventing agent.

The color photographic material according to the present invention may contain ultraviolet light absorbing agent(s) in the hydrophilic colloid layer as described above. Examples of the ultraviolet light absorbing agents include aryl group-substituted benzotriazole compounds (e.g., those as described in U.S. Pat. No. 3,533,794), 4-thiazolidone compounds (e.g., those as described in U.S. Pat. Nos. 3,314,794 and 3,352,681), benzophenone compounds (e.g., those as described in Japanese Patent Application (OPI) No. 2784/71), cinnamic acid ester compounds (e.g., those as described in U.S. Pat. Nos. 3,705,805 and 3,707,375), butadiene compounds (e.g., those as described in U.S. Pat. No. 4,045,229), and bisphenol derivatives (e.g., those as described in U.S. Pat. No. 3,700,455). Furthermore, ultraviolet light absorptive couplers (e.g., α-naphtholic cyan dye forming couplers) or ultraviolet light absorptive polymers may be used as ultraviolet light absorbing agents. These ultraviolet light absorbing agents may be mordanted in a specific layer.

The color photographic material according to the present invention may contain water-soluble dyes as filter dyes or for irradiation prevention or other various purposes in the hydrophilic colloid layers. Examples of such water-soluble dyes include oxonol dyes, hemioxonol dyes, styryl dyes, merocyanine dyes, cyanine dyes, and azo dyes. In these dyes, oxonol dyes, hemioxonol dyes, and merocyanine dyes are useful.

As the binder or protective colloids which can be used for the emulsion layers of the color photographic material according to the present invention, gelatin is advantageously used but other hydrophilic colloids can be used alone or together with gelatin.

As gelatin, lime-treated gelatin or acid-treated gelatin can be used in the present invention. Details of the production of gelatin are described in Arther Weiss, *The Macromolecular Chemistry of Gelatin*, published by Academic Press, 1964.

For the silver halide emulsion layers of the color photographic material according to the present invention, any of silver bromide, silver iodobromide, silver iodochlorobromide, silver chlorobromide, and silver chloride is used as the silver halide.

There is no particular restriction on the average grain size (the grain size being defined as the diameter of the grains when the grain has a spherical or a nearly spherical form and as the length of the edge when the grain has a cubic form, and being averaged based on the projected area of the grains) of the silver halide grians in the photographic emulsions but it is preferred that the grain size be not more than 2 μm.

The grain size distribution may be narrow or broad, but a monodispersed silver halide emulsion having a coefficient of variation of not more than 15% is preferred.

The silver halide grains in the photographic emulsion layers may have a regular crystal form such as cubic, octahedral, etc., or an irregular crystal form such as spherical, tabular, etc., or may have a composite form of these crystal forms. Also, a mixture of grains having various crystal forms may be used. Of these emulsions, the use of a photographic emulsion of regular crystal form is preferred.

Further, a silver halide emulsion wherein tabular silver halide grains having a diameter/thickness ratio of at least 5 accounts for at least 50% of the total projected area of the silver halide grains may be used in the present invention.

The silver halide grains used in the present invention may have a composition or structure inside the grain which is different from that on the surface layer thereof. Also, the silver halide grains may be of the type that latent images are formed mainly on the surface thereof or of the type that latent images are formed mainly in the interior thereof.

During the formation or physical ripening of the silver halide grains, a cadmium salt, a zinc salt, a thallium salt, a lead salt, an iridium salt or a complex salt thereof, a rhodium salt or a complex salt thereof, an iron salt or a complex salt thereof, etc., may exist in the system.

Silver halide emulsions are usually chemically sensitized.

The silver halide emulsions used in the present invention can further contain various kinds of compounds for preventing the occurrence of fog or for stabilizing photographic performance during the production, storage and/or photographic processing of color photographic materials. Examples of such compounds include the compounds known as antifoggants or stabilizers such as azoles (e.g., benzothiazolium salts, nitroimidazoles, nitrobenzimidazoles, chlorobenzimidazoles, bromobenzimidazoles, mercaptothiazoles, mercaptobenzothiazoles, mercaptobenzimidzoles, mercaptothiadiazoles, aminotriazoles, benzotriazoles, nitrobenzotriazoles, mercaptotetrazoles (in particular, 1-phenyl-5-mercaptotetrazole, etc.), mercaptopyrimidines, mercaptotriazines, etc.; thioketo compounds such as oxazolinethione, etc.; azaindenes (e.g., triazaindenes, tetraazaindenes, in particular, 4-hydroxy-substituted (1,3,3a,7)tetraazaindene), pentaazaindenes, etc.; benzenethiosulfonic acid, benzenesulfinic acid, benzenesulfonic acid amide, etc.

The present invention can be applied to multilayer multicolor photographic materials having at least two photographic emulsion layers each having different spectral sensitivity on a support. A multilayer natural color photographic material usually has at least one red-sensitive emulsion layer, at least one green-sensitive emulsion layer and at least one blue-sensitive emulsion layer on a support. The disposition order of these photographic emulsion layers can be optionally selected according to the purpose for which the photographic material is used. Usually, a red-sensitive emulsion layer contains a cyan-forming coupler, a green-sensitive emulsion layer contains a magenta-forming coupler, and a blue-sensitive emulsion layer contains a yellow-forming coupler. Other combinations may be used, if desired.

As the support used in the present invention, there are those conventionally employed in photographic light-sensitive materials, for example, cellulose nitrate films, cellulose acetate films, cellulose acetate butyrate films, cellulose acetate propionate films, polystyrene films, polyethylene terephthalate films, polycarbonate films, laminates of these films, thin glass films, papers, etc. Paper coated with baryta or an α-olefin polymer, in particular, a polymer of an o-olefin having 2 to 10 carbon atoms, such as polyethylene, polypropylene, ethylenebutene copolymer, etc., and a support such as a plastic film, etc., having a roughened surface for improving the adhesion with other polymers as described in Japanese Patent Publication No. 19068/72 give good results. Also, a resin hardenable by the irradiation of ultraviolet rays can be used.

According to the purpose of the color photographic material, a transparent support or an opaque support may be used. Also, a colored transparent support containing dyes or pigments can also be used.

As an opaque support used in the present invention, there are papers which are opaque by themselves and transparent films which were opacified by the incorporation of dyes or pigments such as titanium oxide, etc. Also, a plastic film surface-treated by the method as described in Japanese Patent Publication No. 19068/72 and further papers or plastic films rendered completely light shielding by the addition of carbon black, dyes, etc., can be used.

A subbing layer is usually provided on the support. Furthermore, for improving the adhesive property, a pretreatment such as corona discharging treatment, ultraviolet irradiation treatment, flame treatment, etc., may be applied to the surface of the support.

As a color photographic light-sensitive material which can be used for making the color photograph according to the present invention, an ordinary color photographic light-sensitive material, in particular, a color photographic light-sensitive material for color print is preferred, and color photographic light-sensitive materials of color photographic systems (in particular, color diffusion transfer photographic systems) as described in U.S. Pat. Nos. 3,227,550, 3,227,551 and 3,227,552, and U.S. Preliminary Published Patent B351,673, etc., may be used.

For obtaining dye images by a conventional photographic process, it is necessary to apply color photographic development processing after imagewise exposure. Color photographic development processing fundamentally includes the steps of color development, bleaching and fixing. In this case, two steps of bleaching and fixing may be performed by one step (bleach-fixing).

Furthermore, a combination of color development, first fixing, and bleach-fixing can be employed in the present invention. The color development processing step may include, if necessary, various steps of prehardening, neutralization, first development (black-and-white development), image stabilization, washing with water, etc. The processing temperature is generally 18° C. or more, and preferably in the range from 20° C. to 60° C. In particular, recently the range of from 30° C. to 60° C. is used.

A color developing solution is an aqueous alkaline solution containing an aromatic primary amine color developing agent and having a pH of at least 8, preferably from 9 to 12.

After the fixing or bleach-fixing step, a water washing process is usually performed, but a simple so-called "stabilization process" may be substituted in place of the water washing process substantially without employing a water washing step.

Preferred examples of the aromatic primary amine color developing agent are p-phenylenediamine derivatives and specific examples thereof are described below, although the invention should not be construed as being limited to them.

D-1: N,N-Diethyl-p-phenylenediamine
D-2: 2-Amino-5-diethylaminotoluene
D-3: 2-Amino-5-(N-ethyl-N-laurylamino)toluene
D-4: 4-(N-ethyl-N-(8-hydroxyethyl)amino)aniline
D-5: 2-Methyl-4-[4-N-ethyl-N-(β-hydroxyethyl-)amino]aniline
D-6: N-Ethyl-N-(β-methanesulfonamidoethyl)-3-methyl-4-aminoaniline
D-7: N-(2-Amino-5-diethylaminophenylethyl)methanesulfonamide
D-8: N,N-Dimethyl-p-phenylenediamine
D-9: 4-Amino-3-methyl-N-ethyl-N-methoxyethylaniline
D-10: 4-Amino-3-ethyl-N-ethyl-N-β-ethoxyethylaniline
D-11: 4-Amino-3-methyl-N-ethyl-N-β-butoxyethylaniline Also, these p-phenylenediamine derivatives may be in the form of salts thereof, such as sulfates, hydrochlorides, sulfites, p-toluenesulfonates, etc. The above described compounds are described, for example, in U.S. Pat. Nos. 2,193,015, 2,552,241, 2,566,271, 2,592,364, 3,656,950 and 3,698,525, etc. The amount of the aromatic primary amine color developing agent is from about 0.1 g to about 20 g, and preferably from about 0.5 g to about 10 g per liter of color developing solution.

The color developing solution used in the present invention may contain hydroxylamines as conventionally known.

The processing temperature of the color developing solution is preferably from 30° C. to 50° C., and more preferably from 33° C. to 42° C. Also, the amount of a replenisher for the color developing solution is from 30 ml to 2,000 ml, and preferably from 30 ml to 1,500 ml per square meter of color photographic material. The amount of the replenisher is, however, preferably as low as possible from the viewpoint of reducing the amount of waste liquid.

Also, when benzyl alcohol exists in the color developing solution, the amount thereof is preferably not more than 2.0 ml/liter, and more preferably not more than 0.5 ml/liter. A color developing solution containing no benzyl alcohol is most preferred. The time for color development is preferably within 2 minutes and 30 seconds, more preferably from 10 seconds to 2 minutes and 30 seconds, and most preferably from 45 seconds to 2 minutes.

The compounds of (1) and (2) may be applied to a silver halide color photographic material after imagewise exposure. The application can be conducted by incorporating the compounds into at least one of color photographic processing solutions such as a developing solution, a bleaching solution, a fixing solution, a blixing solution, water for washing or water specifically provided for applying the compounds to the photographic material, or a stabilizing solution. It is also possible to incorporate these compounds separately into two or more solution.

The compounds are preferably contained in a developing solution. It is also possible to apply the compounds after developing process using an aqueous solution containing the compounds.

Each concentration of the compounds (1) and (2) in the processing solution is preferably from $1\times10^{-5}$ to 1 mol/l, and the molar ratio of the concentration of the compound (1) to that of compound (2) is from 0.1 to 10.

In accordance with the present invention color photographs excellent in fastness of color images are obtained. In particular, by the use of the color photographic light-sensitive material according to the present invention, color photographs are obtained in which, the three color balance of a yellow dye, a magenta dye and a cyan dye is maintained and the coloration of white background is exceptionally low even when they are preserved for a long period of time.

The present invention will be described in more detail with reference to the following examples, but the present invention should not be construed as being limited thereto.

EXAMPLE 1

13.0 g of Cyan Coupler (C-1) was dissolved in a mixture of 10.4 ml of dibutyl phthalate and 30 ml of ethyl acetate and the resulting solution was added to 100 g of an aqueous solution containing 10 g of gelatin and 1 g of sodium dodecylbenzenesulfonate to prepare a finely emulsified dispersion. The total amount of the emulsified dispersion was added to 100 g of a silver chlorobromide emulsion (containing 50 mol % of silver bromide and 6.5 g of silver) and thereto 10 ml of a 2% aqueous solution of 2,4-dihydroxy-6-chloro-s-triazine sodium salt was added just before coating as a hardener. The resulting mixture was coated on a paper support, both surfaces of which were laminated with polyethylene at a silver coating amount of 250 mg/m$^2$. On the layer thus-coated was provided a gelatin layer to prepare a sample, which was designated as Sample A.

Further, in the same manner as described above, other samples were prepared using the combinations as shown in Table 1 below. The additives were dissolved into the solutions containing the coupler and then the solutions thus obtained were incorporated into the silver halide emulsion.

These samples were subjected to wedge exposure of 1,000 C.M.S., and then processed according to the processing steps described below.

| Processing Step | Temperature | Time |
|---|---|---|
| Color Development | 33° C. | 3 min. 30 sec. |
| Bleach-Fixing | 33° C. | 1 min. 30 sec. |
| Washing with Water | 28-35° C. | 3 min. |

The processing solutions used in each step had the following compositions.

| | |
|---|---|
| Color Developing Solution: | |
| Benzyl Alcohol | 15 ml |
| Diethylenetriamine pentaacetic acid | 5 g |
| KBr | 0.4 g |
| $Na_2SO_3$ | 5 g |
| $Na_2CO_3$ | 30 g |
| Hydroxylamine sulfate | 2 g |
| 4-Amino-3-methyl-N-β-(methanesulfonamido)-ethylaniline·3/2 $H_2SO_4.H_2O$ | 4.5 g |
| Water to make | 1,000 ml |
| | pH 10.1 |
| Bleach-fixing Solution: | |
| Ammonium thiosulfate (70 wt %) | 150 ml |
| $Na_2SO_3$ | 5 g |
| Na[Fe(EDTA)] | 40 g |
| EDTA | 4 g |
| Water to make | 1,000 ml |
| | pH 6.8 |

The photographic characteristic (dye image density) of each sample having a dye image thus-formed was measured. Then, each sample was subjected to a fading test for 7 days by means of a xenon tester (200,000 lux) using an ultraviolet ray absorption filter to cut out light of wavelengths shorter than 400 nm (made by Fuji Photo Film Co., Ltd.). The measurement of density was conducted using a Fuji self-recording type densitometer, and fading was determined by means of a change in density at the area having an initial density ($D_0$) of 1.5 before the fading test.

Further, each sample was stored under a high temperature condition of 100° C. for 7 days to measure fading of color image due to heat. The results thus-obtained are shown in Table 1 below.

TABLE 1

| Sample | Coupler | Additive | Amount of Additive (mol % to Coupler) | Light-Fastness Test* Xenon, 7 Days $D_0$ = 1.5 (%) | Heat-Fastness Test* 100° C., 7 Days $D_0$ = 1.5 (%) | Remark |
|---|---|---|---|---|---|---|
| A | C-1 | — | — | 78 | 61 | Comparison |
| A-1 | " | I-28 | 20 | 78 | 62 | " |
| A-2 | " | I-36 | " | 79 | 61 | " |
| A-3 | " | I-49 | " | 79 | 62 | " |
| A-4 | " | II-1 | " | 80 | 62 | " |
| A-5 | " | III-26 | " | 78 | 63 | " |
| A-6 | " | III-45 | " | 79 | 61 | " |
| A-7 | " | A-1 | " | 81 | 63 | " |
| A-8 | " | A-30 | " | 82 | 65 | " |
| A-9 | " | A-48 | " | 82 | 66 | " |
| A-10 | " | A-63 | " | 79 | 63 | " |
| A-11 | " | A-90 | " | 83 | 67 | " |
| A-12 | " | A-100 | " | 78 | 62 | " |
| A-13 | " | I-28/A-1 | 20/20 | 88 | 85 | Invention |
| A-14 | " | I-36/A-30 | " | 90 | 87 | " |
| A-15 | " | I-49/A-90 | " | 91 | 88 | " |
| A-16 | " | III-26/A-30 | " | 89 | 87 | " |
| A-17 | C-1 | III-45/A-100 | 20/20 | 89 | 87 | Invention |
| A-18 | C-2 | — | — | 77 | 76 | Comparison |
| A-19 | " | A-22/A-41 | 20/20 | 78 | 80 | " |
| A-20 | " | A-36/A-56 | " | 77 | 79 | " |
| A-21 | " | I-4/I-49 | " | 80 | 77 | " |
| A-22 | " | I-36/II-1 | " | 79 | 76 | " |
| A-23 | " | I-45/III-1 | " | 78 | 77 | " |
| A-24 | " | I-41/A-22 | " | 91 | 93 | Invention |
| A-25 | " | I-47/A-40 | " | 91 | 94 | " |
| A-26 | " | I-49/A-30 | " | 93 | 94 | " |
| A-27 | " | I-38/A-90 | " | 94 | 95 | " |
| A-28 | " | II-1/A-61 | " | 92 | 91 | " |
| A-29 | " | III-1/A-56 | " | 93 | 93 | " |

*The percentage of the remaining dye after the fading test at the area having an initial density $D_0$ = 1.5 to the amount. (The same hereinafter.)

EXAMPLE 2

In the same manner as described in Example 1, except using 100 g of a pure silver chloride emulsion (containing 6.5 g of silver) in place of the silver chlorobromide emulsion used in Example 1, samples having the combinations as shown in Table 2 below were prepared.

These samples were subjected to wedge exposure of 3,000 C.M.S., and then processed according to the processing steps described below.

| Processing Step | Time | Temperature |
|---|---|---|
| Color Development | 45 sec. | 35° C. |
| Bleach-Fixing | 45 sec. | 35° C. |
| Washing with Water | 60 sec. | 35° C. |

The processing solutions used in each step had the following compositions.

| | |
|---|---|
| Color Developing Solution: | |
| Water | 800 ml |
| Diethylenetriaminepentaacetic acid | 3.0 g |
| Potassium bromide | 0.3 g |
| Potassium carbonate | 30 g |
| N-Ethyl-N-(β-methanesulfonamidoethyl)-3-methyl-4-aminoaniline sulfate | 5.5 g |
| Sodium sulfite | 1.7 g |
| Hydroxylamine sulfate | 3.0 g |
| Fluorescent whitening agent (4,4'-diaminostilbene type) | 1.0 g |
| Water to make | 1000 ml |
| pH adjusted to 10.20 with potassium hydroxide | |
| Bleach-Fixing Solution: | |

-continued

| |
|---|
| Same as in Example 1 |

After the measurement of photographic characteristic of the color image thus-obtained, the same light fastness test and heat fastness test as described in Example 1 were performed. The results thus-obtained are shown in Table 2 below.

TABLE 2

| Sample | Coupler | Additive | Amount of Additive (mol % to Coupler) | Light-Fastness Test* Xenon, 7 Days $D_0 = 1.5$ (%) | Heat-Fastness Test* 100° C., 7 Days $D_0 = 1.5$ (%) | Remark |
|---|---|---|---|---|---|---|
| B | C-34 | — | — | 79 | 66 | Comparison |
| B-1 | " | I-49 | 20 | 80 | 67 | " |
| B-2 | " | I-49 | 40 | 82 | 69 | " |
| B-3 | " | A-30 | 20 | 83 | 68 | " |
| B-4 | " | A-30 | 40 | 85 | 70 | " |
| B-5 | " | I-16/A-20 | 20/20 | 91 | 84 | Invention |
| B-6 | " | I-41/A-36 | " | 92 | 83 | " |
| B-7 | " | I-49/A-30 | " | 93 | 86 | " |
| B-8 | " | III-34/A-90 | " | 95 | 87 | " |
| B-9 | " | III-58/A-52 | " | 91 | 82 | " |
| B-10 | C-14 | — | — | 61 | 89 | Comparison |
| B-11 | " | I-20 | 20 | 62 | 90 | " |
| B-12 | " | I-140 | " | 61 | 89 | " |
| B-13 | " | I-20/I-42 | 20/20 | 63 | 91 | " |
| B-14 | " | A-140/A-90 | " | 66 | 92 | " |
| B-15 | " | I-20/A-140 | " | 89 | 97 | Invention |
| B-16 | " | I-38/A-30 | " | 93 | 98 | " |
| B-17 | C-14 | I-42/A-36 | 20/20 | 91 | 97 | Invention |
| B-18 | " | III-25/A-90 | " | 94 | 98 | " |
| B-19 | " | III-47/A-11 | " | 92 | 97 | " |
| B-20 | C-18 | — | — | 60 | 89 | Comparison |
| B-21 | " | I-3 | 20 | 61 | 90 | " |
| B-22 | " | I-38 | " | 61 | 89 | " |
| B-23 | " | I-47 | " | 62 | 90 | " |
| B-24 | " | I-49 | " | 61 | 89 | " |
| B-25 | " | A-61 | " | 60 | 90 | " |
| B-26 | " | A-94 | " | 59 | 89 | " |
| B-27 | " | I-38/A-30 | 20/20 | 90 | 97 | Invention |
| B-28 | " | I-47/A-90 | " | 93 | 98 | " |
| B-29 | " | I-49/A-162 | " | 89 | 96 | " |
| B-30 | " | III-1/A-30 | " | 90 | 96 | " |
| B-31 | C-25 | — | — | 83 | 92 | Comparison |
| B-32 | " | I-49/A-90 | 20/20 | 97 | 99 | Invention |
| B-33 | C-25 | III-1/A-48 | 20/20 | 95 | 98 | Invention |
| B-34 | " | III-34/A-62 | " | 96 | 98 | " |

EXAMPLE 3

4.6 g of Magenta Coupler (M-1) was dissolved in a mixture of 4.6 ml of tricresyl phosphate and 15 ml of ethyl acetate and the resulting solution was added to 100 ml of an aqueous solution containing 10 g of gelatin and 1 g of sodium dodecylbenzenesulfonate to prepare mechanically a finely emulsified dispersion. The total amount of the emulsified dispersion was added to 100 g of a silver chlorobromide emulsion (containing 50 mol % of silver bromide and 6.5 g of silver) and thereto 10 ml of a 2% aqueous solution of 2,4-dihydroxy-6-chloro-s-triazine sodium salt was added just before coating as a hardener. The resulting mixture was coated on a paper support, both surfaces of which were laminated with polyethylene at a silver coating amount of 380 mg/m$^2$. On the layer thus-coated was provided a gelatin layer as a protective layer to prepare a sample, which was designated as Sample C.

Further, in the same manner as described above, other samples were prepared using the combinations as shown in Table 3 below. The additives were dissolved into the solutions containing the coupler and then the solutions thus obtained were incorporated into the silver halide emulsion.

These samples thus-prepared were subjected to exposure and development processing in the same manner as in Example 1.

The photographic characteristic of each sample having a dye image thus-formed was measured. Then, each sample was subjected to a light-fastness test for three months by means of a fluorescent lamp fading tester (15,000 lux) using an ultraviolet ray absorption filter to cut off light of wavelengths shorter than 400 nm (made by Fuji Photo Film Co., Ltd.). The results thus-obtained are shown in Table 3 below.

TABLE 3

| Sample | Coupler | Additive | Amount of Additive (mol % to Coupler) | Light-Fastness Test* Fluorescent Lamp 3 Months, $D_0$ = 1.5 (%) | Remark |
|---|---|---|---|---|---|
| C | M-1 | — | — | 42 (0.27) | Comparison |
| C-1 | " | I-3 | 20 | 43 (0.21) | " |
| C-2 | " | I-16 | " | 45 (0.21) | " |
| C-3 | " | I-20 | " | 44 (0.23) | " |
| C-4 | " | I-28 | " | 46 (0.21) | " |
| C-5 | " | A-1 | " | 78 (0.26) | " |
| C-6 | " | A-22 | " | 79 (0.23) | " |
| C-7 | " | A-25 | " | 81 (0.18) | " |
| C-8 | " | A-26 | " | 43 (0.19) | " |
| C-9 | " | I-3/A-1 | 20/20 | 94 (0.10) | Invention |
| C-10 | " | I-16/A-22 | " | 93 (0.12) | " |
| C-11 | " | I-28/A-26 | " | 90 (0.10) | " |
| C-12 | M-2 | — | — | 41 (0.22) | ComparisoN |
| C-13 | " | I-49/III-1 | 20/20 | 45 (0.20) | " |
| C-14 | " | III-1/III-58 | " | 46 (0.21) | " |
| C-15 | " | A-6/A-49 | " | 77 (0.21) | " |
| C-16 | " | I-49/A-6 | " | 92 (0.16) | Invention |
| C-17 | M-2 | III-1/A-94 | 20/20 | 94 (0.15) | Invention |
| C-18 | M-34 | — | — | 42 (0.27) | Comparison |
| C-19 | " | I-36 | 20 | 45 (0.25) | " |
| C-20 | " | I-42 | " | 44 (0.24) | " |
| C-21 | " | A-36 | " | 77 (0.19) | " |
| C-22 | " | A-61 | " | 89 (0.20) | " |
| C-23 | " | I-36/A-36 | 20/20 | 94 (0.13) | Invention |
| C-24 | " | I-42/A-61 | " | 95 (0.12) | " |
| C-25 | M-13 | — | — | 55 (0.22) | Comparison |
| C-26 | " | I-1/A-22 | 20/20 | 91 (0.11) | Invention |
| C-27 | " | I-49/A-52 | " | 92 (0.12) | " |
| C-28 | " | III-26/A-25 | " | 94 (0.10) | " |
| C-29 | " | III-34/A-85 | 20/10 | 93 (0.13) | " |

Note:
The value in () is density ($D_B$) measured by blue light at the non-color formed portion and represents stain.

EXAMPLE 4

13.8 g of Magenta Coupler (M-33) was dissolved in a mixture of 13.8 ml of tricresyl phosphate and 15 ml of ethyl acetate and the resulting solution was added to 100 ml of an aqueous solution containing 10 g of gelatin and 1 g of sodium dodecylbenzenesulfonate to prepare mechanically a fine emulsified dispersion. The total amount of the emulsified dispersion was added to 100 g of a pure silver chloride emulsion (containing 6.5 g of silver), and then the same procedure was followed as described in Example 3 to prepare Sample D.

Further, in the same manner as described above, other samples were prepared using the combinations as shown in Table 4 below. The additives were dissolved into the solutions containing the coupler and then the solutions thus obtained were incorporated into the silver halide emulsion.

These samples were subjected to the same fading test using a fluorescent lamp as described in Example 3. The results thus-obtained are shown in Table 4 below.

TABLE 4

| Sample | Coupler | Additive | Amount of Additive (mol % to Coupler) | Light-Fastness Test* Fluorescent Lamp 3 Months, $D_0$ = 1.5 (%) | Remark |
|---|---|---|---|---|---|
| D | M-33 | — | — | 48 (0.11) | Comparison |
| D-1 | " | I-49 | 20 | 51 (0.11) | " |
| D-2 | " | I-49 | 40 | 58 (0.10) | " |
| D-3 | " | A-62 | 20 | 87 (0.10) | " |
| D-4 | " | A-62 | 40 | 88 (0.09) | " |
| D-5 | " | I-49/A-62 | 20/20 | 98 (0.10) | Invention |
| D-6 | " | III-1/A-61 | " | 97 (0.09) | " |
| D-7 | M-16 | — | — | 31 (0.13) | Comparison |
| D-8 | " | I-16/II-5 | 20/20 | 35 (0.12) | " |
| D-9 | " | A-40/A-74 | 20/10 | 79 (0.13) | " |
| D-10 | " | I-16/A-40 | 20/20 | 94 (0.10) | Invention |
| D-11 | M-17 | — | — | 38 (0.14) | Comparison |
| D-12 | " | I-42/III-1 | 20/20 | 39 (0.12) | " |
| D-13 | " | A-6/A-84 | 20/10 | 75 (0.14) | " |
| D-14 | " | I-42/A-6 | 20/20 | 94 (0.10) | Invention |
| D-15 | M-23 | — | — | 45 (0.12) | Comparison |

TABLE 4-continued

| Sample | Coupler | Additive | Amount of Additive (mol % to Coupler) | Light-Fastness Test* Fluorescent Lamp 3 Months, $D_0$ = 1.5 (%) | Remark |
|---|---|---|---|---|---|
| D-16 | " | III-26/III-65 | 20/20 | 48 (0.11) | " |
| D-17 | M-23 | A-1/A-37 | 20/20 | 59 (0.14) | Comparison |
| D-18 | " | III-26/A-1 | " | 91 (0.09) | Invention |
| D-19 | M-31 | — | — | 44 (0.11) | Comparison |
| D-20 | " | III-34 | 20 | 46 (0.11) | " |
| D-21 | " | A-56 | " | 83 (0.11) | " |
| D-22 | " | III-34/A-56 | 20/20 | 96 (0.09) | Invention |
| D-23 | M-35 | — | — | 38 (0.13) | Comparison |
| D-24 | " | I-38 | 20 | 41 (0.12) | " |
| D-25 | " | A-6 | " | 81 (0.13) | " |
| D-26 | " | I-38/A-6 | 20/20 | 95 (0.09) | Invention |
| D-27 | M-38 | — | — | 35 (0.14) | Comparison |
| D-28 | " | I-41 | 20 | 51 (0.14) | " |
| D-29 | " | A-140 | " | 36 (0.14) | " |
| D-30 | " | I-41/A-140 | 20/20 | 93 (0.11) | Invention |

Note:
The value in () is density ($D_B$) measured by blue light at the non-color formed portion and represents stain.

EXAMPLE 5

10.7 g of Yellow Coupler (Y-35) was dissolved by heating in a mixture of 8.6 ml of dibutyl phthalate and 25 ml of ethyl acetate and the resulting solution was added to 100 g of an aqueous solution containing 10 g of gelatin and 1 g of sodium dodecylbenzenesulfonate to prepare a finely emulsified dispersion by means of mechanical stirring. The total amount of the emulsified dispersion was added to 100 g of a silver chlorobromide emulsion (containing 80 mol % of silver bromide and 6.5 g of silver) and thereto 10 ml of a 2% aqueous solution of 2,4-dihydroxy-6-chloro-S-triazine sodium salt was added just before coating as a hardener. The resulting mixture was coated on a paper support, both surfaces of which were laminated with polyethylene at a silver coating amount of 350 mg/m$^2$. On the layer thus-coated was provided a gelatin layer to prepare a sample, which was designated as Sample E.

Further, in the same manner as described above, other samples were prepared using the combinations as shown in Table 5 below. The additives were dissolved into the solutions containing the coupler and then the solutions thus obtained were incorporated into the silver halide emulsion.

These samples thus-prepared were subjected to exposure and development processing in the same manner as described in Example 1 to prepare color images.

The photographic characteristic of each sample having a color image thus-formed was measured. Then, each sample was subjected to a light-fastness test for four months by means of a fluorescent lamp fading tester (15,000 lux) using an ultraviolet ray absorption filter same as used in Example 1 above.

Further, in order to evaluate humidity and heat fastness, each sample was stored at 60° C. and 70% RH for three months, and the change in density of the color image at the area having an initial density ($D_0$) of 1.5 was measured. The results thus-obtained are shown in Table 5 below.

TABLE 5

| Sample | Coupler | Additive | Amount of Additive (mol % to Coupler) | Light-Fastness Test Fluorescent Lamp 4 Months, $D_0$ = 1.5 (%) | Humidity and Heat-Fastness Test 60° C./70% RH 3 Months, $D_0$ = 1.5 (%) | Remark |
|---|---|---|---|---|---|---|
| E | Y-35 | — | — | 71 | 86 | Comparison |
| E-1 | " | I-5 | 20 | 72 | 86 | " |
| E-2 | " | I-7 | " | 71 | 88 | " |
| E-3 | " | I-10 | " | 73 | 86 | " |
| E-4 | " | I-22 | " | 71 | 87 | " |
| E-5 | " | I-24 | " | 73 | 86 | " |
| E-6 | " | I-26 | " | 72 | 88 | " |
| E-7 | " | A-31 | " | 75 | 90 | " |
| E-8 | " | A-89 | " | 78 | 91 | " |
| E-9 | " | A-92 | " | 69 | 85 | " |
| E-10 | " | A-100 | " | 71 | 86 | " |
| E-11 | " | I-5/A-31 | 20/20 | 88 | 95 | Invention |
| E-12 | " | I-22/A-100 | " | 86 | 96 | " |
| E-13 | " | I-49/A-89 | " | 90 | 97 | " |
| E-14 | " | I-51/A-100 | " | 87 | 95 | " |
| E-15 | Y-36 | — | — | 73 | 87 | Comparison |
| E-16 | Y-36 | I-56 | 20 | 74 | 87 | Comparison |
| E-17 | " | I-56 | 40 | 77 | 91 | " |
| E-18 | " | III-29 | 20 | 75 | 88 | " |
| E-19 | " | III-29 | 40 | 76 | 90 | " |
| E-20 | " | I-56/A-31 | 20/20 | 93 | 95 | Invention |
| E-21 | Y-39 | — | " | 69 | 87 | Comparison |
| E-22 | " | I-33/III-60 | 20/20 | 70 | 87 | " |
| E-23 | " | I-52/III-40 | " | 69 | 88 | " |
| E-24 | " | A-87/A-148 | 10/20 | 69 | 88 | " |

TABLE 5-continued

| Sample | Coupler | Additive | Amount of Additive (mol % to Coupler) | Light-Fastness Test Fluorescent Lamp 4 Months, $D_0 = 1.5$ (%) | Humidity and Heat-Fastness Test 60° C./70% RH 3 Months, $D_0 = 1.5$ (%) | Remark |
|---|---|---|---|---|---|---|
| E-25 | " | A-145/A-164 | 20/20 | 71 | 89 | " |
| E-26 | " | I-33/A-87 | 20/10 | 92 | 94 | Invention |
| E-27 | " | I-52/A-148 | 20/20 | 94 | 95 | " |
| E-28 | " | III-40/A-145 | " | 95 | 94 | " |
| E-29 | " | III-60/A-164 | " | 93 | 94 | " |

*The percentage of the remaining dye after the fading test at the area having an initial density $D_0 = 1.5$ to the amount.

From the results shown in Examples 1 to 5, it can be seen that the samples in which the compound represented by the general formula (I), (II) or (III) and the compound represented by the general formula (IV) or the organic metal complex are used in combination according to the present invention exhibit a greatly improved effect on the fastness to light, heat or heat and humidity in comparison with the cases wherein these compounds are individually used, the cases wherein these compounds are used individually in an increased amount, and the cases wherein the mixture of the compounds represented by the general formulae (I), (II) and (III) is employed, the cases wherein a mixture of the compound represented by the general formula (IV) or the cases wherein a mixture of organic metal complex is employed.

EXAMPLE 6

On a paper support, both surfaces of which were laminated with polyethylene, a first layer (the undermost layer) to a seventh layer (the uppermost layer) as shown in Table A below were coated in this order to prepare a color photographic light-sensitive material.

For the Blue-Sensitive Emulsion Layer:

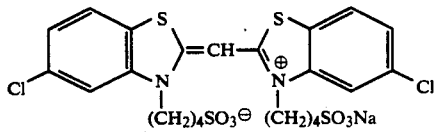

($2 \times 10^{-4}$ mol per mol of silver halide)

For the Green-Sensitive Emulsion Layer:

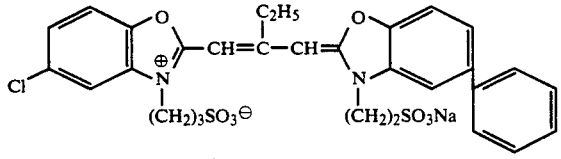

($2.5 \times 10^{-4}$ mol per mol of silver halide)

For the Red-Sensitive Emulsion Layer:

TABLE A

| Layer | Main Composition | Amount Used |
|---|---|---|
| Seventh Layer (Protective layer) | Gelatin | 1.33 g/m$^2$ |
| | Acryl-modified Polyvinyl Alcohol Copolymer (degree of modification: 17%) | 0.17 g/m$^2$ |
| Sixth Layer (Ultraviolet light absorbing layer) | Gelatin | 0.54 g/m$^2$ |
| | Ultraviolet Light Absorbing Agent (d) | $5.10 \times 10^{-4}$ mol/m$^2$ |
| | Solvent (a) | 0.08 g/m$^2$ |
| Fifth Layer (Red-sensitive layer) | Silver Chlorobromide Emulsion (silver bromide: 70 mol %) | 0.22 g/m$^2$ (as silver) |
| | Gelatin | 0.90 g/m$^2$ |
| | Cyan Coupler | $7.05 \times 10^{-4}$ mol/m$^2$ |
| | Color image Stabilizer (f) | $5.20 \times 10^{-4}$ mol/m$^2$ |
| | Solvent (e) | 0.6 g/m$^2$ |
| Fourth Layer (Ultraviolet light absorbing layer) | Gelatin | 1.60 g/m$^2$ |
| | Ultraviolet Light Absorbing Agent (d) | $1.70 \times 10^{-4}$ mol/m$^2$ |
| | Color Mixing Preventing Agent (A-24) | $1.60 \times 10^{-4}$ mol/m$^2$ |
| | Solvent (a) | 0.24 g/m$^2$ |
| Third Layer (Green-sensitive layer) | Silver Chlorobromide Emulsion (silver bromide: 75 mol %) | 0.15 g/m$^2$ (as silver) |
| | Gelatin | 1.56 g/m$^2$ |
| | Magenta Coupler | $3.38 \times 10^{-4}$ mol/m$^2$ |
| | Solvent (c) | 0.59 g/m$^2$ |
| Second Layer (Color mixing preventing layer) | Gelatin | 0.90 g/m$^2$ |
| | Color Mixing Preventing Agent (b) | $2.33 \times 10^{-4}$ mol/m$^2$ |
| First Layer (Blue-sensitive layer) | Silver Chlorobromide Emulsion (silver bromide: 80 mol %) | 0.35 g/m$^2$ (as silver) |
| | Gelatin | 1.35 g/m$^2$ |
| | Yellow Coupler | $6.91 \times 10^{-4}$ mol/m$^2$ |
| | Solvent (a) | 0.02 g/m$^2$ |
| Support | Polyethylene laminated paper (the polyethylene coating containing a white pigment ($TiO_2$) and a bluish dye (ultramarine) on the first layer side). | |

In addition, the following spectral sensitizing dyes were used for the above described silver halide emulsion layers.

-continued

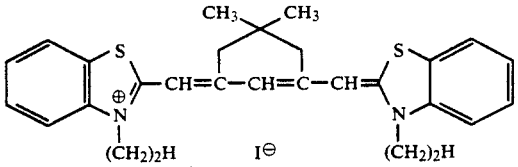

(2.5 × $10^{-4}$ mol per mol of silver halide)

The compounds used for preparing the above described color photographic light-sensitive material were as follows.

Solvent (a):

$(iso\text{-}C_9H_{19}O)_3P{=}O$

Color Mixing Preventing Agent (b):

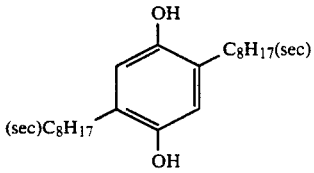

Solvent (c):

$(C_8H_{17}O)_3P{=}O$ and

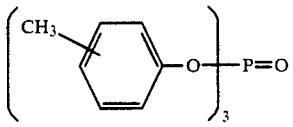

in a 2:1 mixture (weight ratio).

Ultraviolet Light Absorbing Agent (d):

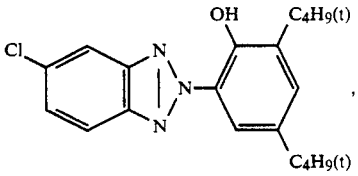

,

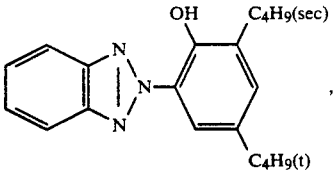

, and

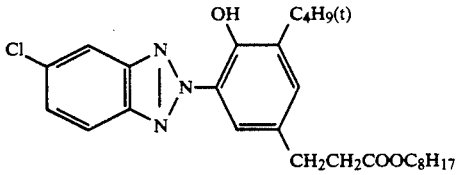

in a 1:5:3 mixture (molar ratio).

Solvent (e):

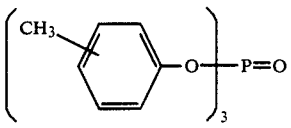

Color Image Stabilizer (f):

-continued

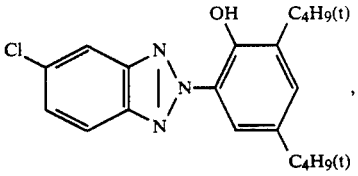

,

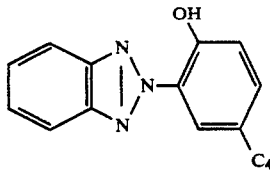

, and

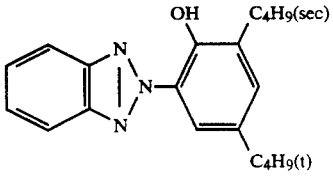

in a 1:3:3 mixture (molar ratio).

Furthermore, the following dyes were used for the emulsion layers as irradiation preventing dyes.

For the Green-Sensitive Emulsion Layer:

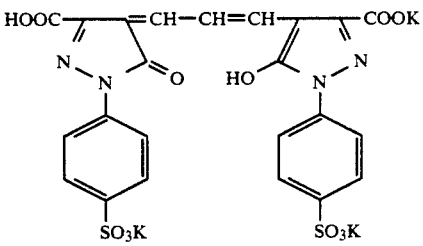

For the Red-Sensitive Emulsion Layer:

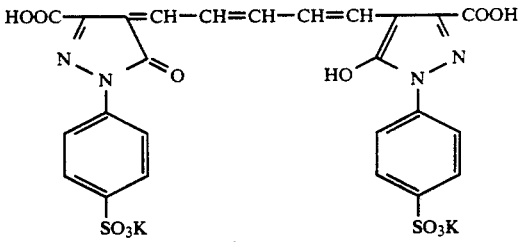

Using the combinations of couplers and the compounds according to the present invention as shown in Table 6 below samples were prepared. The additives were dissolved into the solutions containing the coupler and then the solutions thus obtained were incorporated into the silver halide emulsion.

These samples were exposed through an optical wedge and then subjected to development processing according to the following steps.

| Processing Step | Temperature | Time |
|---|---|---|
| Color Development | 33° C. | 3 min. 30 sec. |
| Bleach-Fixing | 33° C. | 1 min. 30 sec. |
| Washing with Water | 33° C. | 3 min. |

-continued

| Processing Step | Temperature | Time |
|---|---|---|
| Drying | 50–80° C. | 2 min. |

The compositions of the processing solutions used were as follows.

| Color Developing Solution | |
|---|---|
| Benzyl alcohol | 12 ml |
| Diethylene glycol | 5 ml |
| Potassium carbonate | 25 g |
| Sodium chloride | 0.1 g |
| Sodium bromide | 0.5 g |
| Anhydrous sodium sulfite | 2 g |
| Hydroxylamine sulfate | 2 g |
| Fluorescent whitening agent | 1 g |
| N-Ethyl-N-β-methanesulfonamidoethyl-3-methyl-4-aminoaniline sulfate | 4 g |
| Water to make | 1 liter |
| pH (adjusted with sodium hydroxide) | 10.2 |
| Bleach-Fixing Solution | |
| Ammonium thiosulfate | 124.5 g |
| Sodium methabisulfite | 13.3 g |
| Anhydrous sodium sulfite | 2.7 g |
| Ammonium ferric ethylenediamine-tetraacetate | 65 g |
| Color developing solution | 100 ml |

-continued

| | |
|---|---|
| pH | 6.7 to 6.8 |
| Water to make | 1 liter |

The compositions of the processing solutions used were almost in an equilibrium state since the development processing was conducted while performing normal replenishing using an ordinary roller transport type developing solution processer.

With each sample thus-processed, a cyan, yellow and magenta reflection density was measured using a Fuji self-recording type densitometer (made by Fuji Photo Film Co., Ltd.). Then, each sample was subjected to a fading test using a fluorescent lamp tester (15,000 lux) for 30 days.

The results thus-obtained are shown in Table 6 below.

TABLE 6

| | First Layer | | | Third Layer | | | Fifth Layer | | |
|---|---|---|---|---|---|---|---|---|---|
| Sample | Coupler | Additive | Amount of* Additive | Coupler | Additive | Amount of* Additive | Coupler | Additive | Amount of* Additive |
| F | Y-35 | — | — | M-31 | — | — | C-34 | — | — |
| F-1 | " | I-38 | 20 | " | — | — | " | — | — |
| F-2 | " | I-89 | 20 | " | — | — | " | — | — |
| F-3 | " | I-38/A-89 | 20/20 | " | — | — | " | — | — |
| F-4 | " | I-38/III-26/A-89 | 10/10/20 | " | — | — | " | — | — |
| F-5 | " | — | — | " | I-49 | 20 | " | — | — |
| F-6 | " | — | — | " | A-62 | 20 | " | — | — |
| F-7 | " | — | — | " | I-49/A-62 | 20/20 | " | — | — |
| F-8 | " | — | — | " | I-49/III-1/A-62 | 10/10/20 | " | — | — |
| F-9 | " | — | — | " | — | — | " | I-47 | 20 |
| F-10 | " | — | — | " | — | — | " | A-90 | 20 |
| F-11 | " | — | — | " | — | — | " | I-47/A-90 | 20/20 |
| F-12 | " | — | — | " | — | — | " | I-47/III-34/A-90 | 10/10/20 |
| F-13 | " | I-49/III-1/A-90 | 10/10/50 | " | I-49/III-1/A-63 | 10/10/50 | " | I-49/III-1/A-90 | 10/10/50 |
| F-14 | Y-36 | — | — | M-13 | — | — | C-1 | — | — |
| F-15 | " | — | — | " | I-36 | 20 | C-2 | — | — |
| F-16 | " | — | — | " | A-52 | 20 | C-18 | — | — |
| F-17 | " | — | — | " | I-36/A-52 | 20/20 | " | I-41/A-30 | 20/20 |
| F-18 | " | — | — | M-27 | — | — | C-25 | — | — |
| F-19 | " | I-20/A-48 | 20/20 | " | III-26/A-56 | 20/50 | " | III-1/A-30 | 20/20 |

| | Light-Fastness Test with Fluorescent Lamp | | | |
|---|---|---|---|---|
| Sample | Yellow (%) | Magenta (%) | Cyan (%) | Remark |
| F | 80 | 56 | 79 | Comparison |
| F-1 | 82 | 56 | 79 | " |
| F-2 | 83 | 56 | 79 | " |
| F-3 | 91 | 56 | 79 | Invention |
| F-4 | 92 | 56 | 79 | " |
| F-5 | 80 | 58 | 79 | Comparison |
| F-6 | 80 | 71 | 79 | " |
| F-7 | 80 | 86 | 79 | Invention |
| F-8 | 80 | 89 | 79 | " |
| F-9 | 80 | 56 | 81 | Comparison |
| F-10 | 80 | 56 | 83 | " |
| F-11 | 80 | 56 | 87 | Invention |
| F-12 | 80 | 56 | 89 | " |
| F-13 | 85 | 82 | 89 | " |
| F-14 | 81 | 66 | 76 | Comparison |
| F-15 | 81 | 67 | 76 | " |
| F-16 | 81 | 79 | 61 | " |
| F-17 | 81 | 85 | 82 | Invention |
| F-18 | 81 | 57 | 84 | Comparison |
| F-19 | 90 | 93 | 94 | Invention |

*Mol % to coupler

From the results shown in Table 6, it can be seen that the greatly improved effect on light fastness is also observed by the combination of the compounds according to the present invention in multilayer samples.

EXAMPLE 7

A color photographic light-sensitive material (Sample G) was prepared as follows.

A multilayer color photographic light-sensitive material in which Layer 1 to Layer 11 have the following layer structure on a paper support, both surfaces of the paper support having been laminated with polyethylene, was prepared. In this case, the polyethylene coating on the Layer 1 side of the support contained titanium dioxide as a white pigment and a small amount of ultramarine as a bluish dye.

Construction of Layers

The composition of each layer is shown below. The coating amounts of the components are described in the unit of g/m$^2$. With respect to silver halide, the coating amount is indicated in terms of a silver coating amount.

| | |
|---|---|
| Layer 1: Antihalation Layer: | |
| Black Colloidal Silver | 0.01 |
| Gelatin | 0.2 |
| Layer 2: Low-Speed Red-Sensitive Layer: | |
| Silver Iodobromide Emulsion (silver iodide: 3.5 mol %, mean grain size 0.7 μm) spectrally sensitized by red-sensitizing dyes (*5 and *4) | 0.15 as silver |
| Gelatin | 1.0 |
| Cyan Coupler (*3) | 0.30 |
| Color Fading Preventing Agent (*2) | 0.15 |
| Coupler Solvent (*12 and *1) | 0.06 |
| Layer 3: High Speed Red-Sensitive Layer: | |
| Silver Iodobromide Emulsion (silver iodide: 8.0 mol %, mean grain size 0.7 μm) spectrally sensitized by red-sensitizing dyes (*5 and *4) | 0.10 as silver |
| Gelatin | 0.50 |
| Cyan Coupler (*3) | 0.10 |
| Color Fading Preventing Agent (*2) | 0.05 |
| Coupler Solvent (*12 and *1) | 0.02 |
| Layer 4: Interlayer: | |
| Yellow Colloidal Silver | 0.02 |
| Gelatin | 1.00 |
| Color Mixing Preventing Agent (*11) | 0.08 |
| Color Mixing Preventing Agent Solvent (*10) | 0.16 |
| Polymer Latex (*6) | 0.40 (solid content) |
| Layer 5: Low-Speed Green-Sensitive Layer: | |
| Silver Iodobromide Emulsion (silver iodide: 2.5 mol %, mean grain size 0.4 μm) spectrally sensitized by green-sensitizing dyes (*9) | 0.20 as silver |
| Gelatin | 0.70 |
| Magenta Coupler (*8) | 0.40 |
| Coupler Solvent (*15) | 0.60 |
| Layer 6: High-Speed Green-Sensitive Layer: | |
| Silver Iodobromide Emulsion (silver iodide: 3.5 mol %, mean grain size 0.9 μm) spectrally sensitized by green-sensitizing dyes (*9) | 0.20 as silver |
| Gelatin | 0.70 |
| Magenta Coupler (*8) | 0.40 |
| Coupler Solvent (*15) | 0.60 |
| Layer 7: Yellow Filter Layer: | |
| Yellow Colloidal Silver | 0.20 |
| Gelatin | 1.00 |
| Color Mixing Preventing Agent (*11) | 0.06 |
| Color Mixing Preventing Agent Solvent (*10) | 0.24 |

-continued

| | |
|---|---|
| Layer 8: Low-Speed Blue-Sensitive layer: | |
| Silver Iodobromide Emulsion (silver iodide: 2.5 mol %, mean grain size 0.5 μm) spectrally sensitized by blue-sensitizing dyes (*13) | 0.15 as silver |
| Gelatin | 0.50 |
| Yellow Coupler (*12) | 0.20 |
| Coupler Solvent (*15) | 0.05 |
| Layer 9: High-Speed Blue-Sensitive Layer: | |
| Silver Iodobromide Emulsion (silver iodide: 2.5 mol %, mean grain size 1.4 μm) spectrally sensitized by blue-sensitizing dyes (*13) | 0.20 as silver |
| Gelatin | 0.67 |
| Yellow Coupler (*12) | 0.27 |
| Coupler Solvent (*15) | 0.07 |
| Layer 10: Ultraviolet Light Absorbing Layer: | |
| Gelatin | 1.50 |
| Ultraviolet Light Absorbing Agent (*16) | 1.0 |
| Ultraviolet Light Absorbing Agent Solvent (*15) | 0.30 |
| Color Fading Preventing Agent (*14) | 0.08 |
| Layer 11: Protective Layer: | |
| Gelatin | 1.0 |

The compounds used for the color photographic light-sensitive material were as follows.

(*1): Dioctyl phthalate (*2): 2-(2-Hydroxy-3-sec-butyl-5-tert-butylphenyl)benzotriazole (*3): 2-[α-(2,4-Di-tert-amylphenoxy)butanamido]-4,6-dichloro-5-ethylphenol (*4): 5,5'-Dichloro-3,3'-di(3-sulfobutyl)-9-ethylthiacarbocyanine Sodium Salt (*5): Triethylammonium-3-[2-{2-[3-(3-sulfopropyl)-naphtho(1,2-d)thiazolin-2-ylidenemethyl]-1-butenyl}-3-naphtho(1,2-d)thiazolino]propane Sulfonate (*6): Polyethyl Acrylate (*7): Phosphoric Acid Trioctyl Ester (*8): M-33

(*9): 5,5'-Diphenyl-9-ethyl-3,3'-disulfopropyloxacarbocyanine Sodium Salt (*10): Phosphoric Acid o-Cresyl Ester (*11): 2,4-Di-tert-octylhydroquinone (*12): α-Pivaloyl-α-[(2,4-dioxo-1-benzyl-5-ethoxyhydantoin-3-yl)-2-chloro-5-(α-2,4-dioxo-tert-amylphenoxy)butanamido]acetanilide (*13): Triethylammonium 3-[2-(3-benzylrhodanine-5-ylidene)-3-benzoxazolinyl]propanesulfonate (*14): 2,4-Di-sec-octylhydroquinone (*15): Phosphoric Acid Trinonyl Ester (*16): 5-Chloro-2-(2-hydroxy-3-tert-butyl-5-tert-octyl)-phenylbenzotriazole Further, in the same manner as described for Sample G above, except adding the compounds according to the present invention to each Layer 5 and Layer 6 of Sample G as shown in Table 7, other samples were prepared. The additives were dissolved into the solution containing the coupler and then the solutions thus obtained were incorporated into the silver halide emulsion.

The samples thus-prepared were exposed through an optical wedge and subjected to development processing according to the following processing steps.

| Processing Step | Temperature | Time |
|---|---|---|
| First Development | 38° C. | 1 min. 15 sec. |

-continued

| Processing Step | Temperature | Time |
|---|---|---|
| (Black and White Development) | | |
| Washing with Water | 38° C. | 1 min. 30 sec. |
| Reversal Exposure | >100 lux | >1 min. |
| Color Development | 38° C. | 2 min. 15 sec. |
| Washing with Water | 38° C. | 45 sec. |
| Bleach-Fixing | 38° C. | 2 min. 00 sec. |
| Washing with Water | 38° C. | 2 min. 15 sec. |

The compositions for the processing solutions used were as follows.

| First Developing Solution | |
|---|---|
| Pentasodium Nitrilo-N,N,N-trimethylene-phosphonate | 0.6 g |
| Pentasodium Diethylenetriaminepenta-acetate | 4.0 g |
| Potassium Sulfite | 30.0 g |
| Potassium Thiocyanate | 1.2 g |
| Potassium Carbonate | 35.0 g |
| Potassium Hydroquinone Monosulfonate | 25.0 g |
| Diethylene glycol | 15.0 ml |
| 1-Phenyl-4-hydroxymethyl-4-methyl-3-pyrazolidone | 2.0 g |
| Potassium Bromide | 0.5 g |
| Potassium Iodide | 5.0 mg |
| Water to make | 1 liter |
| | pH 9.70 |
| **Color Developing Solution** | |
| Benzyl Alcohol | 15.0 ml |
| Diethylene Glycol | 12.0 ml |
| 3,6-Dithia-1,8-octandiol | 0.2 g |
| Pentasodium Nitrilo-N,N,N-tri-methylenephosphonate | 0.5 g |
| Pentasodium Diethylenetriaminepenta-acetate | 2.0 g |
| Sodium Sulfite | 2.0 g |
| Potassium Carbonate | 25.0 g |
| Hydroxylamine sulfate | 3.0 g |
| N-Ethyl-N-(β-methanesulfonamidoethyl)-3-methyl-4-aminoaniline Sulfate | 5.0 g |
| Potassium Bromide | 0.5 g |
| Potassium Iodide | 1.0 mg |
| Water to make | 1 liter |
| | pH 10.40 |
| **Bleach-Fixing Solution** | |
| 2-Mercapto-1,3,4-triazole | 1.0 g |
| Disodium Ethylenediaminetetraacetate | 5.0 g |
| Ammonium Iron (III) Ethylene-diaminetetraacetate Monohydrate | 80.0 g |
| Sodium Sulfite | 15.0 g |
| Sodium thiosulfate (700 g/l) | 160.0 ml |
| Glacial Acetic Acid | 5.0 ml |
| Water to make | 1 liter |
| | pH 6.50 |

The magenta reflection density (stain) at the non-imaged portion of each sample thus processed was measured and then the magenta reflection density (stain) at the non-imaged portion thereof was measured again after allowing the sample to stand for 3 days at 80° C. and 70% RH and after allowing the sample to stand for 80 days at room temperature. The increase in stain from one hour after processing is shown in Table 7 below.

Further, in order to evaluate light fastness of each sample, a magenta reflection density was measured using a Fuji self-recording type densitometer. Then, each sample was subjected to a fading test using a fluorescent lamp tester (15,000 lux) for 30 days. The results thus-obtained are also shown in Table 7 below.

TABLE 7

| Sample | Additive | Amount of Additive (mol % to Coupler) | Increase in Magenta Density: 80° C./70% RH 3 Days | Increase in Magenta Density: Room Temperature 80 Days | Light-Fastness Test Remaining Ratio of Magenta Dye (%) | Remark |
|---|---|---|---|---|---|---|
| G | — | — | 0.07 | 0.05 | 62 | Comparison |
| G-1 | A-1 | 20 | 0.07 | 0.05 | 70 | " |
| G-2 | A-61 | " | 0.08 | 0.05 | 78 | " |
| G-3 | A-62 | " | 0.07 | 0.06 | 77 | " |
| G-4 | A-63 | " | 0.07 | 0.05 | 74 | " |
| G-5 | I-38 | " | 0.03 | 0.02 | 63 | " |
| G-6 | I-41 | " | 0.03 | 0.02 | 62 | " |
| G-7 | I-49 | " | 0.02 | 0.03 | 63 | " |
| G-8 | III-1 | " | 0.03 | 0.02 | 63 | " |
| G-9 | III-26 | " | 0.02 | 0.02 | 62 | " |
| G-10 | A-1/A-61 | 20/20 | 0.08 | 0.06 | 82 | " |
| G-11 | A-61/A-63 | " | 0.07 | 0.05 | 85 | " |
| G-12 | I-38/I-49 | " | 0.02 | 0.02 | 67 | " |
| G-13 | I-49/III-1 | " | 0.02 | 0.02 | 68 | " |
| G-14 | A-62 | 40 | 0.07 | 0.06 | 81 | " |
| G-15 | I-41 | " | 0.03 | 0.02 | 65 | " |
| G-16 | I-41/A-61 | 20/20 | 0.02 | 0.01 | 91 | Invention |
| G-17 | I-49/A-1 | " | 0.02 | 0.01 | 90 | " |
| G-18 | III-1/A-1 | " | 0.01 | 0.02 | 92 | " |
| G-19 | I-49/III-1/A-63 | 10/10/20 | 0.01 | 0.01 | 87 | " |

From the results shown in Table 7, it can be seen that the combination of the compounds according to the present invention is extremely effective not only for preventing color (magenta) stain due to the preservation after the development processing but also for improving light fastness of magenta dye.

EXAMPLE 8

The following First layer to Fourteenth layer were coated on a paper support, both surfaces of which were laminated with polyethylene to prepare a multilayer color photographic light-sensitive material. The polyethylene laminated on the First layer side of the support contained titanium dioxide as a white pigment and a small amount of ultramarine as a bluish dye.

Construction of Layers

The composition of each layer is shown below. The coating amounts of the components are described in the unit of g/m$^2$. With respect to silver halide, the coating amount is indicated in terms of a silver coating amount.

| | |
|---|---|
| First Layer: Antihalation Layer | |
| Black colloidal silver | 0.10 |
| Gelatin | 1.30 |
| Second Layer: Intermediate Layer | |
| Gelatin | 0.70 |
| Third Layer: Low-Sensitive Red-sensitive Layer | |
| Silver bromide emulsion spectrally sensitized with Red-sensitizing dyes (ExS-1, 2, 3) (average grain size: 0.3 μm, size distribution: 8%, octahedral) | 0.06 |
| Silver bromide emulsion spectrally sensitized with Red-sensitizing dyes (ExS-1, 2, 3) (average grain size: 0.45 μm, size distribution: 10%, octahedral) | 0.10 |
| Gelatin | 1.00 |
| Cyan coupler (ExC-1) | 0.14 |
| Cyan coupler (ExC-2) | 0.07 |
| Color fading preventing agent (Cpd-2, 3, 4, 18, mixing ratio: 1/1/1/1)* | 0.12 |
| Coupler dispersing medium (Cpd-5) | 0.03 |
| Coupler solvent (Solv-1, 2, 3, mixing ratio: 1/1/1)* | 0.06 |
| (*: The mixing ratio of agents is represented by weight ratio and the mixing ratio of the solvents is represented by volume; the same hereinafter) | |
| Fourth Layer: High-Sensitive Red-sensitive Layer | |
| Silver bromide emulsion spectrally sensitized with Red-sensitizing dyes (ExS-1, 2, 3) (average grain size: 0.75 μm, size distribution: 10%, octahedral) | 0.15 |
| Gelatin | 1.00 |
| Cyan coupler (ExC-1) | 0.20 |
| Cyan coupler (ExC-2) | 0.10 |
| Color fading preventing agent (Cpd-2, 3, 4, 18, mixing ratio: 1/1/1/1) | 0.15 |
| Coupler dispersing medium (Cpd-5) | 0.03 |
| Coupler solvent (Solv-1, 2, 3, mixing ratio: 1/1/1) | 0.10 |
| Fifth Layer: Intermediate Layer | |
| Gelatin | 1.00 |
| Color mixing preventing agent (Cpd-7) | 0.08 |
| Color mixing preventing agent solvent (Solv-4, 5, mixing ratio: 1/1) | 0.16 |
| Polymer latex (Cpd-8) | 0.10 (solid content) |
| Sixth layer: Low-Sensitive Green-sensitive Layer | |
| Silver bromide emulsion spectrally sensitized with Green-sensitizing dyes (ExS-3, 4) (average grain size: 0.28 μm, size distribution: 8%, octahedral) | 0.04 |
| Silver bromide emulsion spectrally sensitized with Green sensitizing dyes (ExS-3, 4) (average grain size: 0.45 μm, size distribution: 10%, octahedral) | 0.06 |
| Gelatin | 0.80 |
| Magenta coupler (ExM-1) | 0.10 |
| Coupler dispersing medium (Cpd-5) | 0.05 |
| Coupler solvent (Solv-4, 6, mixing ratio: 1/1) | 0.15 |
| Seventh Layer: High-Sensitive Green-sensitive Layer | |
| Silver bromide emulsion spectrally sensitized with Green-sensitizing dye (ExS-3) (average grain size: 0.9 μm, size distribution: 8%, octahedral) | 0.10 |
| Gelatin | 0.80 |
| Magenta coupler (ExM-1) | 0.10 |
| Coupler dispersing medium (Cpd-5) | 0.05 |
| Coupler solvent (Solv-4, 6, mixing ratio: 1/1) | 0.15 |
| Eighth Layer: Intermediate Layer | |
| Same as Fifth Layer | |
| Ninth Layer: Yellow Filter Layer | |
| Yellow colloidal silver | 0.20 |

-continued

| | |
|---|---|
| Gelatin | 1.00 |
| Color mixing preventing agent (Cpd-7) | 0.06 |
| Color mixing preventing agent solvent (Solv-4, 5, mixing ratio: 1/1) | 0.15 |
| Polymer latex (Cpd-8) | 0.10 (solid content) |
| Tenth Layer: Intermediate Layer | |
| Same as Fifth Layer | |
| Eleventh Layer: Low-Sensitive Blue-sensitive Layer | |
| Silver bromide emulsion spectrally sensitized with Blue-sensitizing dye (ExS-5) (average grain size: 0.35 μm, size distribution: 8%, tetradecahedral) | 0.07 |
| Silver bromide emulsion spectrally sensitized with Blue-sensitizing dye (ExS-5) (average grain size: 0.45 μm, size distribution: 10%, tetradecahedral) | 0.10 |
| Gelatin | 0.50 |
| Yellow coupler (ExY-1) | 0.20 |
| Stain preventing agent (Cpd-7) | 0.001 |
| Color fading preventing agent (Cpd-6) | 0.10 |
| Coupler dispersing medium (Cpd-5) | 0.05 |
| Coupler solvent (Solv-2) | 0.05 |
| Twelfth Layer: High-Sensitive Blue-sensitive Layer | |
| Silver bromide emulsion spectrally sensitized with Blue-sensitizing dyes (ExS-5, 6) (average grain size: 1.2 μm, size distribution: 10%, tetradecahedral) | 0.25 |
| Gelatin | 1.00 |
| Yellow coupler (ExY-1) | 0.40 |
| Stain preventing agent (Cpd-7) | 0.002 |
| Color fading preventing agent (Cpd-6) | 0.10 |
| Coupler dispersing medium (Cpd-5) | 0.05 |
| Coupler solvent (Solv-2) | 0.10 |
| Thirteenth Layer: Ultraviolet Light Absorbing Layer | |
| Gelatin | 1.50 |
| Ultraviolet light absorbing agent (Cpd-1, 3, 9, mixing ratio: 1/1/1) | 1.00 |
| Color mixing preventing agent (Cpd-6, 10, mixing ratio: 1/1) | 0.06 |
| Dispersing medium (Cpd-5) | |
| Ultraviolet light absorbing agent solvent (Solv-1, 2, mixing ratio: 1/1) | 0.15 |
| Irradiation preventing dye (Cpd-11, 12, mixing ratio: 1/1) | 0.02 |
| Irradiation preventing dye (Cpd-13, 14, mixing ratio: 1/1) | 0.02 |
| Fourteenth Layer: Protective Layer | |
| Silver chlorobromide fine particles (silver chloride: 97 mol %, average grain size: 0.2 μm) | 0.15 |
| Modified polyvinylaclohol | 0.02 |
| Gelatin | 1.50 |
| Gelatin hardener (H-1) | 0.17 |

A specific example of the preparation of the silver halide emulsions used herein, except that used in Fourteenth layer, is illustrated below.

An aqueous solution of potassium bromide and an aqueous solution of silver nitrate were added simultaneously to a gelatin aqueous solution containing 0.3 g/molAg of 3,4-dimethyl-1,3-thiazoline-2-thion over about 20 minutes at 75° C. while vigorously stirring, to obtain a monodispersed octahedral silver bromide emulsion having an average grain size of about 0.40 μm. 6 mg/molAg of sodium thiosulfate and 7 mg/molAg of chloroauric acid tetrahydrate were added thereto and the emulsion was heated to 75° C. for 80 minutes to accomplish chemical sensitization. While the thus obtained silver bromide particles were used as core particles, the particles were further grown under the same precipitation condition as above to obtain a monodispersed octahedral core/shell type silver bromide having an average grain size of about 0.7 μm. The coefficient of variation of the grain size was about 10%.

1.5 mg/molAg of sodium thiosulfate and 1.5 mg/molAg of chloroauric acid tetrahydrate were added to the emulsion, and the emulsion was heated to 60° C. for 60 minutes to accomplish chemical sensitization, thus an internal latent image type silver halide emulsion was obtained.

To each light-sensitive layer, nucleating agent (N-I-9) and Nucleating accelerator (ExZS-1) were added in amounts of $1\times10^{-3}$ wt % and $1\times10^{-2}$ wt %, respectively, based on the amount of silver halide.

To each layer, emulsifying dispersing aids (Alkanol XC (Du Pont) and sodium alkylbenzenesulfonate, and coating aids (succinic acid ester and Magefac F-120 (Dai Nippon Ink and Chemical Co., Ltd.)) were added. Furthermore, to the layers containing silver halide or colloidal silver, stabilizers (Cdp-15, 16, 17) were added. The thus-obtained photographic light-sensitive material was designated Sample H.

The compounds used in Example 8 are illustrated below.

1,2-Bis(vinylsulfonylacetamido)ethane (H-1)

(N-I-9)

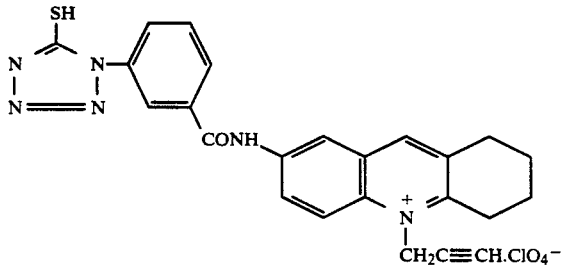

(ExZS-1)

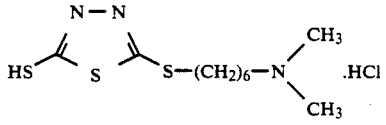

ExS-1

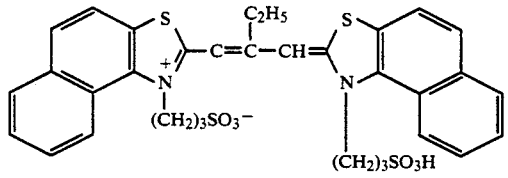

ExS-2

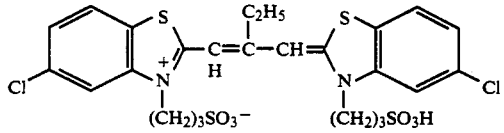

ExS-3

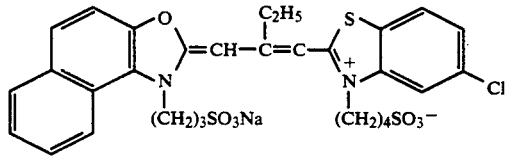

ExS-4

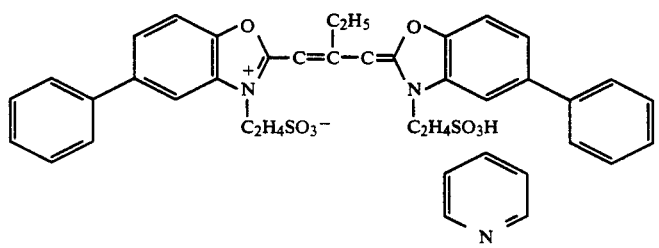

-continued
ExS-5
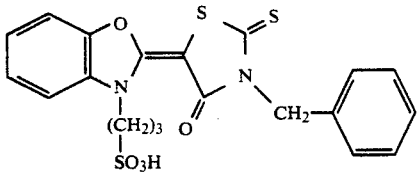
ExS-6
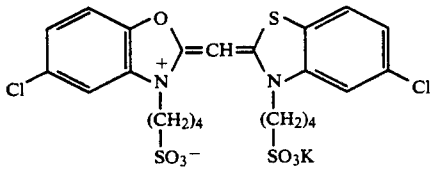
Cpd-1
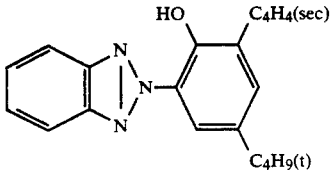
Cpd-2
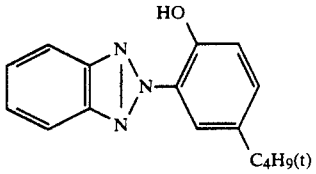
Cpd-3
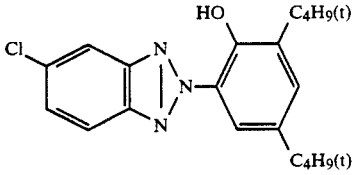
Cpd-4
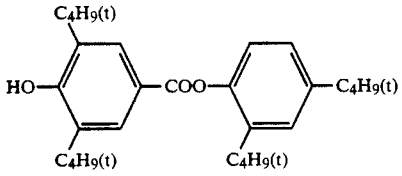
Cpd-5
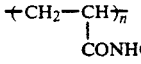
(n = 100 ~ 1000)
Cpd-6
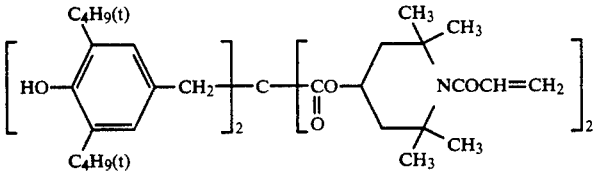
Cpd-7
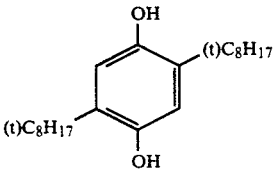
Polyethylacrylate
Cpd-8

-continued
Cpd-9
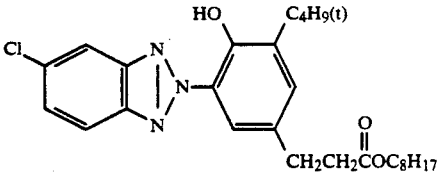
Cpd-10
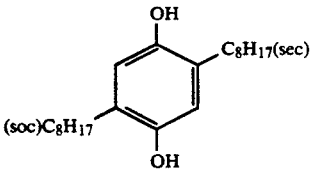
Cpd-11
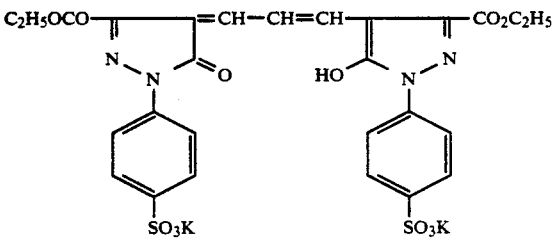
Cpd-12
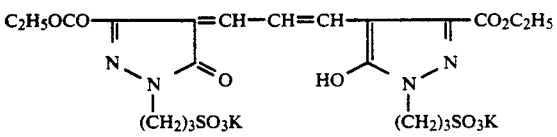
Cpd-13
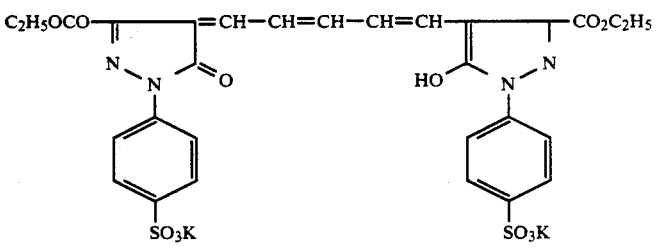
Cpd-14
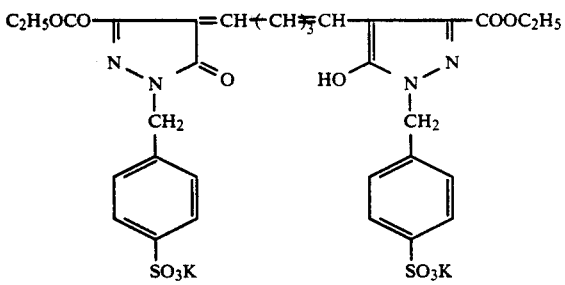
Cpd-15
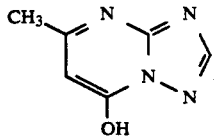
Cpd-16
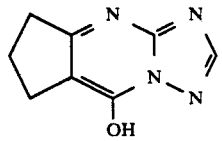

-continued

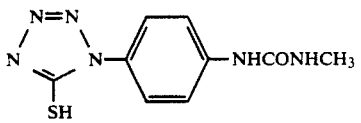

Cpd-17

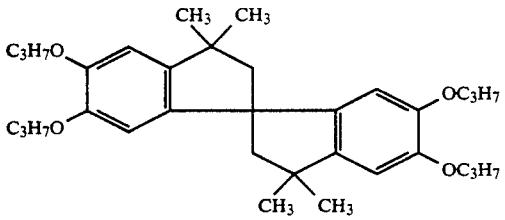

Cpd-18

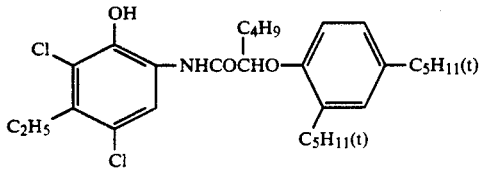

ExC-1

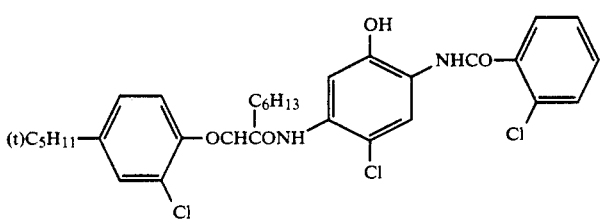

ExC-2

M-25

ExM-1

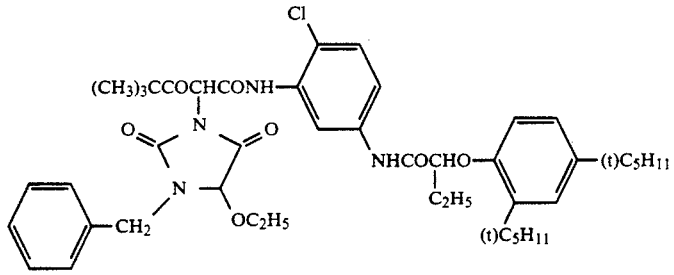

ExY-1

| | |
|---|---|
| Di(2-ethylhexyl)phthalate | (Solv-1) |
| Trinonylphosphate | (Solv-2) |
| Di(3-methylhexyl)phthalate | (Solv-3) |
| Tricresylphosphate | (Solv-4) |
| Dibutylphthalate | (Solv-5) |
| Trioctylphosphate | (Solv-6) |
| Dioctylsebacate | (Solv-7) |

Further, in the same manner as described for Sample H above, except using the combination of the compounds according to the present invention in the Sixth Layer and Seventh Layer of Sample H as shown in Table 8 below, other samples were prepared. The additives were dissolved into the solutions containing the coupler and then the solutions thus obtained were incorporated into the silver halide emulsion.

The samples thus-obtained were exposed to light through an optical wedge, and then processed according to the following Processing A.

Processing A

| Step | Time (sec) | Temperature (°C.) |
|---|---|---|
| Color development | 90 | 38 |
| Bleach-Fixing | 45 | 38 |
| Washing with Water (1) | 45 | 38 |
| Washing with Water (2) | 45 | 38 |

In the water washing steps, water was supplied to the water washing tank (2), and the overflow was introduced to the water washing tank (1) (the so-called countercurrent replenishing system).

The compositions of the processing solutions used were as follows.

| | Mother Solution |
|---|---|
| Color Developing Solution | |
| Diethylenetriaminepentaacetic acid | 0.5 g |
| 1-Hydroxyethylidene-1,1-diphosphonic acid | 0.5 g |
| Diethylene glycol | 8.0 g |
| Benzyl alcohol | 12.0 g |
| Sodium bromide | 0.7 g |
| Sodium sulfite | 2.0 g |
| N,N-Diethylhydroxylamine | 3.5 g |
| Triethylenediamine(1,4-diazabicyclo-(2,2,2)octane) | 3.5 g |
| 3-Methyl-4-amino-N-ethyl-N-(β-methanesulfonamidoethyl)aniline | 6.0 g |
| Potassium carbonate | 30.0 g |
| Fluorescent whitening agent (stilbene type) | 1.0 g |
| Pure water to make | 1,000 ml |
| pH | 10.50 |
| (pH was adjusted with potassium hydroxide or hydrochloric acid.) | |
| Bleach-Fixing Solution | |
| Ammonium thiosulfate | 110 g |
| Sodium hydrogensulfite | 14.0 g |
| Ammonium iron (III) ethylenediaminetetraacetate dihydride | 40.0 g |
| Disodium ethylenediami netetraacetate dihydride | 4.0 g |
| Pure water to make | 1,000 ml |
| pH | 7.0 |
| (pH was adjusted with aqueous ammonia or hydrochloric acid.) | |
| Washing Water | |
| Pure water was used. | |

The term "pure water" used herein means the water produced by processing city water with an ion exchange process whereby the cation concentration and the anion concentration (except hydrogen ion and hydroxide ion) were reduced to 1 ppm or less.

The magenta reflection density of each sample was measured using a Fuji self-recording type densitometer. Then, each sample was subjected to a fading test using a fluorescent lamp tester (15,000 lux) for 30 days. The results thus-obtained are shown in Table 8 below.

TABLE 8

| Sample | Additive | Amount of Additive (mol % to Coupler) | Fluorescent Lamp Fading Test Remaining Ratio of Dye ($D_0$ = 1.5) (%) | Remark |
|---|---|---|---|---|
| H | — | — | 60 | Comparison |
| H-1 | I-20 | 20 | 63 | " |
| H-2 | I-16 | " | 62 | " |
| H-3 | III-58 | " | 62 | " |
| H-4 | A-94 | 50 | 72 | " |
| H-5 | A-100 | " | 75 | " |
| H-6 | I-41/A-56 | 20/50 | 89 | Invention |
| H-7 | III-58/A-1 | " | 87 | " |
| H-8 | I-49/III-26/A-6 | 10/10/50 | 90 | " |

It can be seen from the results shown in Table 8 that almost equivalent results to those in Example 6 are obtained. Specifically, the extent of the effect on the improvement in light fastness based on the combination of the compounds according to the present invention is extremely large in spite of the difference in the layer compositions of photographic light-sensitive material.

While the invention has been described in detail and with reference to specific embodiments thereof, it will be apparent to one skilled in the art that various changes and modifications can be made therein without departing from the spirit and scope thereof.

What is claimed is:

1. A silver halide color photographic material for obtaining a dye image by development processing after image exposure, the development processing including the steps of color development, bleaching and fixing or bleach-fixing, the silver halide photographic material comprising a support having thereon at least one silver halide emulsion layer containing a coupler, wherein the silver halide color photographic material contains (1) at least one compound selected from the group consisting of compounds represented by the general formula (I) or (II), wherein said compound of formula (I) or formula (II) is co-emulsified with the coupler and does not decompose during developing processing, and (2) at least one compound selected from the group consisting of organic color fading preventing agents represented by the general formula (IV), and organic metal complexes containing copper, cobalt, nickel, palladium or platinum as the central metal and having at least one organic ligand having a bidentate or more conformation:

$$R_1\text{-}(A)_n\text{-}X \quad \text{(I)}$$

$$R_2\text{-}\underset{\underset{B}{|}}{C}=Y \quad \text{(II)}$$

wherein $R_1$ and $R_2$ each represents an aliphatic group, an aromatic group or a heterocyclic group; X represents a group capable of being released upon a reaction with an aromatic amine developing agent; A represents a group capable of reacting with an aromatic amine developing agent to form a chemical bond; n represents 0 or 1; B represents a hydrogen atom, an aliphatic group, an aromatic group, a heterocyclic group, an acyl group or an aliphatic or aromatic sulfonyl group; Y represents a group capable of accelerating the addition of an aromatic amine developing agent to the compound represented by the general formula (II); wherein $R_1$ and X, or Y and $R_2$ or B may be connected to each other to form a cyclic structure;

$$R_{30}\text{—}W\text{—}R_{31} \quad \text{(IV)}$$

wherein $R_{30}$ represents an aliphatic group, an aromatic group or a heterocyclic group; $R_{31}$ represents a hydrogen atom, an aliphatic group, an aromatic group, a heterocyclic group or

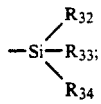

$R_{32}$, $R_{33}$ and $R_{34}$, which may be the same or different, each represents an alkyl group, an alkenyl group, an aryl group, an alkoxy group, an alkenoxy group or an aryloxy group; W represents —O—, —S— or

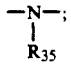

$R_{35}$ represents a hydrogen atom, an aliphatic group, an aromatic group, a heterocyclic group, an acyl group, a sulfonyl group, a sulfinyl group, an oxy-radical group or a hydroxy group; wherein $R_{30}$ and $R_{31}$, or $R_{35}$ and $R_{30}$ or $R_{31}$ may be connected to each other to form a 5-membered to 7-membered ring.

2. A silver halide color photographic material as claimed in claim 1, wherein the compound represented by the general formula (I) or (II) has a second-order reaction rate constant $K_2$ (80° C.) in a reaction with p-anisidine in a range from 1.0 l/mol·sec to $1\times10^{-5}$ l/mol·sec.

3. A silver halide color photographic material as claimed in claim 1, which contains a combination of (i) at least one compound selected from the group consisting of compounds represented by the general formula (I) or (II) and (ii) at least one compound represented by the general formula (III)

$$R—Z \qquad \text{(III)}$$

wherein R represents an aliphatic group, an aromatic group or a heterocyclic group; and Z represents a nucleophilic group or a group capable of being decomposed in the photographic material to release a nucleophilic group.

4. A silver halide color photographic material as claimed in claim 3, wherein the compound represented by the general formula (III) has a nucleophilic functional group or a group derived therefrom each having a Pearson's nucleophilic $^{n}CH_3I$ value of at least 5, as Z.

5. A silver halide color photographic material as claimed in claim 3, wherein the compound represented by the general formula (III) is a compound represented by the following general formula (III-a):

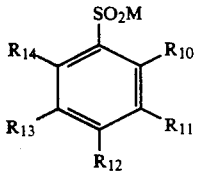

(III-a)

wherein, M represents an atom or an atomic group forming an inorganic salt or an organic salt,

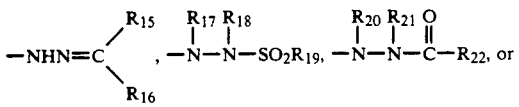

-continued

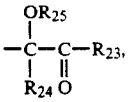

wherein $R_{15}$ and $R_{16}$, which may be the same or different, each represents a hydrogen atom, an aliphatic group, an aromatic group, or a heterocyclic group, wherein $R_{15}$ and $R_{16}$ may be connected to each other to form a 5-membered to 7-membered ring; $R_{17}$, $R_{18}$, $R_{20}$, and $R_{21}$, which may be the same or different, each represents a hydrogen atom, an aliphatic group, an aromatic group, a heterocyclic group, an acyl group, an alkoxycarbonyl group, an aliphatic or aromatic sulfonyl group, a ureido group, or a urethane group, provided that at least one of $R_{17}$ and $R_{18}$ and at least one of $R_{20}$ and $R_{21}$ each represents a hydrogen atom; $R_{19}$ and $R_{22}$ each represents a hydrogen atom, an aliphatic group, an aromatic group, or a heterocyclic group; $R_{19}$ may further represent an alkylamino group, an arylamino group, an alkoxy group, an aryloxy group, an acyl group, an alkoxycarbonyl group, or an aryloxycarbonyl group; wherein at least two of $R_{17}$, $R_{18}$ and $R_{19}$ may be connected to each other to form a 5-membered to 7-membered ring, and at least two of $R_{20}$, $R_{21}$ and $R_{22}$ may be connected to each other to form a 5-membered to 7-membered ring; $R_{23}$ represents a hydrogen atom, an aliphatic group, an aromatic group or a heterocyclic group; $R_{24}$ represents a hydrogen atom, an aliphatic group, an aromatic group, a halogen atom, an acyloxy group or an aliphatic or aromatic sulfonyl group; $R_{25}$ represents a hydrogen atom or an alkali-hydrolizable group; and $R_{10}$, $R_{11}$, $R_{12}$, $R_{13}$, and $R_{14}$, which may be the same or different, each represents a hydrogen atom, an aliphatic group, an aromatic group, a heterocyclic group, a halogen atom, —$SR_{26}$, —$OR_{26}$,

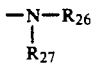

(wherein $R_{26}$ and $R_{27}$, which may be the same or different in the case of —$NR_{26}R_{27}$, each represents a hydrogen atom, an aliphatic group, an alkoxy group, or an aromatic group), an acyl group, an alkoxycarbonyl group, an aryloxycarbonyl group, an aliphatic or aromatic sulfonyl group, an aliphatic or aromatic sulfonamido group, a sulfamoyl group, a ureido group, a urethane group, a carbamoyl group, a sulfo group, a carboxy group, a nitro group, a cyano group, an alkoxyoxalyl group, an aryloxyoxalyl group, an aliphatic or aromatic sulfonyloxy group, —$P(R_{26})_3$,

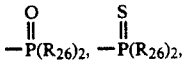

—$P(OR_{26})_3$, (wherein, $R_{26}$ has the same meaning as defined above), or a formyl group.

6. A silver halide color photographic material as claimed in claim 1, wherein the group represented by X in the general formula (I) is a group connected to A through an oxygen atom, a sulfur atom, or a nitrogen atom, or a halogen atom.

7. A silver halide color photographic material as claimed in claim 1, wherein the group represented by A in the general formula (I) is a group containing an atom of low electron density selected from

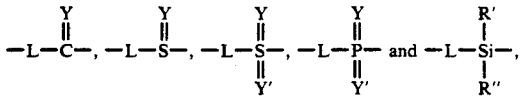

wherein L represents a single bond, an alkylene group, —O—, —S—,

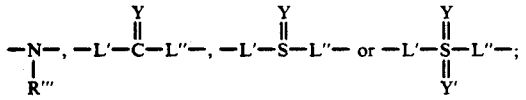

Y has the same meaning as defined in the general formula (II); Y' has the same meaning as defined for Y; R' and R'', which may be the same or different, each represents —L'''—$R_0$; $R_0$ has the same meaning as defined for $R_1$; R''' represents a hydrogen atom, an aliphatic group, an aromatic group, a heterocyclic group, an acyl group or an aliphatic or aromatic sulfonyl group; and L', L'' and L''' each represents —O—, —S— or

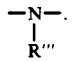

8. A silver halide color photographic material as claimed in claim 7, wherein A represents

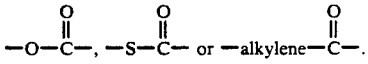

9. A silver halide color photographic material as claimed in claim 1, wherein the compound represented by the general formula (I) is selected from compounds represented by the general formula (I-a), (I-b), (I-c) and (I-d) described below and has a second-order reaction rate constant $K_2$ (80° C.) in a reaction with p-anisidine in the range of from $1\times10^{-1}$ l/mol·sec to $1\times10^{-5}$ l/mol·sec.

(I-a)

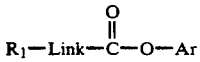

(I-b)

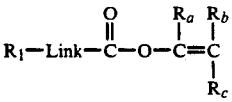

(I-c)

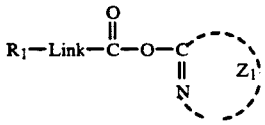

(I-d)

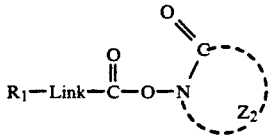

wherein $R_1$ has the same meaning as $R_1$ defined in the general formula (I); Link represents a single bond or —O—; Ar represents an aromatic group provided that it does not become a group useful as a photographic reducing group as a result of reaction with an aromatic amine series developing agent; $R_a$, $R_b$ and $R_c$, which may be the same or different, each represents a hydrogen atom, an aliphatic group, an aromatic group, a heterocyclic group, an alkoxy group, an aryloxy group, a heterocyclic oxy group, a carboxy group, an alkylthio group, an arylthio group, a heterocyclic thio group, an amino group, an alkylamino group, a sulfonamido group, an acyl group, an aliphatic or aromatic sulfonyl group, an alkoxycarbonyl group, a sulfo group, a hydroxyl group, an acyloxy group, a ureido group, a urethane group, a carbamoyl group or a sulfamoyl group, wherein $R_a$ and $R_b$, or $R_b$ and $R_c$, may be connected each other to form a 5-membered to 7-membered hetero ring, which hetero ring may be further substituted with a substituent, or form a spiro ring, a bicyclo ring, or may be fused with an aromatic ring; $Z_1$ and $Z_2$ each represents the non-metallic atomic group necessary for forming a 5-membered to 7-membered hetero ring, which hetero ring may be further substituted with a substituent, or form a spiro ring, a bicyclo ring, or may be fused with an aromatic ring.

10. A silver halide color photographic material as claimed in claim 9, wherein the compound represented by the general formula (I-a), (I-b), (I-c) or (I-d) has the total number of at least 13 carbon atoms.

11. A silver halide color photographic material as claimed in claim 1, wherein the group represented by Y in the general formula (II) is an oxygen atom, a sulfur atom, =N—$R_4$ or

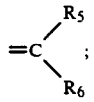

wherein $R_4$, $R_5$ and $R_6$ each represents a hydrogen atom, an aliphatic group, an aromatic group, a heterocyclic group, an acyl group or an aliphatic or aromatic sulfonyl group, wherein $R_5$ and $R_6$ may be connected each other to form a cyclic structure.

12. A silver halide color photographic material as claimed in claim 1, wherein the compound represented by the general formula (IV) is a compound represented by the following general formula (IV-a), (IV-b), (IV-c), (IV-d), (IV-e) or (IV-f):

(IV-a)

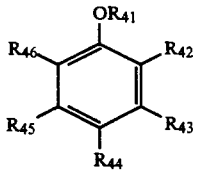

(IV-b)

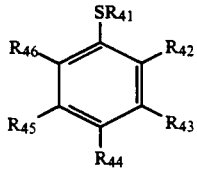

-continued

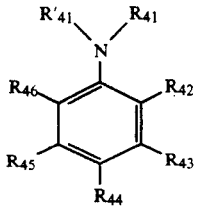

(IV-c)

$R_{50}—O—R_{51}$ (IV-d)

$R_{50}—S—R_{51}$ (IV-e)

$R_{50}—N(R_{35})—N_{51}$ (IV-f)

wherein $R_{41}$ represents a hydrogen atom, an aliphatic group, an aromatic group, a heterocyclic group, or

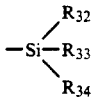

(wherein $R_{32}$, $R_{33}$, and $R_{34}$ each has the same meaning as defined in the general formula (IV); $R_{42}$, $R_{43}$, $R_{44}$, $R_{45}$ and $R_{46}$, which may be the same or different, each represents a hydrogen atom, —W—$R_{31}$, an aliphatic group, an aromatic group, a heterocyclic group, a diacylamino group, a halogen atom, an aliphatic or aromatic sulfonyl group, an aliphatic or aromatic sulfinyl group, an alkoxycarbonyl group, an aryloxycarbonyl group, a ureido group, a urethane group, a sulfamoyl group, a carbamoyl group, a cyano group, a nitro group, an aliphatic or aromatic carbonyloxy group, an aliphatic or aromatic sulfonyloxy group, a silyloxy or an imido group, —W—$R_{31}$ has the same meaning as defined in the general formula (IV), wherein $R_{41}$ and $R_{42}$ may be connected to each other to form a 5-membered to 7-membered ring, or two substituents of $R_{42}$ to $R_{46}$ which are present at the o-position to each other may be connected to each other to form a 5-membered to 7-membered ring, or $R_{31}$ or $R_{35}$ when W represents

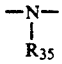

may be connected to a group present at the ortho position thereto to form a 5-membered to 7-membered ring, $R'_{41}$ has the same meaning as $R_{35}$ defined in the general formula (IV), wherein $R'_{41}$ may be connected With $R_{41}$ or $R_{42}$ to form a 5-membered to 7-membered ring, $R_{50}$represents an aliphatic group, a heteroaromatic group, a heterocyclic group, $R_{51}$ represents a hydrogen atom, an aliphatic group, a heteroaromatic group or a heterocyclic group, and $R_{35}$ has the same meaning as defined in the general formula (IV), and $R_{50}$ and $R_{51}$ or $R_{50}$ and $R_{35}$ may be connected to each other to form a 5-membered to 7-membered ring.

13. A silver halide color photographic material as claimed in claim 12, wherein the compound represented by the general formula (IV-a) or (IV-f) is a compound represented by the following general formula (IV-a1), (IV-a2), (IV-a3), (IV-a4), (IV-a5), (IV-a6), (IV-a7), (IV-a8) or (IV-f1):

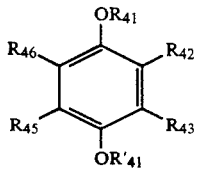

(IV-a1)

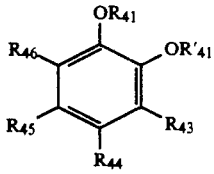

(IV-a2)

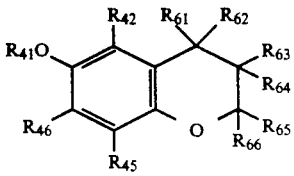

(IV-a3)

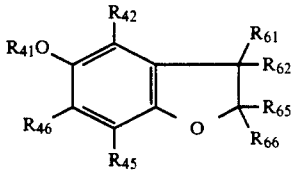

(IV-a4)

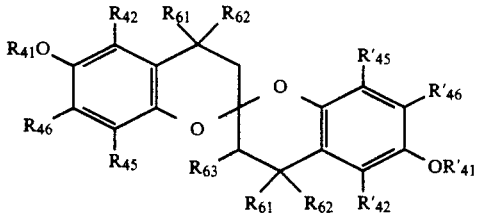

(IV-a5)

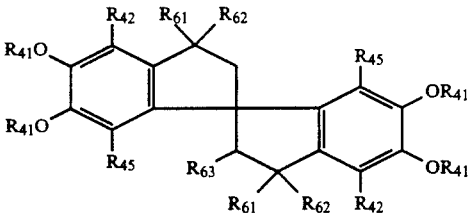

(IV-a6)

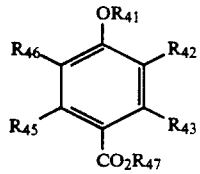

(IV-a7)

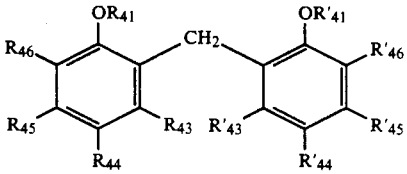

(IV-a8)

-continued (IV-f1)

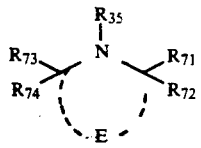

wherein $R_{41}$ to $R_{46}$ each has the same meaning as defined in the general formula (IV-a), $R'_{41}$ and $R'_{42}$ to $R'_{46}$ each has the same meaning as defined for $R_{41}$ and $R_{42}$ to $R_{46}$ respectively, and each substituent may be connected to each other to form a 5-membered to 7-membered ring which is the same as defined in the general formula (IV-a); $R_{61}$ to $R_{64}$, which may be the same or different, each represents a hydrogen atom, an aliphatic group, an aromatic group or a heterocyclic group; $R_{65}$ and $R_{66}$, which may be the same or different, each represents a hydrogen atom, an aliphatic group, an aromatic group, a heterocyclic group, an alkoxy group, an aryloxy group, an alkylthio group, an arylthio group, an alkylamino group, an acylamino group, or

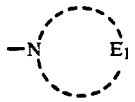

wherein $E_1$ represents a non-metallic atomic group necessary to from a 5-membered to 7-membered ring; $R_{35}$ has the same meaning as defined in the general formula (IV-f); E represents a non-metallic atomic group necessary to form a 5-membered to 7-membered ring; and $R_{71}$ to $R_{74}$, which may be the same or different, each represents a hydrogen atom or an alkyl group.

14. A silver halide color photographic material as claimed in claim 1, wherein the central metal of the organic metal complex is nickel.

15. A silver halide color photographic material as claimed in claim 1, wherein the organic metal complex is a complex represented by the following general formula (V-a), (V-b), (V-c) or (V-d):

(V-a)

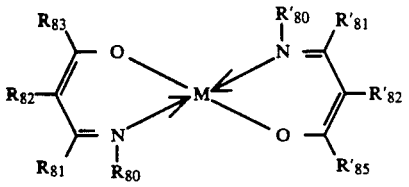

(V-b)

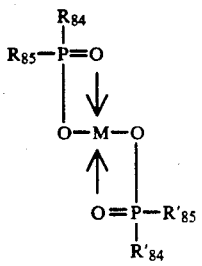

-continued (V-c)

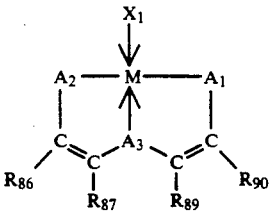

(V-a)

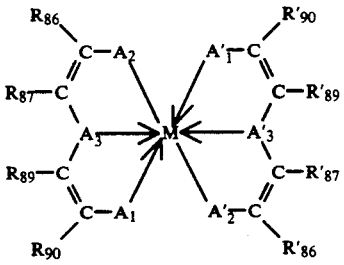

wherein M represents copper, cobalt, nickel, palladium or platinum; $R_{80}$ and $R'_{80}$, which may be the same or different, each represents a hydrogen atom, an alkyl group, an aryl group or a hydroxy group; wherein $R_{80}$ and $R'_{80}$ may be connected to each other; $R_{81}$, $R_{82}$, $R_{83}$, $R'_{81}$, $R'_{82}$ and $R'_{83}$, which may be the same or different, each represents a hydrogen atom, an alkyl group or an aryl group, wherein $R_{82}$ and $R_{83}$ or $R'_{82}$ and $R'_{83}$ may be connected to each other to form an aromatic ring or a 5-membered to 8-membered ring; $R_{84}$, $R_{85}$, $R'_{84}$ and $R'_{85}$, which may be the same or different, each represents an alkyl group, an aryl group, an alkylthio group, an arylthio group, an alkoxy group, an aryloxy group, an alkylamino group or an arylamino group; $R_{86}$, $R_{87}$, $R_{88}$, $R_{89}$, $R_{90}$, $R'_{86}$, $R'_{87}$, $R'_{88}$, $R'_{89}$ and $R'_{90}$, which may be the same or different, each represents a hydrogen atom, an alkyl group or an aryl group, wherein at least one of $R_{86}$ and $R_{87}$, $R_{89}$ and $R_{90}$, $R'_{86}$ and $R'_{87}$ and $R'_{89}$ and $R'_{90}$ may be connected to each other to form an aromatic ring or a 5-membered to 8-membered ring; $X_1$ represents a compound capable of coordinating to M; $A_1$, $A_2$, $A'_1$ and $A'_2$, which may be the same or different, each represents an oxygen atom, a sulfur atom, —$NR_{91}$—, a hydroxy group, an alkoxy group, an alkylthio group or

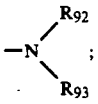

$R_{91}$ represents a hydrogen atom, an alkyl group, an aryl group, a hydroxy group or an alkoxy group; $R_{92}$ and $R_{93}$, which may be the same or different, each represents a hydrogen atom or an alkyl group; and $A_3$ and $A'_3$ each represents an oxygen atom, a sulfur atom or —NH—.

16. A silver halide color photographic material as claimed in claim 1, wherein the color photographic material contains at least one of a yellow coupler, a magenta coupler and a cyan coupler.

17. A silver halide color photographic material as claimed in claim 16, wherein the coupler is selected from those represented by the following general formula (C-I), (C-II), (M-I), (M-II) or (Y);

(C-I)

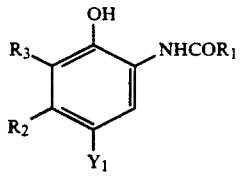

(C-II)

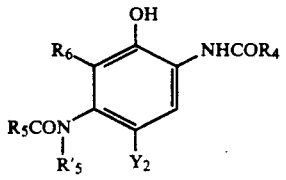

(M-I)

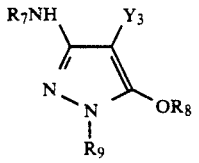

(M-II)

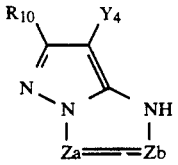

-continued (Y)

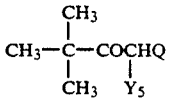

wherein, $R_1$, $R_4$, and $R_5$ each represents an aliphatic group, an aromatic group, a heterocyclic group, an aromatic amino group or a heterocyclic amino group; $R_2$ represents an aliphatic group; $R_3$ and $R_6$ each represents a hydrogen atom, a halogen atom, an aliphatic group, an aliphatic oxy group, or an acylamino group; $R_5'$ represents a hydrogen atom, or a group represented by $R_5$ defined above; $R_7$ and $R_9$ each represents a substituted or unsubstituted phenyl group; $R_8$ represents a hydrogen atom, an aliphatic acyl group, an aromatic acyl group, an aliphatic sulfonyl group, or an aromatic sulfonyl group; $R_{10}$ represents a hydrogen atom or a substituent; Q represents a substituted or unsubstituted N-phenylcarbamoyl group; Za and Zb each represents a methine group, a substituted methine group, or =N—; and $Y_1$, $Y_2$, $Y_3$, $Y_4$, and $Y_5$ each represents a hydrogen atom, or a group capable of releasing upon a coupling reaction with the oxidation product of a color developing agent; wherein $R_2$ and $R_3$ or $R_5$ and $R_6$ may be connected to each other to form a 5-membered to 7-membered ring; or $R_1$, $R_2$, $R_3$ or $Y_1$; $R_4$, $R_5$, $R_6$ or $Y_2$; $R_7$, $R_8$, $R_9$ or $Y_3$; $R_{10}$, $Z_a$, $Z_b$ or $Y_4$; and Q or $Y_5$ each may form a dimer or a higher polymer.

18. A silver halide color photographic material as claimed in claim 1, wherein each amount of said at least one of compounds of (1) and said at least one of compounds of (2) is from $1\times10^{-2}$ to 10 mols per mol of the coupler in the same layer.

19. A silver halide color photographic material as claimed in claim 18, wherein the molar ratio of the amount of said at least one of compounds of (1) and said at least one of compounds (2) is from 0.1 to 10.

* * * * *